US010394145B2

(12) United States Patent
Watanabe et al.

(10) Patent No.: US 10,394,145 B2
(45) Date of Patent: Aug. 27, 2019

(54) TONER FOR ELECTROPHOTOGRAPHY

(71) Applicant: KAO CORPORATION, Chuo-ku (JP)

(72) Inventors: Shogo Watanabe, Izumiotsu (JP); Kunihiro Kano, Wakayama (JP)

(73) Assignee: Kao Corporation, Chuo-ku (JP)

( * ) Notice: Subject to any disclaimer, the term of this patent is extended or adjusted under 35 U.S.C. 154(b) by 405 days.

(21) Appl. No.: 15/107,155

(22) PCT Filed: Dec. 24, 2014

(86) PCT No.: PCT/JP2014/084081

§ 371 (c)(1),
(2) Date: Jun. 22, 2016

(87) PCT Pub. No.: WO2015/098931

PCT Pub. Date: Jul. 2, 2015

(65) Prior Publication Data

US 2018/0196366 A1 Jul. 12, 2018

(30) Foreign Application Priority Data

Dec. 27, 2013 (JP) ..... 2013-273480
Dec. 27, 2013 (JP) ..... 2013-273481
Dec. 27, 2013 (JP) ..... 2013-273482
Dec. 27, 2013 (JP) ..... 2013-273483
Mar. 28, 2014 (JP) ..... 2014-068986

(51) Int. Cl.
*G03G 9/087* (2006.01)
*G03G 9/08* (2006.01)

(52) U.S. Cl.
CPC ..... *G03G 9/0806* (2013.01); *G03G 9/081* (2013.01); *G03G 9/0812* (2013.01); *G03G 9/0819* (2013.01); *G03G 9/0821* (2013.01); *G03G 9/08755* (2013.01); *G03G 9/08762* (2013.01); *G03G 9/08782* (2013.01)

(58) Field of Classification Search
CPC ..... G03G 9/08755
See application file for complete search history.

(56) References Cited

U.S. PATENT DOCUMENTS

2003/0165764 A1* 9/2003 Suwa ..... G03G 9/08748 430/109.4
2006/0030690 A1 2/2006 Mihara et al.
2007/0207401 A1 9/2007 Shirai
2007/0287090 A1 12/2007 Eida
2008/0227002 A1* 9/2008 Moriya ..... G03G 9/0804 430/48
2009/0170020 A1 7/2009 Kubo et al.
2011/0065036 A1* 3/2011 Inoue ..... G03G 9/08755 430/108.2
2011/0294062 A1 12/2011 Eida et al.
2012/0115080 A1 5/2012 Kitagawa
2012/0288791 A1 11/2012 Sakashita et al.
2013/0022907 A1 1/2013 Fukagawa et al.
2013/0287419 A1 10/2013 Matsumoto
2015/0323877 A1 11/2015 Ashizawa et al.

FOREIGN PATENT DOCUMENTS

JP 2002-55490 A 2/2002
JP 2002-55491 A 2/2002
JP 2003-40990 A 2/2003
JP 2003-40990 A5 2/2003
JP 2003-323002 A 11/2003
JP 2004-250663 9/2004
JP 2004-258265 A 9/2004
JP 2005-248117 9/2005
JP 2005-308995 A 11/2005
JP 2006-154624 6/2006
JP 2007-328224 A 12/2007
JP 2008-262179 * 10/2008 ..... G03G 9/087
JP 2009-230064 A 10/2009
JP 2010-8579 A 1/2010
JP 2010-101993 A 5/2010
JP 2010-122306 A 6/2010
JP 2010-286592 12/2010
JP 2011-128197 A 6/2011
JP 2011-141490 A 7/2011
JP 2012-8529 A 1/2012
JP 2012-98617 A 5/2012
JP 2012-107175 6/2012

(Continued)

OTHER PUBLICATIONS

Translation of JP 2008-262179.*
Translation of JP 2013-242509.*
International Search Report dated Feb. 10, 2015 in PCT/JP2014/084081.
Extended European Search Report dated Jun. 30, 2017 in Patent Application No. 14874532.6.
Office Action dated Sep. 13, 2017 in Japanese Patent Application No. 2013-273482.
Office Action dated Sep. 14, 2017 in Japanese Patent Application No. 2013-273480.

(Continued)

*Primary Examiner* — Peter L Vajda

(74) *Attorney, Agent, or Firm* — Oblon, McClelland, Maier & Neustadt, L.L.P.

(57) ABSTRACT

A toner for electrophotography obtained by a method including: step 1: mixing a polyester and a polylactic acid at a temperature of 140° C. or higher and 200° C. or lower and subjecting the mixture to a transesterification reaction to provide a resin composition; and step 2: mixing the resin composition obtained in step 1 with a polyester which is identical to and/or different from the polyester of step 1, and a method for producing the toner. The toner for electrophotography of the present invention is suitably used in developing latent images formed in an electrophotographic method, an electrostatic recording method, an electrostatic printing method, or the like.

7 Claims, No Drawings

(56) References Cited

FOREIGN PATENT DOCUMENTS

| | | | | | |
|---|---|---|---|---|---|
| JP | 2012-118494 | A | | 6/2012 | |
| JP | 2013-97008 | A | | 5/2013 | |
| JP | 2013-122059 | A | | 6/2013 | |
| JP | 2013-242509 | | * | 12/2013 | ..... G03G 9/08 |
| JP | 2013-242509 | A | | 12/2013 | |
| JP | 2014-74892 | A | | 4/2014 | |
| JP | 2015-127761 | A | | 7/2015 | |
| JP | 2015-127762 | A | | 7/2015 | |
| JP | 2015-127763 | A | | 7/2015 | |
| JP | 2015-127764 | A | | 7/2015 | |
| WO | WO 2014/069257 | A1 | | 5/2014 | |

OTHER PUBLICATIONS

Office Action dated Sep. 14, 2017 in Japanese Patent Application No. 2013-273481.

* cited by examiner

TONER FOR ELECTROPHOTOGRAPHY

FIELD OF THE INVENTION

The present invention relates to a toner for electrophotography usable in developing latent images formed in an electrostatic development method, an electrostatic recording method, an electrostatic printing method, or the like, and a method for producing the toner.

BACKGROUND OF THE INVENTION

In the recent year, from the viewpoint of high reliability that would not impair properties of toners even under the various circumstances, together with the advancement of miniaturization, speed-up, and high-quality image formation of electrophotographic apparatuses, improvements in low-temperature fusing ability and durability are earnestly in demand for the toner used in electrophotography.

On the other hand, in a toner which is a developer for electrophotography, use of polylactic acid which is a plant-derived raw material is studied for the purpose of reduction in environmental loads.

For example, it is disclosed that a toner for electrophotography characterized in that a resin containing a degradable polyester resin containing a poly α-hydroxycarboxylic acid and a polyester-based resin other than the above is used as a resin binder gives favorable deinking ability and degree of whiteness, has favorable wax dispersibility, fusing ability, pulverizability, hot offset resistance and storage property, and has excellent properties as a toner for electrophotography (see, Patent Publications 1 and 2).

In addition, from the viewpoint of energy conservation, i.e. reducing energy consumption in the fusing step, together with the advancement of miniaturization, speeding-up and high-quality image formation of the electrophotographic apparatus, an improvement in low-temperature fusing ability of the toner is earnestly in demand. In order to meet this demand, a toner in which a resin binder containing a crystalline resin and an amorphous resin is used is proposed. However, while a toner in which a crystalline resin and an amorphous resin are used has improved low-temperature fusing ability, the toner is likely to have a lowered toner strength. As a result, if a toner is applied with a larger mechanical or thermal stress to meet the demands of the speeding-up and miniaturization, a disadvantage concerning the lowering of gloss or durability is generated.

In order to overcome such a disadvantage, for example, it is proposed that a toner having excellent low-temperature fusing ability, and also having favorable pulverizability and storage property can be produced according to a method for producing a toner including the steps of melt-kneading raw materials containing two or more kinds of polyesters, a heat-treating step, a pulverizing step, and a classifying step, wherein the two or more kinds of the polyesters contain at least one kind of an amorphous polyester, and wherein the heat-treating step is carried out at temperatures and time that satisfy a particular relationship (see, Patent Publication 3).

In addition, it is disclosed a toner containing a resin binder comprising a crystalline resin and an amorphous resin, and a colorant, wherein the crystalline resin contains a composite resin containing a polycondensation resin component obtained by polycondensing an alcohol component containing an aliphatic diol having from 2 to 10 carbon atoms, and a carboxylic acid component containing an aromatic dicarboxylic acid compound, and a styrenic resin component, and wherein the amorphous resin contains a polyester obtained from an alcohol component containing an aliphatic diol in an amount of 60% by mol or more, and a carboxylic acid component, the toner having excellent low-temperature fusing ability and storage stability, suppressed unevenness in optical density, shorter time period for a heat-treating step, and excellent productivity (see, Patent Publication 4).

In addition, from the viewpoint of high reliability that would not impair properties of toners even under the various circumstances, together with the advancement of miniaturization, speed-up, and high-quality image formation of electrophotographic apparatuses, improvements in durability of the toner and developability under high-temperature, high-humidity environmental conditions are earnestly in demand.

In order to meet this demand, for example, it is disclosed that a positively chargeable toner comprising toner matrix particles containing at least a colorant and a resin binder containing a polyester, and an external additive which is externally added to the toner matrix particles, wherein the positively chargeable toner contains the toner matrix particles, silica A having a BET specific surface area of from 50 to 200 $m^2/g$ which is surface-treated with an external additive a fluorine-based silane coupling agent, and silica B having a BET specific surface area of from 50 to 200 $m^2/g$ which is surface-treated with an amino-modified silicone, wherein the positively chargeable toner gives a wide transferable region even under high-temperature, high-humidity conditions is provided (see, Patent Publication 5).

In addition, it is disclosed that a toner for a nonmagnetic monocomponent development used in a developer apparatus holding a toner carrier in a noncontact manner with an electrostatic latent image carrier containing a resin binder, a colorant and an external additive, wherein the external additive contains (a) a hydrophobic rutile type titanium oxide having an average particle size of primary particles of from 5 to 30 nm which is hydrophobically treated with a silane coupling agent, (b) a hydrophobic silica having an average particle size of primary particles of from 6 to 14 nm which is hydrophobically treated with hexamethyldisilazane, and (c) a hydrophobic silica having an average particle size of primary particles of from 20 to 100 nm which is hydrophobically treated with a silicone oil, the toner for nonmagnetic monocomponent development having favorable transferability even under the high-temperature, high-humidity environmental conditions is provided (see, Patent Publication 6).

A polyester has excellent fusing ability and durability as a resin binder for toner, but has stronger negative chargeability as compared to a styrene-acrylic resin or the like, so that improvement of chargeability is needed in a case where a polyester is used as a resin binder for a positively chargeable toner. In view of the above, a technique of adding a charge control resin (CCR) having favorable positive chargeability is known as a means to improve positive chargeability of a polyester.

For example, it is disclosed a positively chargeable toner containing a resin binder and a charge control resin in which the resin binder contains two kinds of polyesters of which storage moduli are in a specified relationship, and the charge control resin contains a styrene-acrylic copolymer having a specified storage moduli, the positively chargeable toner providing favorable chargeability, and having excellent inhibition in the generation of background fog and excellent solid image quality (see, Patent Publication 7).

In addition, from the viewpoint of high reliability, together with the advancement of miniaturization, speed-up, and high-quality image formation of electrophotographic apparatuses, improvements in developability and flowability of the toner are earnestly in demand.

In order to meet this demand, chargeability and flowability are improved by treating the surface of toner matrix particle with an external additive such as fine inorganic particles, but it is known that when detachment of the external additive is occurred upon use of the toner, damages is generated on a photoconductor by detached external additive, and which in turn causes image defects. Therefore, a method for firmly immobilizing an external additive on the toner matrix particles in a proper amount is considered.

For example, a method for producing a toner including the steps of pulverizing a toner composition containing at least a resin binder and a colorant in the presence of fine inorganic particles having an average primary particle size of from 6 to 20 nm to provide toner matrix particles having a volume-median particle size of from 3 to 8 μm, and externally adding a silica having average primary particle size of from 25 to 60 nm to the toner matrix particle obtained (see, Patent Publication 8).

Patent Publication 1: Japanese Patent Laid-Open No. 2003-323002

Patent Publication 2: Japanese Patent Laid-Open No. 2002-55491

Patent Publication 3: Japanese Patent Laid-Open No. 2005-308995

Patent Publication 4: Japanese Patent Laid-Open No. 2012-8529

Patent Publication 5: Japanese Patent Laid-Open No. 2010-122306

Patent Publication 6: Japanese Patent Laid-Open No. 2004-258265

Patent Publication 7: Japanese Patent Laid-Open No. 2010-8579

Patent Publication 8: Japanese Patent Laid-Open No. 2007-328224

SUMMARY OF THE INVENTION

The present invention relates to:

[1] a toner for electrophotography obtained by a method including:

step 1: mixing a polyester and a polylactic acid at a temperature of 140° C. or higher and 200° C. or lower and subjecting the mixture to a transesterification reaction to provide a resin composition; and step 2: mixing the resin composition obtained in step 1 with a polyester which is identical to and/or different from the polyester of step 1; and

[2] a method for producing a toner for electrophotography characterized in that the method includes:

step 1: mixing a polyester and a polylactic acid at a temperature of 140° C. or higher and 200° C. or lower and subjecting the mixture to a transesterification reaction to provide a resin composition; and step 2: mixing the resin composition obtained in step 1 with a polyester which is identical to and/or different from the polyester of step 1, in a production of a toner for electrophotography.

DETAILED DESCRIPTION OF THE INVENTION

However, conventional techniques of Patent Publications 1, 2 and the like are insufficient to satisfy with low-temperature fusing ability and durability at the same time.

The present invention relates to a toner for electrophotography having excellent low-temperature fusing ability and durability, and a method for producing the toner.

Further, the present invention relates to a toner for electrophotography having excellent low-temperature fusing ability, gloss, and durability, and a method for producing the toner.

Further, the present invention relates to a toner for electrophotography having excellent developability (inhibition of background fog) under high-temperature, high-humidity environmental conditions and durability, and a method for producing the toner.

Further, the present invention relates to a positively chargeable toner having excellent durability and low-temperature fusing ability, and being capable of inhibiting the generation of background fog, and a method for producing the toner.

Further, the present invention relates to a method for producing a toner for electrophotography being capable of inhibiting the generation of background fog on an image or damages on a photoconductor, and also having excellent flowability.

The toner for electrophotography of the present invention has excellent low-temperature fusing ability and durability.

The toner for electrophotography of the present invention in which a crystalline polyester and an amorphous polyester are used in combination has excellent low-temperature fusing ability, gloss, and durability.

The toner for electrophotography of the present invention containing a hydrocarbon wax has excellent developability under high-temperature, high-humidity environmental conditions and durability.

The positively chargeable toner of the present invention containing a positively chargeable charge control agent has excellent durability and low-temperature fusing ability, and inhibits the generation of background fog.

The toner for electrophotography obtained by a method of the present invention including pulverizing a melt-kneaded mixture in the presence of fine inorganic particles inhibits the generation of background fog on an image or damages on a photoconductor, and has excellent flowability.

The toner for electrophotography of the present invention is obtained by a method including:

step 1: mixing a polyester and a polylactic acid at a temperature of 140° C. or higher and 200° C. or lower and subjecting the mixture to a transesterification reaction to provide a resin composition; and step 2: mixing the resin composition obtained in step 1 with a polyester which is identical to and/or different from the polyester of step 1, and exhibits effects of excellent low-temperature fusing ability and durability.

The reasons why such effects are exhibited are not elucidated, and they are considered to be as follows.

In the present invention, a resin composition obtained by subjecting a polyester and polylactic acid to a transesterification reaction contains unreacted polyester and polylactic acid, and a polyester-polylactic acid copolymer generated by the transesterification reaction therebetween. The miscibility of a polyester and a polylactic acid is worsened, so that if the polyester and the polylactic acid are melt-kneaded, they remain separated and cannot be produced into a toner. However, the miscibility of a polyester and a polylactic acid in a mixture is improved when previously mixing the polyester and the polylactic acid and subjecting a part of them to a transesterification reaction to produce a polyester-polylactic acid copolymer, and a resin composition after the reaction does not have a state in which the polyester and the polylactic acid are separated and formed in a state of high strength in which a polyester and a polylactic acid are copresent in closely arranged state. Moreover, in a toner obtained by using this resin composition containing a polyester, a polylactic acid and a polyester-polylactic acid copolymer, melting of a polylactic acid phase is promoted, because the melting of a polyester phase and the activation of the molecular movements of the polyester-polylactic acid copolymer take place at the same time. As a result, it is considered that an improvement effect of low-temperature fusing ability is obtained and an improvement effect of durability by the resin composition having high strength which contains a polyester, a polylactic acid and a polyester-polylactic acid copolymer is exhibited at the same time.

Step 1 is a step of mixing a polyester and a polylactic acid at a temperature of 140° C. or higher and 200° C. or lower and subjecting the mixture to a transesterification reaction to provide a resin composition.

A polyester is preferably a polyester obtained by polycondensing an alcohol component containing a dihydric or higher polyhydric alcohol and a carboxylic acid component containing a dicarboxylic or higher polycarboxylic acid compound, and more preferably an amorphous polyester.

In the present invention, the crystallinity of the polyester is expressed by a crystallinity index defined by a value of a ratio of a softening point to a highest temperature of endothermic peak determined by a scanning differential calorimeter, i.e. softening point/highest temperature of endothermic peak. The amorphous polyester refers to a polyester having a crystallinity index exceeding 1.4 or less than 0.6, and preferably exceeding 1.5 or 0.5 or less. The crystallinity of the polyester can be adjusted by the kinds of the raw material monomers and ratios thereof, production conditions, e.g., reaction temperature, reaction time, cooling rate, and the like. Here, the highest temperature of endothermic peak refers to a temperature of the peak on the highest temperature side among endothermic peaks observed. When a difference between the highest temperature of endothermic peak and the softening point is within 20° C., the highest temperature of endothermic peak is defined as a melting point. When the difference between the highest temperature of endothermic peak and the softening point exceeds 20° C., the peak is a peak temperature ascribed to a glass transition.

The alcohol component includes an aliphatic diol, an alicyclic diol, an aromatic diol, and the like, and the aliphatic diol and the aromatic diol are preferred, from the viewpoint of improving durability, low-temperature fusing ability, high-temperature offset resistance and heat-resistant storage property of the toner, from the viewpoint of inhibiting background fog, from the viewpoint of improving flowability of the toner, and from the viewpoint of inhibiting the generation of damages on a photoconductor. Further, the aliphatic diol is preferred, from the viewpoint of improving low-temperature fusing ability and gloss, and from the viewpoint of inhibiting background fog, and the aromatic diol is preferred, from the viewpoint of improving flowability and heat-resistant storage property of the toner.

The number of carbon atoms of the aliphatic diol is preferably 2 or more, and more preferably 3 or more, from the viewpoint of improving low-temperature fusing ability and gloss of the toner. In addition, the number of carbon atoms is preferably 10 or less, more preferably 8 or less, even more preferably 6 or less, and even more preferably 4 or less, from the viewpoint of improving heat-resistant storage property, from the viewpoint of improving flowability of the toner, and from the viewpoint of inhibiting the generation of background fog on an image and damages on a photoconductor.

The aliphatic diol includes ethylene glycol, 1,2-propanediol, 1,3-propanediol, 1,2-butanediol, 1,3-butanediol, 1,4-butanediol, 2,3-butanediol, 1,2-pentanediol, 1,3-pentanediol, 1,4-pentanediol, 1,5-pentanediol, 2,3-pentanediol, 2,4-pentanediol, 1,2-hexanediol, 1,3-hexanediol, 1,4-hexanediol, 1,5-hexanediol, 1,6-hexanediol, 2,3-hexanediol, 3,4-hexanediol, 2,4-hexanediol, 2,5-hexanediol, 1,4-butenediol, neopentyl glycol, and the like.

Among them, an aliphatic diol having a hydroxyl group bonded to a secondary carbon atom is preferred from the viewpoint of improving heat-resistant storage property, low-temperature fusing ability, gloss and flowability of the toner, and from the viewpoint of inhibiting the generation of background fog on an image and damages on a photoconductor. The number of carbon atoms of the aliphatic diol is preferably 3 or more from the viewpoint of improving low-temperature fusing ability and gloss of the toner. In addition, the number of carbon atoms of the aliphatic diol is preferably 6 or less, and more preferably 4 or less, from the viewpoint of improving durability and heat-resistant storage properly of the toner, from the viewpoint of inhibiting background fog, and from the viewpoint of inhibiting the generation of damages on a photoconductor. Specific examples include 1,2-propanediol, 1,2-butanediol, 1,3-butanediol, 2,3-butanediol, 1,2-pentanediol, 1,3-pentanediol, 2,3-pentanediol, 2,4-pentanediol, and the like, 1,2-propanediol and 2,3-butanediol are preferred, and 1,2-propanediol is more preferred, from the viewpoint of improving durability, heat-resistant storage property, low-temperature fusing ability, gloss and flowability of the toner, from the viewpoint of inhibiting background fog, and from the viewpoint of inhibiting the generation of damages on a photoconductor.

The content of the aliphatic diol is preferably 50% by mol or more, more preferably 80% by mol or more, and even more preferably 90% by mol or more, and preferably 100% by mol or less, and more preferably substantially 100% by mol, of the alcohol component, from the viewpoint of improving low-temperature fusing ability and gloss of the toner, from the viewpoint of inhibiting background fog, and from the viewpoint of inhibiting the generation of damages on a photoconductor. The content of the aliphatic diol having a hydroxyl group bonded to a secondary carbon atom is preferably 50% by mol or more, more preferably 80% by mol or more, and even more preferably 90% by mol or more, and preferably 100% by mol or less, and more preferably substantially 100% by mol, of the alcohol component, from the viewpoint of improving durability, heat-resistant storage property and flowability of the toner, from the viewpoint of inhibiting background fog, and from the viewpoint of inhibiting the generation of damages on a photoconductor.

Specific examples of the aromatic diol include alkylene oxide adducts of bisphenol A represented by the formula (I):

(I)

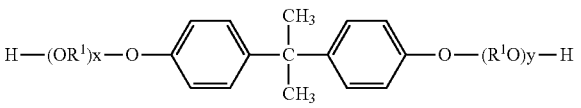

wherein $R^1O$ and $OR^1$ are an oxyalkylene group, wherein $R^1$ is an ethylene and/or a propylene group, x and y each shows an average number of moles of the alkylene oxide added, each being a positive number, and the sum of x and y is preferably 1 or more and 16 or less, more preferably 1 or more and 8 or less, and even more preferably 1.5 or more and 4 or less, and the like.

The content of the aromatic diol is preferably 50% by mol or more, more preferably 80% by mol or more, and even more preferably 90% by mol or more, and preferably 100% by mol or less, and more preferably substantially 100% by mol, of the alcohol component, from the viewpoint of improving durability, heat-resistant storage property and flowability of the toner.

Other alcohol components include a trihydric or higher polyhydric alcohol and the like such as glycerol.

The carboxylic acid component of the polyester preferably contains an aromatic dicarboxylic acid compound, from the viewpoint of improving durability heat-resistant storage property and flowability of the toner.

The aromatic dicarboxylic acid compound includes phthalic acid, isophthalic acid, terephthalic acid, anhydrides thereof, alkyl esters thereof having carbon atoms of 1 or more and 3 or less, and the like.

The content of the aromatic dicarboxylic acid compound is preferably 50% by mol or more, more preferably 70% by mol or more, even more preferably 85% by mol or more, and even more preferably 90% by mol or more, and preferably 100% by mol or less, of the carboxylic acid component, from the viewpoint of improving durability, heat-resistant storage property and flowability of the toner.

In addition, the carboxylic acid component of the polyester preferably contains a tricarboxylic or higher polycarboxylic acid compound, from the viewpoint of improving durability, heat-resistant storage property and flowability of the toner.

The tricarboxylic or higher polycarboxylic acid compound includes, for example, tricarboxylic or higher polycarboxylic acids having 4 or more and 30 or less carbon atoms, preferably 4 or more and 20 or less carbon atoms, and more preferably 4 or more and 10 or less carbon atoms; anhydrides thereof; alkyl esters having 1 or more and 3 or less carbon atoms; and the like. Here, the number of carbon atoms of the carboxylic acid compound does not include the number of carbon atoms of an alkyl group of the alkyl ester.

Specific examples include 1,2,4-benzenetricarboxylic acid (trimellitic acid), 2,5,7-naphthalenetricarboxylic acid, 1,2,4,5-benzenetetracarboxylic acid (pyromellitic acid), and the like, 1,2,4-benzenetricarboxylic acid (trimellitic acid) and an anhydride thereof are preferred, and 1,2,4-benzenetricarboxylic acid anhydride (trimellitic anhydride) is more preferred, from the viewpoint of improving durability, heat-resistant storage property and flowability of the toner.

The content of the tricarboxylic or higher polycarboxylic acid compound is preferably 1% by mol or more, more preferably 2% by mol or more, even more preferably 5% by mol or more, and even more preferably 10% by mol or more, of the carboxylic acid component, from the viewpoint of improving durability and heat-resistant storage property of the toner. In addition, the content of the tricarboxylic or higher polycarboxylic acid compound is preferably 2% by mol or more, and more preferably 5% by mol or more, from the viewpoint of improving durability and flowability of the toner.

In addition, the content of the tricarboxylic or higher polycarboxylic acid compound is preferably 20% by mol or less, more preferably 15% by mol or less more, and even more preferably 10% by mol or less, of the carboxylic acid component, from the viewpoint of improving low-temperature fusing ability of the toner. In addition, the content of the tricarboxylic or higher polycarboxylic acid compound is preferably 20% by mol or less, more preferably 10% by mol or less, and even more preferably 6% by mol or less, from the viewpoint of improving low-temperature fusing ability and gloss of the toner.

Other carboxylic acid component includes aliphatic dicarboxylic acid such as oxalic acid, malonic acid, maleic acid, fumaric acid, succinic acid, adipic acid, sebacic acid, azelaic acid, succinic acid substituted with an alkyl group having 1 or more and 30 or less carbon atoms or an alkenyl group having 2 or more and 30 or less carbon atoms; alicyclic dicarboxylic acids such as cyclohexanedicarboxylic acid; rosins such as unpurified rosins and purified rosins; rosins modified with fumaric acid, maleic acid, acrylic acid, or the like, anhydrides thereof, alkyl esters thereof having 1 or more and 3 or less carbon atoms, and the like.

Here, the alcohol component may properly contain a monohydric alcohol, and the carboxylic acid component may properly contain a monocarboxylic acid compound, from the viewpoint of adjusting the softening point of the polyester.

The equivalent ratio of the carboxylic acid component to the alcohol component in the polyester, i.e. COOH group or groups/OH group or groups, is preferably 0.70 or more, and more preferably 0.80 or more, and preferably 1.15 or less, and more preferably 1.05 or less, from the viewpoint of reducing an acid value of the polyester.

The polycondensation reaction of the alcohol component and the carboxylic acid component can be carried out in an inert gas atmosphere at a temperature of 130° C. or higher and 250° C. or lower, optionally in the presence of an esterification catalyst, an esterification promoter, a polymerization inhibitor or the like. The esterification catalyst includes tin compounds such as dibutyltin oxide and tin(II) 2-ethylhexanoate, titanium compounds such as titanium diisopropylate bistriethanolaminate; and the like. The amount of the esterification catalyst used is preferably 0.01 parts by mass or more, and more preferably 0.1 parts by mass or more, and preferably 1.5 parts by mass or less, and more preferably 1.0 part by mass or less, based on 100 parts by mass of a total amount of the alcohol component and the carboxylic acid component. The esterification promoter includes gallic acid, and the like. The amount of the esterification promoter used is preferably 0.001 parts by mass or more, and more preferably 0.01 parts by mass or more, and preferably 0.5 parts by mass or less, and more preferably 0.1 parts by mass or less, based on 100 parts by mass of a total amount of the alcohol component and the carboxylic acid component. The polymerization inhibitor includes tert-butyl catechol, and the like. The amount of the polymerization inhibitor used is preferably 0.001 parts by mass or more, and more preferably 0.01 parts by mass or more, and preferably 0.5 parts by mass or less, and more preferably 0.1 parts by mass or less, based on 100 parts by mass of a total amount of the alcohol component and the carboxylic acid component.

The polyester has a softening point of preferably 80° C. or higher, more preferably 90° C. or higher, even more preferably 100° C. or higher, and even more preferably 120° C. or higher, from the viewpoint of improving durability and heat-resistance storage property of the toner. In addition, the polyester has a softening point of preferably 80° C. or higher, more preferably 90° C. or higher, and even more preferably 100° C. or higher, from the viewpoint of improving durability of the toner, and from the viewpoint of inhibiting the generation of background fog on an image and damages on a photoconductor.

In addition, the polyester has a softening point of preferably 160° C. or lower, and more preferably 140° C. or lower, from the viewpoint of improving low-temperature fusing ability and flowability of the toner. In addition, the polyester has a softening point of preferably 160° C. or lower, more preferably 140° C. or lower, and even more preferably 130° C. or lower, from the viewpoint of improving low-temperature fusing ability and gloss of the toner.

The softening point of the polyester can be controlled by adjusting the kinds and compositional ratios of the alcohol component and the carboxylic acid component, an amount of a catalyst, or the like, or selecting reaction conditions such as reaction temperature, reaction time and reaction pressure.

In the case where the polyester is an amorphous polyester, the amorphous polyester has a highest temperature of endothermic peak of preferably 50° C. or higher, more preferably 60° C. or higher, and even more preferably 65° C. or higher, from the viewpoint of improving durability and heat-resistant storage property of the toner. Moreover, the amorphous polyester has a highest temperature of endothermic peak of preferably 90° C. or lower, more preferably 80° C. or lower, and even more preferably 75° C. or lower, from the viewpoint of improving low-temperature fusing ability and gloss of the toner.

The highest temperature of endothermic peak of the amorphous polyester can be controlled by the kinds, compositional ratios or the like of the alcohol component and the carboxylic acid component.

The polyester has a glass transition temperature of preferably 50° C. or higher, more preferably 55° C. or higher, and even more preferably 60° C. or higher, from the viewpoint of improving durability and heat-resistant storage property of the toner, and from the viewpoint of inhibiting the generation of background fog on an image and damages on a photoconductor.

In addition, the polyester has a glass transition temperature of preferably 90° C. or lower, more preferably 80° C. or lower, and even more preferably 75° C. or lower, from the viewpoint of improving low-temperature fusing ability and flowability of the toner. In addition, the polyester has a glass transition temperature of preferably 90° C. or lower, more preferably 80° C. or lower, and even more preferably 70° C. or lower, from the viewpoint of improving low-temperature fusing ability and gloss of the toner.

The glass transition temperature of the polyester can be controlled by the kinds, compositional ratios or the like of the alcohol component and the carboxylic acid component.

The polyester has an acid value of preferably 30 mgKOH/g or less, more preferably 20 mgKOH/g or less, and even more preferably 15 mgKOH/g or less, from the viewpoint of improving durability and heat-resistant storage property of the toner. In addition, the polyester has an acid value of preferably 30 mgKOH/g or less, and more preferably 20 mgKOH/g or less, from the viewpoint of improving flowability and durability of the toner.

In addition, the polyester has an acid value of preferably 1 mgKOH/g or more, more preferably 3 mgKOH/g or more, and even more preferably 5 mgKOH/g or more, from the viewpoint of improving productivity of the polyester, and the viewpoint of improving low-temperature fusing ability of the toner. In addition, the polyester has an acid value of preferably 1 mgKOH/g or more, more preferably 2 mgKOH/g or more, and even more preferably of 3 mgKOH/g or more, from the viewpoint of improving productivity of the amorphous polyester, and from the viewpoint of improving low-temperature fusing ability and gloss of the toner.

The acid value of the polyester can be controlled by adjusting the kinds or compositional ratios of the alcohol component or the carboxylic acid component, an amount of a catalyst, or the like, or selecting reaction conditions such as reaction temperature, reaction time and reaction pressure.

In the present invention, the polyester may contain two or more kinds of polyesters of which softening points differ by preferably 5° C. or higher, and more preferably 10° C. or higher, from the viewpoint of satisfying low-temperature fusing ability with durability, heat-resistant storage property and flowability of the toner. Of the two or more kinds of the polyesters, the softening point of the resin having the lowest softening point is preferably 80° C. or higher, more preferably 95° C. or higher, and even more preferably 105° C. or higher, from the viewpoint of improving durability, heat-resistant storage property and flowability of the toner, and the viewpoint of inhibiting the generation of background fog on an image and damages on a photoconductor, and preferably 135° C. or lower, more preferably 120° C. or lower, and even more preferably 115° C. or lower, from the viewpoint of improving low-temperature fusing ability of the toner. The softening point of the resin having the highest softening point is preferably 110° C. or higher, more preferably 120° C. or higher, and even more preferably 130° C. or higher, from the viewpoint of improving durability, heat-resistant storage property and flowability of the toner, and from the viewpoint of inhibiting the generation of background fog on an image and damages on a photoconductor, and preferably 160° C. or lower, more preferably 150° C. or lower, and even more preferably 140° C. or lower, from the viewpoint of improving low-temperature fusing ability of the toner. When the polyester contains two or more kinds of the polyesters, it is preferably that the polyester contains two kinds, from the viewpoint of improving productivity of the toner.

When two kinds of the polyesters are used, a mass ratio of a high-softening point polyester to a low-softening point polyester, i.e. a high-softening point polyester/a low-softening point polyester, is preferably from 10/90 to 90/10, more preferably from 20/80 to 80/20, even more preferably from 50/50 to 80/20, and even more preferably from 50/50 to 70/30, from the viewpoint of improving low-temperature fusing ability and durability of the toner. In addition, the mass ratio is even more preferably from 60/40 to 70/30, from the viewpoint of improving low-temperature fusing ability of the toner, and even more preferably from 50/50 to 67/33, even more preferably from 60/40 to 67/33, and even more preferably from 60/40 to 65/35, from the viewpoint of improving the durability of the toner.

Accordingly, the mass ratio of a high-softening point polyester to a low-softening point polyester, i.e. a high-softening point polyester/a low-softening point polyester, is preferably 10/90 or more, more preferably 20/80 or more, even more preferably 50/50 or more, and even more preferably 60/40 or more, and preferably 90/10 or less, more preferably 80/20 or less, even more preferably 70/30 or less, even more preferably 67/33 or less, and even more preferably 65/35 or less, from the viewpoint of improving low-temperature fusing ability and durability of the toner.

The polylactic acid may be a homopolymer of lactic acid or a copolymer of lactic acid and other hydroxycarboxylic acid.

The lactic acid which is a monomer of the polylactic acid may be either of L-lactic acid or D-lactic acid.

Other hydroxycarboxylic acid includes a hydroxycarboxylic acid having 3 or more to 8 or less carbon atoms, and specific examples include glycolic acid, hydroxybutyric acid, hydroxyvaleric acid, hydroxypentanoic acid, hydroxycaproic acid, hydroxyheptanoic acid, and the like.

In the present invention, the content of lactic acid is preferably 80% by mol or more, and more preferably 90% by mol or more, and preferably 100% by mol or less, and more preferably substantially 100% by mol, of the monomers constituting polylactic acid, from the viewpoint of improving durability and flowability of the toner, and from the viewpoint of inhibiting the generation of background fog on an image and damages on a photoconductor. Accordingly, it is preferable that the polylactic acid is a homopolymer of lactic acid rather than a copolymer of lactic acid and other hydroxycarboxylic acid.

The polylactic acid can be produced according to a conventional method including polycondensing a lactic acid or polycondensing a lactic acid and other hydroxycarboxylic acid, and in the present invention, a commercially available polylactic acid, for example, "N-3000" (glass transition temperature: 63° C.), or "N-4000" (glass transition temperature: 61° C.), hereinabove homopolymer of lactic acid, manufactured by Nature Works, can also be used.

In the present invention, the polylactic acid is preferably a crystalline polylactic acid, from the viewpoint of improving durability, low-temperature fusing ability, gloss and flowability of the toner, from the viewpoint of inhibiting background fog, and from the viewpoint of inhibiting the generation of damages on a photoconductor. The crystalline property of the polylactic acid is expressed by crystallinity. The crystallinity can be obtained by a method described in Examples.

The crystalline polylactic acid has a crystallinity of preferably 30% or more, more preferably 50% or more, even more preferably 70% or more, even more preferably 80% or more, and even more preferably 90% or more, and preferably 100% or less, from the viewpoint of improving durability, low-temperature fusing ability, gloss and flowability of the toner, from the viewpoint of inhibiting background fog, and from the viewpoint of inhibiting the generation of damages on a photoconductor.

The polylactic acid has a number-average molecular weight of preferably 60,000 or more, more preferably 100,000 or more, even more preferably 150,000 or more, and even more preferably 180,000 or more, from the viewpoint of improving durability, heat-resistant storage property, low-temperature fusing ability, gloss and flowability of the toner, from the viewpoint of inhibiting background fog, and from the viewpoint of inhibiting the generation of background fog on an image and damages on a photoconductor. In addition, the polylactic acid has a number-average molecular weight of preferably 300,000 or less, more preferably 250,000 or less, and even more preferably 200,000 or less, from the viewpoint of allowing to melt-knead to provide a toner, from the viewpoint of improving durability, low-temperature fusing ability and gloss, and from the viewpoint of inhibiting background fog under high-temperature, high-humidity conditions.

The polylactic acid has a weight-average molecular weight of preferably 60,000 or more, more preferably 100,000 or more, even more preferably 250,000 or more, even more preferably 400,000 or more, and even more preferably 450,000 or more, from the viewpoint of allowing the toner to include polylactic acid, from the viewpoint of improving durability, heat-resistant storage property, low-temperature fusing ability, gloss and flowability of the toner, from the viewpoint of inhibiting background fog, and from the viewpoint of inhibiting the generation of damages on a photoconductor. In addition, the polylactic acid has a weight-average molecular weight of preferably 700,000 or less, more preferably 550,000 or less, and even more preferably 500,000 or less, from the viewpoint of allowing to melt-knead to provide a toner, from the viewpoint of improving durability, low-temperature fusing ability and gloss of the toner, and from the viewpoint of inhibiting background fog under high-temperature, high-humidity conditions.

The polylactic acid has a melting point of preferably 155° C. or higher, and more preferably 160° C. or higher, from the viewpoint of improving durability, heat-resistant storage property and flowability of the toner, from viewpoint of inhibiting background fog, and from the viewpoint of inhibiting the generation of background fog on an image and damages on a photoconductor. In addition, the polylactic acid has a melting point of preferably 180° C. or lower, and more preferably 175° C. or lower, from the viewpoint of improving low-temperature fusing ability and gloss of the toner.

When two or more kinds of polyesters having different softening point are used as a resin binder, the polyester subjected to transesterification reaction with polylactic acid is preferably a low-softening point polyester, from the viewpoint of increasing miscibility of a resin composition while avoiding increase of viscosity upon transesterification reaction.

A mass ratio of a polyester to a polylactic acid subjected to transesterification reaction in step 1, i.e. polyester/polylactic acid, is preferably 90/10 or less, more preferably 80/20 or less, even more preferably 70/30 or less, and even more preferably 60/40 or less, and preferably 30/70 or more, more preferably 35/65 or more, even more preferably 40/60 or more, and even more preferably 45/55 or more, from the viewpoint of allowing the toner to include polylactic acid, from the viewpoint of improving durability, low-temperature fusing ability, gloss and flowability of the toner, from the viewpoint of inhibiting background fog, and from the viewpoint of inhibiting the generation of background fog on an image and damages on a photoconductor. From these viewpoints, a mass ratio of the polyester to the polylactic acid subjected to transesterification reaction in step 1, i.e. polyester/polylactic acid, is preferably from 90/10 to 30/70, more preferably from 80/20 to 35/65, even more preferably from 70/30 to 40/60, and even more preferably from 60/40 to 45/55.

As mentioned above, the resin composition contains a polyester-polylactic acid copolymer formed by conversion of a part of the polylactic acid by subjecting the polyester and the polylactic acid to a transesterification reaction.

The transesterification reaction between a polyester and a polylactic acid can be carried out by a method of mixing a polyester and a polylactic acid at a temperature of 140° C. or higher and 200° C. or lower, which corresponds to step 1.

A transesterification ratio based on the polylactic acid in the transesterification reaction of step 1 is preferably 0.1% or more, more preferably 1.0% or more, even more preferably 3.0% or more, and even more preferably 7.0% or more, of all of the ester bonds in the polylactic acid, from the viewpoint of improving low-temperature fusing ability, durability and gloss of the toner, from the viewpoint of inhibiting background fog, from the viewpoint of improving flowability of the toner to inhibit aggregation, and from the viewpoint of inhibiting the generation of damages on a photoconductor, and even more preferably 20% or more, from the viewpoint of improving low-temperature fusing ability of the toner. When the transesterification ratio is 0.1 or more, the miscibility of the polyester and the polylactic acid is improved, a polyester phase is melted and at the same time a molecular movement of a polyester-polylactic acid copolymer is activated upon fusing, and the melting of the polylactic acid phase is likely to be promoted by the actions, thereby improving low-temperature fusing ability of the toner. In addition, the transesterification ratio based on a polylactic acid is preferably 35% or less, more preferably 30% or less, even more preferably 25% or less, even more preferably 20% or less, even more preferably 15% or less, and even more preferably 10% or less, of all of the ester bonds in the polylactic acid, from the viewpoint of improving durability of the toner, from the viewpoint of improving flowability of the toner to inhibit aggregation, and from the viewpoint of inhibiting background fog on an image. When the transesterification ratio is 35% or less, a component derived from the polylactic acid is maintained in a length of lactic acid chain sufficient to show the properties of polylactic acid in the resin composition, so that a state having high strength is obtained, thereby improving durability of the toner.

The transesterification ratio based on polylactic acid can be estimated from changes in integral intensity of a peak ascribed to a carbonyl carbon of an ester bond of polylactic acid and a peak ascribed to a carbonyl carbon appearing after the transesterification according to $^{13}$C-NMR method, and can be obtained according to the method described in Examples. The transesterification reaction in the present invention refers to a transesterification reaction formed between a component derived from a polylactic acid and a component derived from a polyester, not including a transesterification reaction between the components derived from polylactic acid and a transesterification reaction between the components derived from a polyester.

The temperature at which a polyester and a polylactic acid are mixed in step 1 is 140° C. or higher, preferably 150° C. or higher, and more preferably 160° C. or higher, from the viewpoint of allowing to cause transesterification. In addition, the temperature for mixing a polyester and a polylactic acid in step 1 is 200° C. or lower, preferably 190° C. or lower, and more preferably 180° C. or lower, from the viewpoint of allowing the toner to include a polylactic acid and improving durability, low-temperature fusing ability and flowability of the toner, from the viewpoint of inhibiting background fog, and from the viewpoint of inhibiting the generation of damages on a photoconductor.

The mixing time in step 1 cannot be unconditionally determined, because the mixing time depends on the temperature for mixing, and the mixing time is preferably 0.5 hours or more, more preferably 1 hour or more, even more preferably 2 hours or more, and even more preferably 4 hours or more, from the viewpoint of allowing the toner to include a polylactic acid and improving durability of the toner, and from the viewpoint of inhibiting background fog. In addition, the mixing time is preferably 0.5 hours or more, more preferably 2 hours or more, and even more preferably 4 hours or more, from the viewpoint of allowing to cause transesterification.

In addition, the mixing time in step 1 is preferably 15 hours or less, more preferably 13 hours or less, even more preferably 12 hours or less, even more preferably 11 hours or less, even more preferably 10 hours or less, even more preferably 9 hours or less, even more preferably 7 hours or less, and even more preferably 6 hours or less, from the viewpoint of allowing the toner to include polylactic acid and improving durability of the toner, and from the viewpoint of improving productivity of the toner. In addition, the mixing time is preferably 15 hours or less, more preferably 13 hours or less, even more preferably 11 hours or less, even more preferably 9 hours or less, and even more preferably 6 hours or less, from the viewpoint of allowing the toner to include a polylactic acid and improving durability and flowability of the toner, from the viewpoint of inhibiting the generation of background fog on an image and damages on a photoconductor, and from the viewpoint of improving productivity of the toner.

The method of mixing may be any one of:

(A) a method including mixing a polyester and a polylactic acid at a temperature lower than a temperature for melting the components, and further mixing the components while heating and melting the mixture, (B) a method including previously heating and melting a polyester, and mixing the polyester with a polylactic acid, and (C) a method including previously heating and melting a polylactic acid and mixing the polylactic acid with a polyester, but, a method of (B) is preferable, from the viewpoint of allowing the toner to include a polylactic acid and improving durability and flowability of the toner, and from the viewpoint of inhibiting the generation of damages on a photoconductor. Accordingly, it is preferable that step 1 includes the following step 1-1 and step 1-2:

step 1-1: melting polyester, and step 1-2: mixing a molten polyester with a polylactic acid at a temperature from 140° to 200° C.

The present invention includes step 1 in the preparation of a mixture of raw materials of a toner, and it is preferable that the resin composition obtained in step 1 is cooled and pulverized to a size of from 0.01 to 2 mm or so, and thereafter subjected to the subsequent step 2 as toner raw materials.

Next, a toner containing the resin composition obtained in step 1 as a resin binder is produced by a method including:

step 2: mixing the resin composition obtained in step 1 with a polyester which is identical to and/or different from the polyester of step 1.

The method for producing a toner containing the resin composition obtained in step 1 includes:

(1) a method for producing a toner, including melt-kneading a mixture of raw material for a toner containing a resin composition and pulverizing a melt-kneaded mixture obtained, (2) a method for producing a toner, including aggregating and thermally depositing resin composition particles in a dispersion in which the resin composition is dispersed in an aqueous medium to provide toner particles, (3) a method for producing a toner, including stirring a dispersion prepared by dispersing a resin composition in an aqueous medium and toner raw materials in high speed to provide toner particles, and the like. The melt-kneading method of (1) is preferable, from the viewpoint of improving productivity of the toner, and from the viewpoint of improving durability and low-temperature fusing ability of the toner. In addition, a toner may be obtained by an aggregation and thermal deposition method of (2), from the viewpoint of improving durability of the toner.

Even in a case where a toner is produced by any one of the above methods, the amount of the resin composition obtained in step 1 used is preferably 2% by mass or more, more preferably 5% by mass or more, even more preferably 8% by mass or more, even more preferably 10% by mass or more, and even more preferably 15% by mass or more, of the resin binder, from the viewpoint of improving durability, low-temperature fusing ability and flowability of the toner, from the viewpoint of inhibiting background fog, and from the viewpoint of inhibiting the generation of damages on a photoconductor. In addition, the amount used is preferably 100% by mass or less, more preferably 80% by mass or less, even more preferably 70% by mass or less, even more preferably 60% by mass or less, and even more preferably 50% by mass or less, from the viewpoint of improving low-temperature fusing ability, from the viewpoint of inhibiting background fog, and from the viewpoint of inhibiting the generation of damages on a photoconductor. In addition, the amount used is preferably 99% by mass or less, more preferably 80% by mass or less, even more preferably 70% by mass or less, even more preferably 60% by mass or less, and even more preferably 50% by mass or less, from the viewpoint of improving low-temperature fusing ability and gloss of the toner.

It is preferable that a high-softening point polyester is added separately from a transesterification reaction, i.e. added in step 2, from the viewpoint of enhancing miscibility of a resin composition while avoiding an increase in viscosity upon transesterification reaction. A mass ratio of a polyester subjected to a transesterification reaction to a polyester not subjected to a transesterification reaction, a polyester subjected to a transesterification reaction/a polyester not subjected to a transesterification reaction, i.e. a mass ratio of a polyester of step 1 to a polyester of step 2, a polyester of step 1/a polyester of step 2, is preferably 90/10 or less, more preferably 70/30 or less, even more preferably 60/40 or less, even more preferably 50/50 or less, even more preferably 45/55 or less, even more preferably 40/60 or less, and even more preferably 35/65 or less, from the viewpoint of enhancing miscibility of a resin composition while avoiding an increase in viscosity upon transesterification reaction, from the viewpoint of improving low-temperature fusing ability and durability of the toner, and from the viewpoint of inhibiting background fog. The mass ratio is preferably 1/99 or more, more preferably 3/97 or more, even more preferably 5/95 or more, even more preferably 10/90 or more, and even more preferably 15/85 or more, from the viewpoint of improving durability of the toner, from the viewpoint of inhibiting background fog, from the viewpoint of inhibiting aggregation, and from the viewpoint of inhibiting the generation of damages on a photoconductor. From these viewpoints, the mass ratio is preferably from 90/10 to 1/99, more preferably from 70/30 to 3/97, even more preferably from 60/40 to 5/95, even more preferably from 50/50 to 10/90, even more preferably from 45/55 to 10/90, even more preferably from 40/60 to 15/85, and even more preferably from 35/65 to 15/85.

Here, in the present invention, the polyester may be a modified polyester to an extent that the properties thereof are not substantially impaired. The modified polyester refers to, for example, a polyester grafted or blocked with a phenol, a urethane, an epoxy or the like according to a method described in Japanese Patent Laid-Open No. Hei-11-133668, Hei-10-239903, Hei-8-20636, or the like.

In the present invention, a total content of the polyester in the resin composition of step 2 is preferably 90% by mass or more, and more preferably 95% by mass or more, and preferably 100% by mass or less, more preferably substantially 100% by mass, and even more preferably 100% by mass, of the resin binder, but the resin binder may contain other resins besides the polyester and the polylactic acid within the range that would not impair the effects of the present invention. The resins besides the polyester and the polylactic acid include, for example, vinyl resins, epoxy resins, polycarbonates, polyurethanes, and the like.

(1) Method for Producing Including Melt-Kneading Resin Composition, and Pulverizing Melt-Kneaded Mixture Obtained (Melt-Kneading Method)

In the method of (1), step 2 is step 2A: mixing the resin composition obtained in step 1 with a polyester which is identical to and/or different from the polyester of step 1 and melt-kneading a raw material mixture for a toner obtained, and the method further includes step 3A: pulverizing and classifying a melt-kneaded mixture obtained in step 2A.

In one embodiment, it is preferable that the polyester used in step 1 is an amorphous polyester, and particularly the polyester different from the polyester of step 1 used in step 2A is a crystalline polyester, from the viewpoint of having excellent low-temperature fusing ability, gloss and durability. The crystalline polyester refers to a polyester having a crystallinity index defined above of from 0.6 to 1.4, preferably from 0.7 to 1.2, more preferably from 0.9 to 1.2, and even more preferably from 0.9 to 1.1.

Low-temperature fusing ability and gloss can be improved by using a crystalline polyester and an amorphous polyester together in a resin binder, but it is difficult to mix with the amorphous polyester while maintaining a crystalline structure of the crystalline polyester, so that the crystalline polyester is localized, thereby worsening durability. On the other hand, the toner of the present invention has the feature that the toner contains a resin composition obtained by carrying out a transesterification reaction between an amorphous polyester and a polylactic acid, so that the resin composition contains unreacted amorphous polyester and polylactic acid, and a polyester-polylactic acid copolymer formed by the transesterification reaction therebetween. The miscibility of an amorphous polyester and a polylactic acid is worsened, so that the mixture remains separated even when the components are melt-kneaded, and cannot be produced into a toner. However, the miscibility of an amorphous polyester and a polylactic acid in a mixture is improved by previously mixing the amorphous polyester and the polylactic acid to allow to a partial transesterification reaction therebetween to form a polyester-polylactic acid copolymer, and a resin composition after the reaction is formed in a state of high strength in which an amorphous polyester and a polylactic acid are copresent in closely arranged state, without being in a separated state thereof. Moreover, when this resin composition containing an amorphous polyester, a polylactic acid and a polyester-polylactic acid copolymer is kneaded with a crystalline polyester, a stirring share is increased, so that it is facilitated to disperse the crystalline polyester in a resin binder while keeping crystallinity of the crystalline polyester, thereby providing toner particles in which the variances in constitutional components among the toner particles are reduced. As a result, it is considered that both of the improvement effect of low-temperature fusing ability and gloss ascribed to the crystalline polyester, and the improvement effect of durability ascribed to the resin composition having high strength containing an amorphous polyester, a polylactic acid and a polyester-polylactic acid copolymer are exhibited.

It is preferable that the crystalline polyester is a crystalline polyester obtained by polycondensing an alcohol component containing a dihydric or higher polyhydric alcohol and a carboxylic acid component containing a dicarboxylic or higher polycarboxylic acid compound.

It is preferable that the alcohol component of the crystalline polyester contains an aliphatic diol, from the viewpoint of enhancing crystallinity of the polyester, and from the viewpoint of improving low-temperature fusing ability and gloss of the toner. The number of the carbon atoms of the aliphatic diol is preferably 4 or more, more preferably 6 or more, and even more preferably 9 or more, from the viewpoint of enhancing crystallinity of the polyester. In addition, the number of carbon atoms is preferably 14 or less, and more preferably 12 or less, from the viewpoint of improving low-temperature fusing ability and gloss of the toner. Further, the number of the carbon atoms of the aliphatic diol is preferably 10, from the viewpoint of improving durability of the toner.

The aliphatic diol having 4 or more and 14 or less carbon atoms includes 1,4-butanediol, 1,4-butenediol, 1,5-pentanediol, neopentyl glycol, 1,6-hexanediol, 1,7-heptanediol, 1,8-octanediol, 1,9-nonanediol, 1,10-decanediol, 1,12-dodecanediol, 1,14-tetradecanediol, and the like, and particularly, the aliphatic diol is preferably α,ω-linear alkanediols, more preferably 1,4-butenediol, 1,6-hexanediol, 1,8-octanediol, 1,9-nonanediol, 1,10-decanediol, and 1,12-dodecanediol, and even more preferably 1,6-hexanediol, 1,8-octanediol, and 1,10-decanediol, especially from the viewpoint of enhancing crystallinity of a polyester, and from the viewpoint of improving low-temperature fusing ability and gloss of the toner. Further, the aliphatic diol is preferably 1,10-decanediol, from the viewpoint of improving durability of the toner.

The content of the aliphatic diol having 4 or more and 14 or less carbon atoms is preferably 70% by mol or more, more preferably 90% by mol or more, even more preferably 95% by mol or more, even more preferably substantially 100% by mol, and even more preferably 100% by mol, of the alcohol component, from the viewpoint of enhancing crystallinity of the polyester. Further, the proportion of one kind of the aliphatic diols having 4 or more and 14 or less carbon atoms in the alcohol component is preferably 50% by mol or more, more preferably 70% by mol, even more preferably 90% by mol or more, and even more preferably substantially 100% by mol.

The alcohol component may contain a polyhydric alcohol component other than aliphatic diol having 4 or more and 14 or less carbon atoms, and the alcohol component includes aliphatic diols such as ethylene glycol, 1,2-propanediol, and 1,3-propanediol; aromatic diols such as alkylene oxide adducts of bisphenol A such as ethylene oxide adducts of bisphenol A and propylene oxide adducts of bisphenol A; trihydric or higher polyhydric alcohols such as glycerol, pentaerythritol, trimethylolpropane, sorbitol, and 1,4-sorbitan.

It is preferable that the carboxylic acid component of the crystalline polyester contains an aromatic dicarboxylic acid compound or an aliphatic dicarboxylic acid compound, from the viewpoint of enhancing crystallinity of the polyester, and from the viewpoint of improving low-temperature fusing ability and gloss of the toner.

The aromatic dicarboxylic acid compound is preferably an aromatic dicarboxylic acid compound having 8 or more and 12 or less carbon atoms, more preferably at least one member selected from the group consisting of a phthalic acid compound, isophthalic acid compound and a terephthalic acid compound, and even more preferably at least one member selected from the group consisting of phthalic acid, isophthalic acid and terephthalic acid.

Here, in the present invention, a dicarboxylic acid compound refers to a dicarboxylic acid, an anhydride thereof and an alkyl ester having 1 or more and 3 or less carbon atoms, and a dicarboxylic acid is preferable among them. In addition, the preferred number of carbon atoms is the number of carbon atoms including a dicarboxylic acid moiety of the dicarboxylic acid compound, but not including the number of carbon atoms of an alkyl group of an alkyl ester moiety (1 or more and 3 or less).

The number of carbon atoms of the aliphatic dicarboxylic acid compound is preferably 4 or more, more preferably 6 or more, and even more preferably 9 or more, from the viewpoint of enhancing crystallinity of the polyester. In addition, the number of carbon atoms is preferably 14 or less, and more preferably 12 or less, from the viewpoint of improving low-temperature fusing ability and gloss of the toner. Further, the number of carbon atoms of the aliphatic dicarboxylic acid is preferably 10, from the viewpoint of improving durability of the toner.

The aliphatic dicarboxylic acid compound having 4 or more and 14 or less carbon atoms includes maleic acid, fumaric acid, citraconic acid, itaconic acid, glutaconic acid, succinic acid, adipic acid, azelaic acid, sebacic acid, decanedioic acid, dodecanedioic acid, tetradecanedioic acid, and the like, and preferably at least one member selected from the group consisting of fumaric acid, succinic acid, adipic acid, sebacic acid, decanedioic acid and dodecanedioic acid, from the viewpoint of improving durability of the toner. Further, the aliphatic dicarboxylic acid compound is preferably sebacic acid, from the viewpoint of improving durability of the toner.

The content of the aromatic dicarboxylic acid compound having 8 or more and 12 or less carbon atoms and an aliphatic dicarboxylic acid compound having 4 or more and 14 or less carbon atoms is preferably 70% by mol or more, more preferably 90% by mol or more, even more preferably 95% by mol or more, even more preferably substantially 100% by mol, and even more preferably 100% by mol, of the carboxylic acid component, from the viewpoint of enhancing crystallinity of the polyester.

The carboxylic acid component may contain a polycarboxylic acid compound other than the aromatic dicarboxylic acid compound having 8 or more and 12 or less carbon atoms and the aliphatic dicarboxylic acid compound having 4 or more and 14 or less carbon atoms, and the polycarboxylic acid compound includes aliphatic dicarboxylic acids such as oxalic acid, malonic acid, and succinic acids substituted with an alkyl group having 1 or more and 30 or less carbon atoms or an alkenyl group having 2 or more and 30 or less carbon atoms; alicyclic dicarboxylic acids such as cyclohexanedicarboxylic acid; tricarboxylic or higher polycarboxylic acids such as trimellitic acid, 2,5,7-naphthalenetricarboxylic acid, and pyromellitic acid, acid anhydrides thereof, alkyl esters thereof having 1 or more and 3 or less carbon atoms, and the like.

In addition, the alcohol component may properly contain a monohydric alcohol, and the carboxylic acid component may properly contain a monocarboxylic acid compound, from the viewpoint of adjusting molecular weight and the like.

Of the total number of moles of the carboxylic acid component and the alcohol component, a total number of moles of the aromatic dicarboxylic acid compound having 8 or more and 12 or less carbon atoms, the aliphatic dicarboxylic acid compound having 4 or more and 14 or less carbon atoms, and the aliphatic diol having 4 or more and 14 or less carbon atoms is preferably 80% by mol or more, more preferably 90% by mol or more, even more preferably 95% by mol or more, even more preferably substantially 100% by mol, and even more preferably 100% by mol, from the viewpoint of enhancing crystallinity of the polyester.

The equivalent ratio of the carboxylic acid component to the alcohol component in the crystalline polyester, i.e. COOH group or groups/OH group or groups, is preferably 0.70 or more, and more preferably 0.75 or more, and preferably 1.10 or less, and more preferably 1.05 or less, from the viewpoint of adjusting a softening point of the polyester and the like.

It is preferable that the polycondensation reaction of the carboxylic acid component and the alcohol component is carried out in an inert gas atmosphere at a temperature of preferably 130° C. or higher and 250° C. or lower, optionally in the presence of an esterification catalyst, a polymerization inhibitor or the like. The esterification catalyst includes tin compounds such as dibutyltin oxide and tin(II) 2-ethylhexanoate; titanium compounds such as titanium diisopropylate bistriethanolaminate; and the like. The esterification promoter which may be used together with the esterification catalyst includes gallic acid, and the like, and the polymerization inhibitor includes tort-butyl catechol, and the like. The amount of the esterification catalyst used is preferably 0.01 parts by mass or more, and more preferably 0.1 parts by mass or more, and preferably 1.5 parts by mass or less, and more preferably 1.0 part by mass or less, based on 100 parts by mass of a total amount of the alcohol component and the carboxylic acid component. The amount of the esterification promoter used is preferably 0.001 parts by mass or more, and more preferably 0.01 parts by mass or more, and preferably 0.5 parts by mass or less, and more preferably 0.1 parts by mass or less, based on 100 parts by mass of a total amount of the alcohol component and the carboxylic acid component. The amount of the polymerization inhibitor used is preferably 0.001 parts by mass or more, and more preferably 0.01 parts by mass or more, and preferably 0.5 parts by mass or less, and more preferably 0.1 parts by mass or less, based on 100 parts by mass of a total amount of the alcohol component and the carboxylic acid component.

Here, in the present invention, the polyester contains a modified polyester to an extent that the properties thereof are not substantially impaired. The modified polyester includes, for example, urethane-modified polyesters in which a polyester is modified with an urethane bond, epoxy-modified polyesters in which a polyester is modified with an epoxy bond, a composite resin containing two or more resin compositions including a polyester component and other resin component, and the like.

In the present invention, a composite resin containing a polyester component comprising the above crystalline polyester and a styrenic resin can be used as a crystalline polyester.

As the raw material monomers for the styrenic resin component, at least styrene or styrene derivatives such as α-methylstyrene and vinyltoluene (hereinafter, the styrene and styrene derivatives are collectively referred to as "styrenic compound") are used.

The content of the styrenic compound is preferably 70% by mass or more, more preferably 90% by mass or more, even more preferably 95% by mass or more, even more preferably substantially 100% by mass, and even more preferably 100% by mass, of the raw material monomers for the styrenic resin component, from the viewpoint of improving durability, low-temperature fusing ability and gloss of the toner.

The raw material monomers for the styrenic resin component that are usable other than the styrenic compound include alkyl (meth)acrylate; ethylenically unsaturated monoolefins such as ethylene and propylene; diolefins such as butadiene; ethylenic monocarboxylate such as dimethylaminoethyl (meth)acrylate; N-vinyl compounds such as N-vinylpyrrolidone; and the like.

The raw material monomers for the styrenic resin component that are usable other than the styrenic compound can be used in a combination of two or more kinds. The term "(meth)acrylic acid" as used herein means acrylic acid and/or methacrylic acid.

Among the raw material monomers for the styrenic resin component that are usable other than the styrenic compound, the alkyl (meth)acrylate is preferred, from the viewpoint of improving low-temperature fusing ability of the toner. The number of the carbon atoms of the alkyl group in the alkyl (meth)acrylate is preferably 1 or more, and more preferably 8 or more, and preferably 22 or less, and more preferably 18 or less, from the viewpoint mentioned above. Here, the number of carbon atoms of the alkyl ester refers to the number of carbon atoms derived from the alcohol component constituting the ester.

Specific examples of the alkyl (meth)acrylate include methyl (meth)acrylate, ethyl (meth)acrylate, (iso)propyl (meth)acrylate, (iso or tert)butyl (meth)acrylate, 2-ethylhexyl (meth)acrylate, (iso)octyl (meth)acrylate, (iso)decyl (meth)acrylate, (iso)stearyl (meth)acrylate, and the like. Here, the expression "(iso or tert)" or "(iso)" embraces both a case where these groups are present and a case where the groups are absent, and the case where the groups are absent means normal. Also, the expression "(meth)acrylate" means both cases including acrylate and methacrylate.

The content of the alkyl (meth)acrylate is preferably 30% by mass or less, more preferably 20% by mass or less, and even more preferably 10% by mass or less, of the raw material monomers for the styrenic resin component, from the viewpoint of improving durability, low-temperature fusing ability and gloss of the toner.

Here, a resin obtained by addition polymerization of raw material monomers containing a styrenic compound and an alkyl (meth)acrylate is also referred to as a styrene-(meth) acrylate resin.

The addition polymerization reaction of the raw material monomers for the styrenic resin component can be carried out by a conventional method, for example, a method of carrying out the reaction of the raw material monomers in the presence of a polymerization initiator such as dicumyl peroxide, a crosslinking agent, and the like in the presence of an organic solvent or in the absence of any solvents. The temperature conditions of the addition polymerization reaction are properly selected depending on the reactivity of the raw material monomers with a polymerization initiator, and the temperature is preferably 110° C. or higher, and more preferably 140° C. or higher, and moreover preferably 200° C. or lower, more preferably 170° C. or lower.

It is preferable that the composite resin is a resin obtained by polymerizing (i) raw material monomers for a polyester component containing an alcohol component and a carboxylic acid component; (ii) raw material monomers for a styrenic resin component; and (iii) a dually reactive monomer capable of reacting with both of the raw material monomers for the polyester component and the raw material monomers for the styrenic resin component.

It is preferable that the dually reactive monomer is a compound having in its molecule at least one functional group selected from the group consisting of a hydroxyl group, a carboxy group, an epoxy group, a primary amino group and a secondary amino group, preferably a hydroxyl group and/or a carboxyl group, and more preferably a compound having a carboxyl group, and an ethylenically unsaturated bond. Moreover, it is more preferable that the dually reactive monomer is at least one member selected from the group consisting of acrylic acid, methacrylic acid, fumaric acid, maleic acid and maleic anhydride. Among them, acrylic acid, methacrylic acid or fumaric acid is even more preferred, from the viewpoint of reactivity of the polycondensation reaction and the addition polymerization reaction. Here, when the dually reactive monomer is used with a polymerization inhibitor, the polycarboxylic acid compound having an ethylenically unsaturated bond such as fumaric acid functions as a raw material monomer for the polyester component. In this case, the fumaric acid and the like are not a dually reactive monomer, but a raw material monomer for the polyester component.

The amount of the dually reactive monomer used is preferably 1 mol or more, and more preferably 2 mol or more, and preferably 30 mol or less, more preferably 25 mol or less, and even more preferably 20 mol or less, based on 100 mol in a total of the alcohol component of the polyester component, from the viewpoint of enhancing dispersibility between the styrenic resin component and the polyester component and improving durability, low-temperature fusing ability and gloss of the toner. In addition, the amount of the dually reactive monomer used is preferably 2 mol or more, and more preferably 5 mol or more, and preferably 30 mol or less, more preferably 20 mol or less, and even more preferably 15 mol or less, based on 100 mol of a total of the raw material monomers of the styrenic resin component.

The composite resin can be obtained by a method including the steps of concurrently carrying out the step (A) a polycondensation reaction of raw material monomers for a polyester component; and the step (B) an addition polymerization reaction of raw material monomers for a styrenic resin component and a dually reactive monomer.

In this method, it is preferable that the steps (A) and (B) are carried out under reaction temperature conditions appropriate for an addition polymerization reaction, a reaction temperature is raised, raw material monomers for the polyester component of a trivalent or higher polyvalent monomer serving as a crosslinking agent are optionally added to a polymerization system under temperature conditions appropriate for a polycondensation reaction, and the polycondensation reaction of the step (A) is further carried out. During the process, the polycondensation reaction alone can also be progressed by adding a radical polymerization inhibitor under temperature conditions appropriate for the polycondensation reaction. The dually reactive monomer is also participant in a polycondensation reaction as well as the addition polymerization reaction.

When the steps (A) and (B) are concurrently carried out, a mixture containing raw material monomers for the styrenic resin component can be added dropwise to a mixture containing raw material monomers for the polyester component to react.

It is preferable that the above method is carried out in a single vessel.

In the composite resin, a mass ratio of the polyester component to the styrenic resin component, i.e. the polyester component/the styrenic resin component (in the present invention, the mass ratio being defined as a mass ratio of the raw material monomers for the polyester component to the raw material monomers for the styrenic resin component, more specifically total mass of the raw material monomers for the polyester component/total mass of the raw material monomers for the styrenic resin component), is preferably from 55/45 to 95/5, more preferably from 65/35 to 95/5, and even more preferably from 70/30 to 95/5, from the viewpoint of maintaining the crystallinity of the polyester, thereby improving durability, low-temperature fusing ability and gloss of the toner. Here, in the above calculation, the amount of the dually reactive monomer is included in the raw material monomers for the polyester component. In addition, the amount of the polymerization initiator is not included in the amount of the raw material monomers for a styrenic resin component.

The crystalline polyester has a softening point of preferably 60° C. or higher, more preferably 70° C. or higher, and even more preferably 80° C. or higher, from the viewpoint of improving heat-resistant storage property of the toner. In addition, the crystalline polyester has a softening point of preferably 120° C. or lower, more preferably 115° C. or lower, and even more preferably 110° C. or lower, from the viewpoint of improving low-temperature fusing ability and gloss of the toner.

In addition, it is preferable that the crystalline polyester has a softening point lower than the softening point of the amorphous polyester, from the viewpoint of improving low-temperature fusing ability and gloss of the toner, and the difference is preferably 20° C. or more, and more preferably from 20° to 60° C. Here, when the amorphous polyester is composed with a plurality of resins, the difference from the softening point of the amorphous polyester refers to the difference from the weighted-average softening point.

The crystalline polyester has a melting point of preferably 55° C. or higher, more preferably 65° C. or higher, and even more preferably 70° C. or higher, from the viewpoint of improving heat-resistant storage property of the toner. In addition, the crystalline polyester has a melting point of preferably 120° C. or lower, more preferably 115° C. or lower, and even more preferably 112° C. or lower, from the viewpoint of improving low-temperature fusing ability and gloss of the toner.

The content of the crystalline polyester is preferably 1% by mass or more, more preferably 7% by mass or more, even more preferably 12% by mass or more, and even more preferably 18% by mass or more, of the resin binder, from the viewpoint of improving low-temperature fusing ability and gloss of the toner. In addition, the content is preferably 40% by mass or less, more preferably 35% by mass or less, even more preferably 28% by mass or less, and even more preferably 22% by mass or less, from the viewpoint of improving durability of the toner.

The toner of the present invention may further contain an amorphous polyester as a resin binder in addition to the amorphous polyester subjected to a transesterification reaction. When the amorphous polyester subjected to a transesterification reaction and the amorphous polyester not subjected to a transesterification reaction are separately added, the mass ratio of the amorphous polyester subjected to a transesterification reaction to the amorphous polyester not subjected to a transesterification reaction, i.e. the amorphous polyester subjected to a transesterification reaction/the amorphous polyester not subjected to a transesterification reaction, in other words, the mass ratio of the amorphous polyester of step 1 to the amorphous polyester of step 2A, i.e. a polyester of step 1/a polyester of step 2A, is preferably 90/10 or less, more preferably 70/30 or less, even more preferably 60/40 or less, even more preferably 50/50 or less, even more preferably 45/55 or less, even more preferably 40/60 or less, and even more preferably 35/65 or less, from the viewpoint of enhancing miscibility of the resin composition, and from the viewpoint of improving low-temperature fusing ability and gloss of the toner, and the mass ratio is preferably 1/99 or more, more preferably 3/97 or more, even more preferably 5/95 or more, even more preferably 10/90 or more, and even more preferably 15/85 or more, from the viewpoint of improving durability. From these viewpoints, the mass ratio is preferably from 90/10 to 1/99, more preferably from 70/30 to 3/97, even more preferably from 60/40 to 5/95, even more preferably from 50/50 to 10/90, even more preferably from 45/55 to 10/90, even more preferably from 40/60 to 10/90, even more preferably from 35/65 to 10/90, and even more preferably from 35/65 to 15/85.

The mass ratio of the crystalline polyester to the amorphous polyester, i.e. a crystalline polyester/an amorphous polyester, is preferably 1/99 or more, more preferably 3/97 or more, even more preferably 5/95 or more, even more preferably 7/93 or more, even more preferably 10/90 or more, and even more preferably 20/80 or more, from the viewpoint of improving low-temperature fusing ability and gloss of the toner, and the mass ratio is preferably 50/50 or less, more preferably 40/60 or less, even more preferably 35/65 or less, even more preferably 30/70 or less, even more preferably 20/80 or less, and even more preferably 15/85 or less, from the viewpoint of improving durability of the toner. From these viewpoints, the mass ratio is preferably from 1/99 to 50/50, more preferably from 3/97 to 40/60, even more preferably from 5/95 to 35/65, even more preferably from 5/95 to 30/70, even more preferably from 5/95 to 20/80, even more preferably from 7/93 to 20/80, and even more preferably from 10/90 to 20/80. Here, the mass of the amorphous polyester refers to the mass of the amorphous polyester subjected to a transesterification reaction, or a total mass of the amorphous polyester subjected to a transesterification reaction and the amorphous polyester not subjected to a transesterification reaction in a case where the toner further contains an amorphous polyester.

In the present invention, a total content in a crystalline polyester and a resin composition, or a total content in a crystalline polyester, a resin composition and an amorphous polyester in a case where the toner further contains an amorphous polyester is preferably 90% by mass or more, and more preferably 95% by mass or more, and preferably 100% by mass or less, more preferably substantially 100% by mass, and even more preferably 100% by mass, of the resin binder.

It is preferable that the toner of the present invention is a positively chargeable toner containing a positively chargeable charge control resin, from the viewpoint of inhibiting background fog, and it is preferable that the positively chargeable charge control resin is melt-kneaded together with a resin composition and the like in step 2A.

The reasons why the effects of inhibiting background fog are exhibited are not elucidated, and they are considered to be as follows.

The positively chargeable charge control resin is a resin having a plurality of chargeable sites, so that the positively chargeable charge control resin has a favorable positive chargeability, but the miscibility with a polyester is worsened, so that durability of the toner is worsened. On the other hand, the toner of the present invention has the feature that the toner contains a resin composition obtained by carrying out a transesterification reaction between a polyester and a polylactic acid, and the resin composition contains unreacted polyester and polylactic acid, and a polyester-polylactic acid copolymer formed by the transesterification reaction therebetween. The miscibility of a polyester and a polylactic acid is worsened, so that even when melt-kneading is carried out, the polyester and the polylactic acid remain separated and cannot be produced into a toner. However, the miscibility of a polyester and a polylactic acid in the mixture is improved by previously mixing the polyester and the polylactic acid to allow a partial transesterification reaction therebetween to form in a polyester-polylactic acid copolymer, and a resin composition after the reaction is formed in a state of high strength in which a polyester and a polylactic acid are copresent in closely arranged state without being in a separated state. Moreover, when this resin composition containing a polyester, a polylactic acid and a polyester-polylactic acid copolymer is melt-kneaded with a positively chargeable charge control resin, a stirring share is increased, so that it is facilitated that the positively chargeable charge control resin is dispersed in a resin composition, thereby providing toner particles in which the variances in constitutional components among the toner particles are reduced. As a result, the miscibility of the polyester and the positively chargeable charge control resin is improved, and the effect of inhibiting background fog is improved. Further, a polyester-polylactic acid copolymer and a positively chargeable charge control resin with improved miscibility promote melting of a polylactic acid phase in which molecular movement is activated in addition to melting of a polyester phase during fusing. Therefore, it is considered that an improvement effect of low-temperature fusing ability is also obtained.

The positively chargeable charge control resin includes styrene-acrylic resins, polyamine resins, phenolic resins, and the like. Among them, styrene-acrylic resins are preferred, from the viewpoint of improving chargeability of the toner and inhibiting background fog.

The styrene-acrylic resin is preferably a styrene-acrylic copolymer containing a quaternary ammonium salt group, and more preferably a styrene-acrylic copolymer containing a quaternary ammonium salt group obtained by polymerizing a mixture of a monomer represented by the formula (II):

(II)

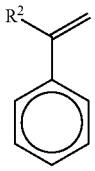

wherein $R^2$ is a hydrogen atom or a methyl group, a monomer represented by the formula (III):

(III)

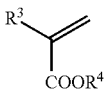

wherein $R^3$ is a hydrogen atom or a methyl group, and $R^4$ is an alkyl group having 1 or more and 6 or less carbon atoms, and a monomer represented by the formula (IV):

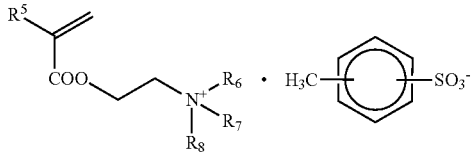

(IV)

wherein $R^5$ is a hydrogen atom or a methyl group, and each of $R^6$, $R^7$, and $R^8$ is an alkyl group having 1 or more and 4 or less carbon atoms.

In the formula (II), it is preferable that $R^2$ is a hydrogen atom, from the viewpoint of improving chargeability of the toner.

In the formula (III), it is preferable that $R^3$ is a hydrogen atom, and that $R^4$ is a butyl group, from the viewpoint of improving chargeability of the toner.

Also, in the formula (IV), it is preferable that $R^5$ is a methyl group, and that each of $R^6$, $R^7$ and $R^8$ is an ethyl group, from the viewpoint of improving chargeability of the toner.

The content of the monomer represented by formula (II) is preferably 60% by mass or more, more preferably 70% by mass or more, and even more preferably 78% by mass or more, and preferably 95% by mass or less, and more preferably 90% by mass or less, of the mixture of the monomers, from the viewpoint of improving charging stability of the toner and inhibiting background fog.

The content of the monomer represented by formula (III) is preferably 2% by mass or more, more preferably 5% by mass or more, and even more preferably 10% by mass or more, and preferably 30% by mass or less, more preferably 20% by mass or less, and even more preferably 15% by mass or less, of the mixture of the monomers, from the viewpoint of improving charging stability of the toner and inhibiting background fog.

The content of the monomer represented by formula (IV) is preferably 3% by mass or more, more preferably 5% by mass or more, and even more preferably 10% by mass or more, and preferably 35% by mass or less, more preferably 30% by mass or less, and even more preferably 25% by mass or less, of the mixture of the monomers, from the viewpoint of improving charging stability of the toner and inhibiting background fog.

The polymerization of the monomer mixture can be carried out by, for example, heating a monomer mixture to a temperature of 50° C. or higher and 100° C. or lower in an inert gas atmosphere in the presence of a polymerization initiator such as azobisdimethylvaleronitrile. Here, the polymerization method may be any of solution polymerization, suspension polymerization, or bulk polymerization, and preferably solution polymerization.

The styrene-acrylic copolymer containing a quaternary ammonium salt group has a softening point of preferably 100° C. or higher, more preferably 105° C. or higher, and even more preferably 108° C. or higher, and preferably 140° C. or lower, more preferably 135° C. or lower, and even more preferably 130° C. or lower, from the viewpoint of improving charging stability of the toner and inhibiting background fog.

The styrene-acrylic copolymer containing a quaternary ammonium salt group includes, for example, "FCA-201PS," and "FCA-701-PT," hereinabove manufactured by FUJIKURA KASEI CO., LTD.

Other styrene-acrylic resins include "FCA-1001NS" manufactured by FUJIKURA KASEI CO., LTD., which is a styrene-acrylic copolymer not containing a quaternary ammonium salt group, and the like. In addition, the polyamine resin includes "AFP-B" manufactured by Orient Chemical Industries Co., Ltd., and the like, and the phenolic resin includes "FCA-2521NJ," "FCA-2508N," hereinabove manufactured by FUJIKURA KASEI CO., LTD.

The content of the positively chargeable charge control resin is preferably 0.5 parts by mass or more, more preferably 1 part by mass or more, and even more preferably 1.5 parts by mass or more, based on 100 parts by mass of the resin binder, from the viewpoint of inhibiting background fog. In addition, the content is preferably 15 parts by mass or less, more preferably 10 parts by mass or less, even more preferably 8 parts by mass or less, even more preferably 6 parts by mass or less, and even more preferably 5 parts by mass or less, based on 100 parts by mass of the resin binder, from the viewpoint of improving low-temperature fusing ability and durability of the toner.

The content of the positively chargeable charge control resin is preferably 0.5 parts by mass or more, more preferably 1 part by mass or more, even more preferably 2 parts by mass or more, even more preferably 3 parts by mass or more, and even more preferably 4 parts by mass or more, based on 100 parts by mass of the resin composition, from the viewpoint of improving dispersibility of the positively chargeable charge control resin in a resin binder, and inhibiting background fog. In addition, the content is preferably 500 parts by mass or less, more preferably 100 parts by mass or less, even more preferably 80 parts by mass or less, even more preferably 60 parts by mass or less, and even more preferably 50 parts by mass or less, based on 100 parts by mass of the resin composition, from the viewpoint of improving durability of the toner.

In addition, it is preferable that an additive such as a colorant, a releasing agent, or a charge control agent is melt-kneaded in step 2A.

As the colorant, all of the dyes, pigments and the like which are used as colorants for toners can be used, and carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, isoindoline, disazo yellow, or the like can be used. The toner of the present invention may be any of black toners and color toners. As the colorant, Phthalocyanine Blue 15:3 is preferred, from the viewpoint of improving gloss and heat-resistant storage property of the toner.

The content of the colorant is preferably 1 part by mass or more, and more preferably 2 parts by mass or more, based on 100 parts by mass of the resin binder, from the viewpoint of improving optical density and gloss of the toner. In addition, the content is preferably 20 parts by mass or less, more preferably 10 parts by mass or less, and even more preferably 5 parts by mass or less, from the viewpoint of improving low-temperature fusing ability and durability of the toner.

The releasing agent includes hydrocarbon-based waxes such as polypropylene, polyethylene, polypropylene polyethylene copolymer, α-olefin based polymer, microcrystalline wax, paraffin waxes, and Fischer-Tropsch wax, and oxides thereof; ester-based waxes such as synthetic ester waxes, carnauba wax, montan wax, sazole wax, and deacidified waxes thereof; fatty acid amides, fatty acids, higher alcohols, metal salts of aliphatic acids, and the like. These releasing agents may be used alone or in a mixture of two or more kinds. Among them, the releasing agent is preferably α-olefin based polymer, a paraffin wax, a synthetic ester wax, and carnauba wax, more preferably a synthetic ester wax and α-olefin based polymer, and even more preferably a synthetic ester wax, from the viewpoint of improving low-temperature fusing ability and durability of the toner.

The releasing agent has a melting point of preferably 60° C. or higher, more preferably 65° C. or higher, and even more preferably 70° C. or higher, from the viewpoint of improving durability and heat-resistant storage property of the toner, and preferably 120° C. or lower, more preferably 100° C. or lower, and even more preferably 90° C. or lower, from the viewpoint of improving low-temperature fusing ability and gloss of the toner.

The content of the releasing agent is preferably 0.5 parts by mass or more, more preferably 1.0 part by mass or more, and even more preferably 1.5 parts by mass or more, based on 100 parts by mass of the resin binder, from the viewpoint of improving low-temperature fusing ability of the toner, and preferably 15 parts by mass or less, more preferably 10 parts by mass or less, and even more preferably 8.0 parts by mass or less, from the viewpoint of improving durability and heat-resistant storage property of the toner.

It is preferable that the toner of the present invention contains a hydrocarbon-based wax as a releasing agent from the viewpoint of inhibiting background fog under high-temperature, high-humidity conditions.

The reasons why the effects of inhibiting background fog under high-temperature, high-humidity conditions are exhibited are not elucidated, and they are considered to be as follows.

In order to supply sufficient charges to the toner and exhibit developability even under high-temperature, high-humidity environmental conditions in which the toner is likely to absorb water in the air, the hydrophobicity of the toner particles is needed to increase; however, a wax having high hydrophobicity such as a hydrocarbon wax has worsened miscibility with a polyester, and durability of the toner is worsened. On the other hand, the toner of the present invention has the feature that the toner contains a resin composition obtained by carrying out a transesterification reaction between a polyester and a polylactic acid, and the resin composition contains unreacted polyester and polylactic acid, and a polyester-polylactic acid copolymer formed by a transesterification reaction therebetween. The miscibility of the polyester and the polylactic acid is worsened, so that even when melt-kneading is carried out, the polyester and the polylactic acid remain separated and cannot be produced into a toner. However, the miscibility of a polyester and a polylactic acid in the mixture is improved when previously mixing the polyester and the polylactic acid to allow a partial transesterification reaction therebetween to form a polyester-polylactic acid copolymer, and a resin composition after the reaction is formed in a state having high strength in which a polyester and a polylactic acid are copresent in closely arranged state without being in a separated state. Moreover, when this resin composition containing the polyester, the polylactic acid and the polyester-polylactic acid copolymer is kneaded with a hydrocarbon wax, a stirring share is increased, so that dispersion of the hydrocarbon wax in a resin binder is facilitated, thereby providing toner particles in which the variances in constitutional components among the toner particles are reduced. As a result, it is considered that both of the improved effect of developability under high-temperature, high-humidity environmental conditions (inhibition of background fog) and the improved effect of durability caused by the resin composition having high strength which contains the polyester, the polylactic acid, and the polyester-polylactic acid copolymer are exhibited.

A hydrocarbon wax includes polypropylene, polyethylene, polypropylene-polyethylene copolymer, α-olefin based polymer, microcrystalline wax, paraffin wax, Fischer-Tropsch wax, and the like. Among them, polypropylene, α-olefin based polymer, paraffin wax and Fischer-Tropsch wax are preferred, polypropylene, α-olefin based polymer and paraffin wax are more preferred, and α-olefin based polymer is even more preferred, from the viewpoint of inhibiting background fog under high-temperature, high-humidity conditions.

Among the α-olefin based polymer, an α-olefin based polymer obtained by polymerizing a monomer containing an α-olefin having 22 or more and 30 or less carbon atoms is preferable, from the viewpoint of improving durability and charging stability of the toner and inhibiting background fog under high-temperature, high-humidity conditions.

The content of the α-olefin having 22 or more and 30 or less carbon atoms is preferably 80% by mol or more, more preferably 90% by mol or more, even more preferably 95% by mol or more, and even more preferably substantially 100% by mol, of the raw material monomers for the α-olefin based polymer, from the viewpoint of improving durability and charging stability of the toner, and inhibiting background fog under high-temperature, high-humidity conditions.

Further, the content of an α-olefin having 26 or more and 28 or less carbon atoms is preferably 60% by mol or more, more preferably 80% by mol or more, even more preferably 90% by mol or more, even more preferably 95% by mol or more, and even more preferably 97% by mol or more, of the raw material monomers for the α-olefin based polymer, from the viewpoint of improving durability and charging stability of the toner, and inhibiting background fog under high-temperature, high-humidity conditions.

The monomers containing an α-olefin having 22 or more and 30 or less carbon atoms in an amount of 80% by mol or more include a blend of α-olefins having 18 or more carbon atoms; for example, monomers obtained by distilling "LINEALENE 26+," (manufactured by Idemitsu Kosan Co., Ltd., a blend of α-olefins mainly composed of those having 26 or more carbon atoms), "LINEALENE 2024," (manufactured by Idemitsu Kosan Co., Ltd., a blend of α-olefins mainly composed of those having 18 or more and 26 or less carbon atoms), or the like, and/or dissolving "LINEALENE 26+" or the like in a hydrocarbon solvent at a temperature of 50° C. or lower, and preferably from 15° to 50° C., and extracting a homogeneous supernatant solution, can be used.

As the above-mentioned hydrocarbon-based solvent, for example, an aromatic hydrocarbon solvent such as toluene or xylene; an alicyclic hydrocarbon solvent such as cyclopentane or cyclohexane; an aliphatic hydrocarbon solvent such as pentane or hexane; a halogenated hydrocarbon solvent such as chloroform or dichloromethane, or the like can be used. These solvents can be used alone or in a mixture of two or more kinds.

The α-olefin based polymer can be synthesized in accordance with a method described in WO 2007/063885. Specifically, the α-olefin based polymer is obtained by dissolving an α-olefin monomer in an aromatic hydrocarbon solvent such as toluene, adding a methallocene catalyst and hydrogen thereto, and polymerizing the monomer under the conditions of a temperature of from 0° to 180° C. and normal pressure to 10 MPa.

The α-olefin based polymer of the present invention has a melting point of preferably 60° C. or higher, more preferably 64° C. or higher, even more preferably 68° C. or higher, and even more preferably 72° C. or higher, and preferably 90° C. or lower, more preferably 85° C. or lower, and even more preferably 80° C. or lower, from the viewpoint of improving low-temperature fusing ability, durability and charging stability of the toner. The melting point of the α-olefin based polymer can be obtained in accordance with a method described in Examples set forth below.

The α-olefin based polymer has a melt viscosity at 100° C. of preferably 100 mPa·s or more, more preferably 120 mPa·s or more, even more preferably 150 mPa·s or more, even more preferably 180 mPa·s or more, and even more preferably 190 mPa·s or more, and preferably 300 mPa·s or less, more preferably 250 mPa·s or less, and even more preferably 220 mPa·s or less, from the viewpoint of improving low-temperature fusing ability, durability and charging stability of the toner, and inhibiting background fog under high-temperature, high-humidity conditions.

The content of the α-olefin based polymer in the releasing agent is preferably 50% by mass or more, more preferably 60% by mass or more, even more preferably 65% by mass or more, even more preferably 80% by mass or more, and even more preferably 90% by mass or more, from the viewpoint of improving low-temperature fusing ability, durability and charging stability of the toner.

The hydrocarbon wax of the present invention has a melting point of preferably 60° C. or higher, more preferably 64° C. or higher, even more preferably 68° C. or higher, and even more preferably 72° C. or higher, from the viewpoint of improving heat-resistant storage property, durability and charging stability of the toner, and inhibiting background fog under high-temperature, high-humidity conditions, and preferably 140° C. or lower, more preferably 130° C. or lower, even more preferably 120° C. or lower, and even more preferably 100° C. or lower, from the viewpoint of improving low-temperature fusing ability of the toner. The melting point of the hydrocarbon wax can be obtained by a method described in Examples set forth below.

The content of the hydrocarbon wax in the toner is preferably 0.5 parts by mass or more, more preferably 1.5 parts by mass or more, even more preferably 2.5 parts by mass or more, and even more preferably 4.0 parts by mass or more, based on 100 parts by mass of the resin binder, from the viewpoint of improving charging stability of the toner, and inhibiting background fog under high-temperature, high-humidity conditions. In addition, the content is preferably 15 parts by mass or less, more preferably 10 parts by mass or less, and even more preferably 8.0 parts by mass or less, based on 100 parts by mass of the resin binder, from the viewpoint of improving durability of the toner.

The content of the hydrocarbon wax in the releasing agent is preferably 50% by mass or more, more preferably 60% by mass or more, even more preferably 70% by mass or more, even more preferably 80% by mass or more, and even more preferably 90% by mass or more, from the viewpoint of improving charging stability of the toner, and inhibiting background fog under high-temperature, high-humidity conditions.

As a charge control agent, any of a negatively chargeable charge control agent and a positively chargeable charge control agent can be used.

The negatively chargeable charge control agent includes metal-containing azo dyes, copper phthalocyanine dyes, metal complexes of alkyl derivatives of salicylic acid, nitroimidazole derivatives, boron complexes of benzilic acid, and the like. The metal-containing azo dyes include, for example, "VARIFAST BLACK 3804, "BONTRON S-28," "BONTRON S-31," "BONTRON S-32," "BONTRON S-34," "BONTRON S-36," hereinabove manufactured by Orient Chemical Industries Co., Ltd.; "T-77," "AIZEN SPILON BLACK TRH," hereinabove manufactured by Hodogaya Chemical Co., Ltd., and the like. The metal complexes of alkyl derivatives of salicylic acid include, for example, "BONTRON E-81," "BONTRON E-82," "BONTRON E-84," "BONTRON E-85," "BONTRON E-304," hereinabove manufactured by Orient Chemical industries Co., Ltd., and the like. The boron complexes of benzilic acid include, for example, "LR-147" manufactured by Japan Carlit Co., Ltd., and the like.

The positively chargeable charge control agent includes Nigrosine dyes, triphenylmethane-based dyes, quaternary ammonium salt compounds, polyamine resins, imidazole derivatives, and the like. The Nigrosine dyes include, for example, "Nigrosine Base EX," "Oil Black BS," "Oil Black SO," "BONTRON N-01," "BONTRON N-07," "BONTRON N-09," "BONTRON N-11," hereinabove manufactured by Orient Chemical Industries Co., Ltd., and the like. The triphenylmethane-based dyes include, for example, triphenylmethane-based dyes containing a tertiary amine as a side chain. The quaternary ammonium salt compounds include, for example, "BONTRON P-51," "BONTRON P-52," hereinabove manufactured by Orient Chemical Industries Co., Ltd.; "TP-415" manufactured by Hodogaya Chemical Co., Ltd.; cetyltrimethylammonium bromide, "COPY CHARGE PXVP435," "COPY CHARGE PSY," hereinabove manufactured by Clariant Ltd., and the like. The polyamine resins include, for example, "AFP-B" manufactured by Orient Chemical industries Co., Ltd., and the like. The imidazole derivatives include, for example, "PLZ-2001," "PLZ-8001," hereinabove manufactured by Shikoku Chemicals Corporation, and the like.

The content of the charge control agent is preferably 0.2 parts by mass or more, and more preferably 0.5 parts by mass or more, and preferably 5 parts by mass or less, and more preferably 3 parts by mass or less, based on 100 parts by mass of the resin binder, from the viewpoint of improving charging stability of the toner.

Here, when the positively chargeable charge control resin is contained, a positively chargeable charge control agent is preferred.

The content of the positively chargeable charge control agent is preferably 0.2 parts by mass or more, and more preferably 0.5 parts by mass or more, and preferably 5 parts by mass or less, and more preferably 3 parts by mass or less, based on 100 parts by mass of the resin binder, from the viewpoint of improving charging stability of the toner.

The toner may contain a negatively chargeable charge control agent, but it is preferable that the content is within the range which would not impair the positive chargeability of the toner, and the content is preferably 0.5 parts by mass or less, more preferably 0.2 parts by mass or less, based on 100 parts by mass of the resin binder, and it is even more preferable not to include the negatively chargeable charge control agent.

In the present invention, an additive such as a magnetic particulate, a flowability improver, a charging conductivity modifier, a reinforcing filler such as a fibrous material, an antioxidant, an anti-aging agent, or a cleanability improver may be further properly used.

The melt-kneading can be carried out with a known kneader, such as a closed kneader, a single-screw or twin-screw extruder, or an open-roller type kneader. From the viewpoint of lowering the temperature during melt-kneading, and improving durability, low-temperature fusing ability, gloss and flowability of the toner, from the viewpoint of being capable of efficiently highly dispersing the additives such as a colorant, a charge control agent, and a releasing agent in the toner without repeats of kneading or without a dispersion aid to suppress background fog, and from the viewpoint of inhibiting the generation of background fog on an image or damages on a photoconductor, it is preferable to use an open-roller type kneader, and the open-roller type kneader is more preferably provided with feeding ports and a discharging port for a kneaded mixture along the shaft direction of the roller.

It is preferable that the toner raw materials containing a resin composition, a polyester which is identical to and/or different from the polyester of step 1, and additives such as a colorant, a charge control agent, a releasing agent, and a positively chargeable charge control resin are previously mixed with a mixer such as a Henschel mixer or a ball-mill, and thereafter fed to a kneader.

The open-roller type kneader refers to a kneader of which kneading unit is an open type, not being tightly closed, and the kneading heat generated during the kneading can be easily dissipated. In addition, it is preferable that the continuous open-roller type kneader is a kneader provided with at least two rollers. The continuous open-roller type kneader usable in the present invention is a kneader provided with two rollers having different peripheral speeds, in other words, two rollers of a high-rotation roller having a high peripheral speed and a low-rotation roller having a low peripheral speed. In the present invention, it is preferable that the high-rotation roller is a heat roller, and that the low-rotation roller is a cooling roller, from the viewpoint of improving dispersibility of the additives such as a colorant, a charge control agent, a releasing agent and a positively chargeable charge control resin in the toner, from the viewpoint of reducing mechanical forces during the melt-kneading, thereby inhibiting heat generation, from the viewpoint of lowering the temperature during the melt-kneading, and improving durability, low-temperature fusing ability, gloss and flowability of the toner, and from the viewpoint of inhibiting the generation of background fog on an image or damages on a photoconductor.

The temperature of the roller can be adjusted by, for example, a temperature of a heating medium passing through the inner portion of the roller, and each roller may be divided in two or more portions in the inner portion of the roller, each being passed through with heating media of different temperatures.

The temperature at the end part of the raw material-supplying side of the high-rotation roller is preferably 100° C. or higher and 160° C. or lower, from the viewpoint of reducing mechanical forces during the melt-kneading, thereby inhibiting heat generation, from the viewpoint of improving durability, low-temperature fusing ability, gloss and flowability of the toner, from the viewpoint of inhibiting background fog, and from the viewpoint of inhibiting the generation of damages on a photoconductor, and the temperature at the end part of the raw material-supplying side of the low-rotation roller is preferably 30° C. or higher and 100° C. or lower, from the same viewpoints.

In the high-rotation roller, the difference between setting temperatures of the end part of the raw material-supplying side and the end part of the kneaded mixture-discharging side is preferably 20° C. or more, and more preferably 30° C. or more, from the viewpoint of preventing detachment of the kneaded mixture from the roller, from the viewpoint of reducing mechanical forces during the melt-kneading, thereby inhibiting heat generation, from the viewpoint of improving durability, low-temperature fusing ability, gloss and flowability of the toner, from the viewpoint of inhibiting background fog, and from the viewpoint of inhibiting the generation of damages on a photoconductor. Moreover, the difference in the setting temperatures is preferably 60° C. or less, and more preferably 50° C. or less, from the same viewpoints.

In the low-rotation roller, the difference between setting temperatures of the end part of the raw material-supplying side and the end part of the kneaded mixture-discharging side is preferably 0° C. or more, more preferably 10° C. or more, and even more preferably 20° C. or more, and preferably 50° C. or less, from the viewpoint of improving dispersibility of the additives such as a colorant, a charge control agent, a releasing agent and a positively chargeable charge control resin in the toner, thereby inhibiting background fog, from the viewpoint of reducing mechanical forces during the melt-kneading, thereby inhibiting heat generation, from the viewpoint of improving durability, low-temperature fusing ability, gloss and flowability of the toner, and from the viewpoint of inhibiting the generation of background fog on an image and damages on a photoconductor.

The peripheral speed of the high-rotation roller is preferably 2 m/min or more, more preferably 10 m/min or more, and even more preferably 25 m/min or more, from the viewpoint of improving dispersibility of the additives such as a colorant, a charge control agent, a releasing agent and a positively chargeable charge control resin in the toner, and preferably 100 m/min or less, more preferably 75 m/min or less, and even more preferably 50 m/min or less, from the viewpoint of reducing mechanical forces during the melt-kneading, thereby inhibiting heat generation, from the viewpoint of improving durability, low-temperature fusing ability, gloss and flowability of the toner, and from the viewpoint of inhibiting the generation of background fog on an image and damages on a photoconductor.

The peripheral speed of the low-rotation roller is preferably n or more, more preferably 5 m/min or more, and even more preferably 15 m/min or more, and preferably 90 m/min or less, more preferably 60 m/min or less, and even more preferably 30 m/min or less, from the same viewpoints. In addition, the ratio of the peripheral speeds of the two rollers, i.e., low-rotation roller/high-rotation roller, is preferably from 1/10 to 9/10, and more preferably from 3/10 to 8/10.

Structures, size, materials and the like of the roller are not particularly limited. Also, the surface of the roller may be any of smooth, wavy, rugged, or other surfaces. From the viewpoint of increasing kneading share and improving dispersibility of the additives such as a colorant, a charge control agent, a releasing agent and a positively chargeable charge control resin in the toner, from the viewpoint of reducing mechanical forces during the melt-kneading, thereby inhibiting heat generation, from the viewpoint of improving durability, low-temperature fusing ability and flowability of the toner, and from the viewpoint of inhibiting the generation of background fog on an image and damages on a photoconductor, it is preferable that plural spiral ditches are engraved on the surface of each roller.

The melt-kneaded mixture obtained in step 2A is cooled to an extent that is pulverizable, and thereafter subjected to the subsequent step 3A. In the present invention, when a crystalline polyester is used, a heat-treating step may be carried out after step 2A.

In the present invention, the temperature of the heat-treating step is preferably equal to or higher than a glass transition temperature of the amorphous polyester, from the viewpoint of improving dispersibility of the additives such as a colorant, a releasing agent and a charge control agent in the resin binder, from the viewpoint of promoting crystallization of a crystalline polyester, thereby improving low-temperature fusing ability and gloss of the toner, and from the viewpoint of shortening time period of a heat-treating step, thereby improving productivity of the toner. In addition, the temperature of the heat-treating step is preferably a temperature equal to or lower than a melting point of the crystalline polyester, more preferably a temperature lower than the melting point by 10° C. or more, and even more preferably a temperature lower than the melting point by 15° C. or more, from the viewpoint of preventing the lowering of heat-resistant storage property of the toner by randomness in the arrangements accompanying with dissolution of a crystal.

In addition, the heat treatment time is preferably 1 hour or more, more preferably 3 hours or more, and even more preferably 6 hours or more, from the viewpoint of promoting crystallization of a crystalline resin, thereby improving low-temperature fusing ability and gloss of the toner. Also, the heat treatment time is preferably 12 hours or less, and more preferably 10 hours or less, from the viewpoint of improving productivity of the toner. Here, this heat treatment time is a cumulative time at which the temperature is within the temperature range defined above (a temperature equal to or higher than the glass transition temperature of the amorphous polyester and equal to lower than the melting point of the crystalline polyester). In addition, it is preferable that the temperature does not exceed the upper limit of the temperature range defined above from the beginning to the end of the heat-treating step, from the viewpoint of maintaining dispersibility of the additives in the toner.

In the heat-treating step, an oven or the like can be used. For example, in a case where an oven is used, a heat-treating step can be carried out by maintaining a kneaded mixture in the oven at a given temperature.

Embodiments for carrying out the heat-treating step are not particularly limited, and include, for example:

Embodiment 1: an embodiment including the steps of, subsequent to step 1, pulverizing a melt-kneaded mixture in step 3A, and keeping a pulverized melt-kneaded mixture under the heat-treatment conditions mentioned above;

Embodiment 2: an embodiment including the steps of, subsequent to step 1, keeping a melt-kneaded mixture under the heat-treatment conditions mentioned above in the process of cooling the resulting melt-kneaded mixture, further cooling the melt-kneaded mixture to a point of attaining a pulverizable hardness, and subjecting the cooled mixture to a subsequent step such as step 3A;

Embodiment 3: an embodiment including the steps of, subsequent to step 1, once cooling the resulting melt-kneaded mixture to a pulverizable hardness, subjecting the cooled melt-kneaded mixture to the above-mentioned heat-treating step, cooling the melt-kneaded mixture again, and subjecting the cooled mixture to a subsequent step such as step 3A; and the like. In the present invention, the heat-treating step may be carried out in any of the Embodiments, and Embodiment 3 is preferred from the viewpoint of maintaining dispersibility of additives in the toner.

In step 3A, the melt-kneaded mixture obtained in step 2A is pulverized and classified.

In the present invention, it is preferable that the pulverization in step 3A is carried out in the presence of fine inorganic particles. A toner for electrophotography obtained by this method exhibits effects that the generation of background fog on an image and damages on a photoconductor is inhibited and flowability is excellent.

The reasons why such effects are exhibited are not elucidated, and they are considered to be as follows.

In the present invention, first, a resin composition is obtained by subjecting a polyester and polylactic acid to a transesterification reaction to provide a resin composition. The resin composition contains a unreacted polyester and polylactic acid, and a polyester-polylactic acid copolymer formed by a transesterification reaction therebetween. The miscibility of the polyester and the polylactic acid is worsened, so that even when melt-kneading is carried out, the polyester and the polylactic acid remain separated and cannot be produced into a toner. However, the miscibility of a polyester and a polylactic acid in the mixture is improved when previously mixing the polyester and the polylactic acid to allow a partial transesterification reaction therebetween to form a polyester-polylactic acid copolymer, and a resin composition after the reaction is formed in a state of high strength in which a polyester and a polylactic acid are copresent in closely arranged state without being in a separated state. Moreover, toner raw materials, which contain this resin composition containing a polyester, a polylactic acid and a polyester-polylactic acid copolymer, are melt-kneaded, fine inorganic particles are then mixed therewith, and the mixture is pulverized, thereby adhering the fine inorganic particles to toner particles to lower the amount of fine inorganic particles released from the toner particles, and at the same time being capable of allowing the resin particles to have high strength to suppress embedding the fine inorganic particles in the toner particles. As a result, it is considered that a toner excellent in both of the improvement in flowability of the toner due to the presence of fine inorganic particles on the surface of the toner particles, and inhibition of background fog owing to the contribution of chargeability provided with fine inorganic particles can be obtained.

The fine inorganic particles include silica, alumina, titania, zirconia, tin oxide, zinc oxide, and the like, and two or more kinds of them may be used in combination. Among them, silica is preferred, and a hydrophobic silica that is hydrophobically treated is more preferred, from the viewpoint of improving flowability of the toner, and from the viewpoint of inhibiting the generation of background fog on an image and damages on a photoconductor.

The fine inorganic particles have a volume-average particle size of preferably 5 nm or more, more preferably 6 nm or more, and even more preferably 7 nm or more, from the viewpoint of improving flowability of the toner, and from the viewpoint of inhibiting background fog on an image, and preferably 35 nm or less, more preferably 25 nm or less, and even more preferably 20 nm or less, from the viewpoint of improving flowability of the toner, and from the viewpoint of inhibiting the generation of damages on a photoconductor.

The amount of fine inorganic particles used in step 3A is preferably 0.1 parts by mass or more, more preferably 0.3 parts by mass or more, even more preferably 0.5 parts by mass or more, even more preferably 0.8 parts by mass or more, even more preferably 1.2 parts by mass or more, and even more preferably 1.5 parts by mass or more, based on 100 parts by mass of the melt-kneaded mixture, from the viewpoint of improving flowability of the toner, from the viewpoint of inhibiting aggregation, and from the viewpoint of inhibiting background fog on an image. In addition, the amount used is preferably 10 parts by mass or less, more preferably 8 parts by mass or less, even more preferably 5 parts by mass or less, even more preferably 4 parts by mass or less, and even more preferably 2.5 parts by mass or less, based on 100 parts by mass of the melt-kneaded mixture, from the viewpoint of inhibiting the generation of damages on a photoconductor.

The pulverizing step may be carried out in divided multi-stages. For example, a resin kneaded mixture may be roughly pulverized to a size of from 1 to 5 mm or so, and the roughly pulverized mixture may then be further finely pulverized to a desired particle size.

The pulverizer usable in the pulverizing step is not particularly limited. For example, the pulverizer preferably usable in the rough pulverization includes a hammer-mill, an atomizer, Rotoplex, and the like, and the pulverizer preferably usable in the fine pulverization includes a fluidised bed opposed jet mill, an impact type jet mill, a rotary mechanical mill, and the like.

The classifier used in the classification step includes a rotor type classifier, an air classifier, an inertial classifier, a sieve classifier, and the like. The pulverized product which is insufficiently pulverized and removed during the classifying step may be subjected to the pulverization step again, and the pulverization step and the classification step may be repeated as occasion demands.

(2) Method for Aggregating and Thermally Depositing Resin Composition Particles in Dispersion in Which Resin Composition is Dispersed in Aqueous Medium (Aggregating and Thermally Depositing Method)

In the method of (2), step 2 includes: step 2B: dispersing a resin composition obtained in step 1 in an aqueous dispersion and mixing a dispersed mixture with an aqueous dispersion containing a polyester which is identical to and/or different from the polyester of step 1 to provide a liquid mixture, and wherein the method further includes step 3B: aggregating and thermally depositing a resin composition particles in the liquid mixture obtained in step 2B.

Step 2B is a step of dispersing a resin composition obtained in step 1 in an aqueous dispersion and mixing a dispersed mixture with an aqueous dispersion containing a polyester which is identical to and/or different from the polyester of step 1 to provide a liquid mixture.

Also in the method of (2), the polyester which is identical to and/or different from the polyester of step 1 is further added in step 2B, in addition to the polyester subjected to a transesterification reaction (polyester of step (1)). In that case, in the method (2), an aqueous dispersion containing a resin composition is mixed with an aqueous dispersion containing a polyester, from the viewpoint of improving productivity of the toner. Accordingly, the following description of step 2B, a method of obtaining an aqueous dispersion containing a polyester used in step 2B is together explained.

In the present invention, the term "aqueous" may refer to a liquid containing water in amount of preferably 50% by mass or more, more preferably 70% by mass or more, even more preferably 90% by mass or more, and even more preferably substantially 100% by mass, although a solvent such as an organic solvent may be contained.

An aqueous dispersion containing a resin composition or an aqueous dispersion containing a polyester are respectively obtained by mixing a resin composition or a polyester, an organic solvent and water, and further optionally a neutralizing agent or a surfactant, stirring the mixture, and thereafter removing the organic solvent by distillation or the like. Preferably, a resin composition or a polyester, and optionally a surfactant are dissolved in an organic solvent, and thereafter water and further optionally a neutralizing agent are mixed thereto. Here, when the mixture is stirred, a generally used agitation mixer such as anchor blades, a high-speed agitation mixer such as DESPA, manufactured by ASADA IRON WORKS CO., LTD.; T.K. HOMOGENIZING MIXER, T.K. HOMOGENIZING DISPER, T.K. ROBOMIX, hereinabove manufactured by PRIMIX Corporation; CLEARMIX, manufactured by M Technique Co., Ltd; KADY Mill, manufactured by KADY International, and the like can be used.

The organic solvent includes alcoholic solvents such as ethanol, isopropanol, and isobutanol; ketone-based solvents such as acetone, methyl ethyl ketone, methyl isobutyl ketone, and diethyl ketone; ether-based solvents such as dibutyl ether, tetrahydrofuran, and dioxane; ethyl acetate, chloroform, and the like. Among them, chloroform and ethyl acetate are preferred, from the viewpoint of improving dispersibility of a resin composition or polyester, and from the viewpoint of improving durability of the toner.

The neutralizing agent includes an alkali metal hydroxide such as lithium hydroxide, sodium hydroxide, and potassium hydroxide; ammonia; organic bases such as trimethylamine, ethylamine, diethylamine, triethylamine, triethanolamine and tributylamine, and the like.

The surfactant includes an anionic surfactant, a cationic surfactant, a nonionic surfactant, and the like, and an anionic surfactant is preferred.

The anionic surfactants includes alkylbenzenesulfonates, alkyl sulfates, alkyl ether sulfates, polyoxyalkylene alkyl ether sulfates, and the like, and alkylbenzenesulfonates and alkyl ether sulfates are preferred, from the viewpoint of improving dispersion stability of the dispersion of resin particles. Specifically, sodium dodecylbenzenesulfonate, sodium dodecyl sulfate, sodium dodecyl ether sulfate and sodium polyoxyethylene lauryl ether sulfate are more preferred.

The cationic surfactant includes alkylbenzenetrimethylammonium chlorides, alkyltrimethylammonium chlorides, dialkyldimethylammonium chlorides, and the like.

The nonionic surfactant includes polyoxyethylene alkylaryl ethers, polyoxyethylene alkyl ethers, polyoxyethylene sorbitan esters, polyoxyethylene fatty esters, oxyethylene/oxypropylene block copolymers, and the like.

When a surfactant is used, the amount of the surfactant used, in a case where an aqueous dispersion of the resin composition is prepared, is preferably 0.1 parts by mass or more, and more preferably 0.5 parts by mass or more, and preferably 30 parts by mass or less, and more preferably 20 parts by mass or less, based on 100 parts by mass of the resin composition. In a case where an aqueous dispersion of the polyester is prepared, the amount suitable for the surfactant used for 100 parts by mass of the polyester is similar to the amount for the resin composition defined above.

In a case where an aqueous dispersion of the resin composition is prepared, the amount of the organic solvent used when mixed with the resin composition is preferably 30 parts by mass or more, and more preferably 50 parts by mass or more, and preferably 1,500 parts by mass or less, and more preferably 1,000 parts by mass or less, based on 100 parts by mass of the resin composition. In a case where an aqueous dispersion of the polyester is prepared, the amount suitable for the organic solvent used for 100 parts by mass of the polyester is similar to the amount for the resin composition defined above.

In a case where an aqueous dispersion of the resin composition is prepared, the amount of water used when mixed with the resin composition is preferably 100 parts by mass or more, and more preferably 200 parts by mass or more, and preferably 1,500 parts by mass or less, and more preferably 1,000 parts by mass or less, based on 100 parts by mass of the resin composition. In a case where an aqueous dispersion of the polyester is prepared, the amount suitable for the water used based on 100 parts by mass of the polyester is similar to the amount for the resin composition described above.

The temperature at which the organic solvent is mixed with (dissolved in) a resin composition or a polyester which may depend on the boiling point of the organic solvent used, is preferably 10° C. or higher, and more preferably 20° C. or higher, and preferably 90° C. or lower, and more preferably 80° C. or lower.

The solid content concentration of an aqueous dispersion containing a resin composition and an aqueous dispersion containing polyester, which can be adjusted by properly adding water, is preferably 3% by mass or more, more preferably 5% by mass or more, and even more preferably 10% by mass or more, and preferably 30% by mass or less, and more preferably 25% by mass or less.

In addition, the dispersion can be prepared by mixing with a nonionic surfactant without using the above-mentioned organic solvent.

The nonionic surfactant includes, for example, polyoxyethylene alkylaryl ethers such as polyoxyethylene nonylphenyl ether; polyoxyethylene alkyl ethers such as polyoxyethylene oleyl ether and polyoxyethylene lauryl ether; polyoxyethylene sorbitan esters such as polyoxyethylene sorbitan monolaurate and polyoxyethylene sorbitan monostearate; polyoxyethylene fatty acid esters such as polyethylene glycol monolaurate, polyethylene glycol monostearate, and polyethylene glycol monooleate; oxyethylene/oxypropylene block copolymers, and the like. In addition, the nonionic surfactant may be used in combination with an anionic surfactant or a cationic surfactant.

When a resin is formed into fine particles in water under a normal pressure, the nonionic surfactant has a cloud point of preferably 70° C. or higher, and more preferably 80° C. or higher, and preferably 105° C. or lower, and more preferably 100° C. or lower.

In a case where an aqueous dispersion of a resin composition is prepared, the amount of the nonionic surfactant used is preferably 5 parts by mass or more, more preferably 10 parts by mass or more, and even more preferably 20 parts by mass or more, and preferably 80 parts by mass or less, more preferably 70 parts by mass or less, and even more preferably 60 parts by mass or less, based on 100 parts by mass of the resin composition, from the viewpoint of improving the dispersion stability of the resin composition particles in the aqueous dispersion. In a case where an aqueous dispersion of the polyester is prepared, the suitable amount of the nonionic surfactant used for 100 parts by mass of polyester is similar to the amount for the above-mentioned resin composition.

The resin composition particles in an aqueous dispersion containing a resin composition or the polyester particles in an aqueous dispersion containing the polyester have a volume-median particle size $D_{50}$ of preferably 50 nm or more, and more preferably 80 nm or more, and preferably 1,000 nm or less, more preferably 500 nm or less, and even more preferably 300 nm or less, from the viewpoint of homogeneously aggregating the particles in the subsequent step 3B. A volume-median particle size $D_{50}$ of each of the particles can be measured with a laser diffraction particle size analyzer or the like.

Step 3B is a step of aggregating and thermally depositing the resin composition particles in the liquid mixture obtained in step 2B.

In step 3B additives such as a colorant, a releasing agent, and a charge control agent are added to the liquid mixture obtained in step 2B, and the mixture may be subjected to an aggregating step. An aqueous dispersion of the additives may be mixed with the mixture obtained in step 2B. In addition, the additives may be mixed when the aqueous dispersion of a resin composition obtained in step 1 is mixed with an aqueous dispersion containing a polyester which is identical to and/or different from the polyester of step 1, in step 2B.

Specific examples of the colorant, the releasing agent and the charge control agent are the same as those of the method of (1). The amounts added of these agents are the same as those of the method of (1).

In step 3B, the dispersion treatment is carried out at a temperature preferably lower than a softening point of a polyester having the lowest softening point, and more preferably a temperature equal to or lower than "softening point minus(−)20° C." (meaning a temperature lower than the softening point by 20° C., hereinafter referred to the same), from the viewpoint of homogenously dispersing the mixture of the liquid mixture obtained in step 2B and each of additives optionally used. Specifically, the temperature is preferably 60° C. or lower, and more preferably 55° C. or lower, and it is preferable that the dispersion treatment is carried out at a temperature higher than 0° C., and more preferably 10° C. or higher, from the viewpoint of flowability of the medium and production energy of an aqueous dispersion of the resin.

From these viewpoints, a homogenous resin dispersion can be prepared according to a conventional method such as stirring the liquid mixture at a temperature of preferably 0° C. or higher, and more preferably 10° C. or higher, and preferably 60° C. or lower, and more preferably 55° C. or lower to subject the stirred mixture to the dispersing treatment.

As a method of the dispersing treatment, it is preferable that the dispersion is carried out with a disperser, and the usable disperser includes a generally used agitation mixer such as anchor blades, a high-speed agitation mixer such as DESPA, manufactured by ASADA IRON WORKS CO., LTD.; T.K. HOMOGENIZING MIXER, T.K. HOMOGENIZING DISPER, T.K. ROBOMIX, hereinabove manufactured by PRIMIX Corporation; CLEARMIX, manufactured by M Technique Co., Ltd; KADY Mill, manufactured by KADY International, an ultrasonic disperser, and the like.

The system in the aggregating step has a pH of preferably 2 or more, and more preferably 3 or more, and preferably 10 or less, more preferably 9 or less, and even more preferably 8 or less, from the viewpoint of satisfying both dispersion stability of the liquid mixture and aggregation property of the resin particles.

It is preferable that the system in the aggregating step has a temperature of a temperature equal to or higher than "softening point of a polyester having the lowest softening point −70° C.," and equal to or lower than the softening point of a polyester having the lowest softening point, from the viewpoint of satisfying dispersion stability of the liquid mixture and aggregation property of the resin particles.

In the aggregating step, in order to effectively carry out the aggregation, an aggregating agent can be added. As the aggregating agent, a cationic surfactant in the form of a quaternary salt, polyethyleneimine, or the like may be used in an organic system, and an inorganic metal salt, an inorganic ammonium salt, a divalent or higher polyvalent metal complex or the like may be included in an inorganic system.

The inorganic metal salts include, for example, metal salts such as sodium sulfate, sodium chloride, calcium chloride, calcium nitrate, barium chloride, magnesium chloride, zinc chloride, aluminum chloride, and aluminum sulfate; and inorganic metal salt polymers such as poly(aluminum chloride), poly(aluminum hydroxide), and poly(calcium sulfide). The inorganic ammonium salts includes, for example, ammonium sulfate, ammonium chloride, ammonium nitrate, and the like. Among them, calcium chloride is preferred, from the viewpoint of satisfying both of dispersion stability of the liquid mixture and aggregation property of the resin particles.

When an aggregating agent is added, the amount thereof is preferably 0.1 parts by mass or more, and more preferably 0.2 parts by mass or more, based on 100 parts by mass of the resin binder, from the viewpoint of controlling the aggregation property of the resin particles to provide a desired particle size, and the amount is preferably 60 parts by mass or less, more preferably 55 parts by mass or less, and even more preferably 50 parts by mass or less, based on 100 parts by mass of the resin binder, from the viewpoint of satisfying both of dispersion stability of the liquid mixture and aggregation properly of the resin particles, and from the viewpoint of improving heat-resistant storage property of the toner.

It is preferable that the aggregating agent is dissolved in an aqueous medium and added, and it is preferable that the mixture is sufficiently stirred during addition and after the termination of addition.

The aggregated particles obtained in the aggregating step have a volume-median particle size $D_{50}$ of preferably 1 μm or more, more preferably 2 μm or more, and even more preferably 3 μm or more, and preferably 15 μm or less, and more preferably 10 μm or less, from the viewpoint of homogenously unifying the particles to provide toner particles.

In the aggregating step, an aggregation inhibitor is optionally added, and thereafter the mixture is subjected to a thermally depositing step to provide an aqueous dispersion of thermally deposited particles. It is preferable that a surfactant is used as an aggregation inhibitor, and more preferable that an anionic surfactant is used. It is preferable that at least one member selected from the group consisting of alkyl ether sulfonates, alkyl sulfates and linear alkylbenzenesulfonates is used as an anionic surfactant.

The thermally depositing step can be carried out, for example, by heating aggregated particles. It is preferable that this thermally depositing step is carried out while stirring aggregated particles with a rate at which the aggregated particles are not precipitated.

The temperature in a system in the thermally depositing step is preferably a temperature equal to or higher than "the softening point of a polyester having the lowest softening point minus(−)50° C." and a temperature equal to or lower than "the softening point +50° C.," more preferably a temperature equal to or higher than "the softening point −35° C." and a temperature equal to or lower than "the softening point +35° C.," and even more preferably a temperature equal to or higher than "the softening point −20° C." and a temperature equal to or lower than "the softening point +20° C.," from the viewpoint of controlling particle sizes, particle size distribution, and shapes of the intended toner and controlling thermally depositing ability of the particles. The specific temperature in the system is preferably 60° C. or higher, and more preferably 70° C. or higher, and preferably 140° C. or lower, and more preferably 120° C. or lower.

The thermally deposited particles obtained in step 3B are properly subjected to a liquid-solid separation step such as filtration, washing step, and drying step, whereby toner particles can be obtained.

In the washing step, it is preferable that an acid is used for removing metal ions on the toner surface, from the viewpoint of securing satisfactory electric properties and reliability as a toner. Also, it is preferable that the added nonionic surfactant is completely removed by washing, and it is preferable that the washing s carried out with an aqueous solution at a temperature equal to or lower than a cloud point of a nonionic surfactant. The washing is carried out preferably plural times.

In addition, in the drying step, any methods such as vibration-type fluidised drying method, spray-drying method, freeze-drying method, or flash jet method can be employed. The water content of the toner particles on dry basis is adjusted to preferably 1.5% by mass or less, and more preferably 1.0% by mass or less, from the viewpoint of improving chargeability of the toner.

In the method for producing a toner for electrophotography of the present invention, it is preferable that the method further includes a step of mixing the toner particles obtained, in other words, toner matrix particles, with an external additive, from the viewpoint of improving chargeability, flowability and transferability of the toner.

The external additive includes inorganic particles of silica, alumina, titania, zirconia, tin oxide, zinc oxide, and the like, and fine organic particles such as resin particles such as fine melamine-based resin particles and fine polytetrafluoroethylene resin particles. Two or more kinds of the external additives may be used in combination. Among them, silica is preferred, and a hydrophobic silica that is hydrophobically treated is more preferred, from the viewpoint of improving transferability of the toner.

The external additive has a volume-average particle size of preferably 10 nm or more, and more preferably 15 nm or more, and preferably 250 nm or less, more preferably 200 nm or less, and even more preferably 90 nm or less, from the viewpoint of improving chargeability, flowability, and transferability of the toner.

The content of the external additive is preferably 0.05 parts by mass or more, more preferably 0.1 parts by mass or more, and even more preferably 0.3 parts by mass or more, and preferably 5 parts by mass or less, more preferably 4 parts by mass or less, and even more preferably 3 parts by mass or less, based on 100 parts by mass of the toner matrix particles before the treatment with the external additive, from the viewpoint of improving chargeability, flowability, and transferability of the toner.

In the mixing of the toner matrix particles with an external additive, a mixer having an agitating member such as rotary blades is preferably used, more preferably a high-speed mixer such as a Henschel mixer or Super Mixer, and even more preferably a Henschel mixer.

The toner for electrophotography of the present invention has a volume-median particle size $D_{50}$ of preferably 3 μm or more, more preferably 4 μm or more, and even more preferably from 6 μm or more, and preferably 15 μm or less, more preferably 12 μm or less, and even more preferably 9

μm or less, from the viewpoint of improving the image quality of the toner. The term volume-median particle size $D_{50}$ as used herein means a particle size of which cumulative volume frequency calculated on a volume percentage is 50% counted from the smaller particle sizes. Also, in a case where the toner is treated with an external additive, the volume-median particle size of the toner matrix particles is regarded as a volume-median particle size of the toner.

The toner for electrophotography of the present invention can be used as a toner directly for monocomponent development, or as a toner mixed with a carrier for two-component development, in an apparatus for forming fused images of a monocomponent development or a two-component development.

Regarding the embodiments mentioned above, the present invention will further disclose a method for producing a toner for electrophotography as set forth below.

<1> A toner for electrophotography obtained by a method including:

step 1: mixing a polyester and a polylactic acid at a temperature of 140° C. or higher and 200° C. or lower and subjecting the mixture to a transesterification reaction to provide a resin composition; and step 2: mixing the resin composition obtained in step 1 with a polyester which is identical to and/or different from the polyester of step 1.

<2> The toner for electrophotography according to the above <1>, wherein the polyester of step 1 and/or step 2 is preferably an amorphous polyester.

<3> The toner for electrophotography according to the above <1> or <2>, wherein the alcohol component of the polyester of step 1 and/or step 2 contains at least any one of aliphatic diols and aromatic diols.

<4> The toner for electrophotography according to the above <3>, wherein the aliphatic diol has the number of carbon atoms of preferably 2 or more, and more preferably 3 or more, and preferably 10 or less, more preferably 8 or less, even more preferably 6 or less, and even more preferably 4 or less.

<5> The toner for electrophotography according to the above <3> or <4>, wherein the content of the aliphatic diol is preferably 50% by mol or more, more preferably 80% by mol or more, and even more preferably 90% by mol or more, and preferably 100% by mol or less, and more preferably substantially 100% by mol, of the alcohol component.

<6> The toner for electrophotography according to any one of the above <3> to <5>, wherein the aliphatic diol is preferably an aliphatic diol having a hydroxyl group bonded to a secondary carbon atom, more preferably at least any one of 1,2-propanediol and 2,3-butanediol, and even more preferably 1,2-propanediol.

<7> The toner for electrophotography according to the above <6>, wherein the content of the aliphatic diol having a hydroxyl group bonded to a secondary carbon atom is preferably 50% by mol or more, more preferably 80% by mol or more, and even more preferably 90% by mol or more, and preferably 100% by mol or less, and more preferably substantially 100% by mol, of the alcohol component.

<8> The toner for electrophotography according to any one of the above <3> to <7>, wherein the content of the aromatic diol is preferably 50% by mol or more, more preferably 80% by mol or more, and even more preferably 90% by mol or more, and preferably 100% by mol or less, and more preferably substantially 100% by mol, of the alcohol component.

<9> The toner for electrophotography according to any one of the above <1> to <8>, wherein the carboxylic acid component of the polyester of step 1 and/or step 2 contains preferably an aromatic dicarboxylic acid compound.

<10> The toner for electrophotography according to the above <9>, wherein the content of the aromatic dicarboxylic acid compound is preferably 50% by mol or more, more preferably 70% by mol or more, even more preferably 85% by mol or more, and even more preferably 90% by mol or more, and preferably 100% by mol or less, of the carboxylic acid component.

<11> The toner for electrophotography according to any one of the above <1> to <10>, wherein the carboxylic acid component of the polyester of step 1 and/or step 2 contains preferably a tricarboxylic or higher polycarboxylic acid compound.

<12> The toner for electrophotography according to the above <11>, wherein the tricarboxylic or higher polycarboxylic acid compound is preferably at least any one of 1,2,4-benzenetricarboxylic acid (trimellitic acid) and an anhydride thereof, and more preferably 1,2,4-benzenetricarboxylic acid anhydride (trimellitic anhydride), <13> The toner for electrophotography according to the above <11> or <12>, wherein the content of the tricarboxylic or higher polycarboxylic acid compound is preferably 1% by mol or more, more preferably 2% by mol or more, even more preferably 5% by mol or more, and even more preferably 10% by mol or more, and preferably 20% by mol or less, more preferably 15% by mol or less, even more preferably 10% by mol or less, and even more preferably 6% by mol or less, of the carboxylic acid component.

<14> The toner for electrophotography according to any one of the above <1> to <13>, wherein the polyester of step 1 and/or step 2 has a softening point of preferably 80° C. or higher, more preferably 90° C. or higher, even more preferably 100° C. or higher, and even more preferably 120° C. or higher, and preferably 160° C. or lower, more preferably 140° C. or lower, and even more preferably 130° C. or lower.

<15> The toner for electrophotography according to any one of the above <1> to <14>, wherein the polyester of step 1 and/or step 2 has a glass transition temperature of preferably 50° C. or higher, more preferably 55° C. or higher, and even more preferably 60° C. or higher, and preferably 90° C. or lower, more preferably 80° C. or lower, even more preferably 75° C. or lower, and even more preferably 70° C. or lower.

<16> The toner for electrophotography according to any one of the above <1> to <15>, wherein the polyester of step 1 and/or step 2 preferably contains two or more kinds of polyesters of which softening points differ by preferably 5° C. or more, and more preferably 10° C. or more.

<17> The toner for electrophotography according to the above <16>, wherein of the two or more kinds of the polyesters, the softening point of the resin having the lowest softening point is preferably 80° C. or higher, more preferably 95° C. or higher, and even more preferably 105° C. or higher, and preferably 135° C. or lower, more preferably 120° C. or lower, and even more preferably 115° C. or lower, and the softening point of the resin having the highest softening point is preferably 110° C. or higher, more preferably 120° C. or higher, and even more preferably 130° C. or higher, and preferably 160° C. or lower, more preferably 150° C. or lower, even more preferably 140° C. or lower.

<18> The toner for electrophotography according to the above <16> or <17>, wherein when two kinds of the polyesters are used, a mass ratio of a high-softening point polyester to a low-softening point polyester, i.e. high-softening point polyester/low-softening point polyester, is preferably from 10/90 to 90/10, more preferably from 20/80 to 80/20, even more preferably from 50/50 to 80/20, even more preferably from 50/50 to 70/30, and even more preferably from 60/40 to 70/30.

<19> The toner for electrophotography according to the above <16> or <17>, wherein when two kinds of the polyesters are used, a mass ratio of a high-softening point polyester to a low-softening point polyester, i.e. high-softening point polyester/low-softening point polyester, is preferably from 50/50 to 67/33, more preferably from 60/40 to 67/33, and even more preferably from 60/40 to 65/35.

<20> The toner for electrophotography according to the above <16> or <17>, wherein when two kinds of the polyesters are used, a mass ratio of a high-softening point polyester to a low-softening point polyester, i.e. high-softening point polyester/low-soften ng point polyester, is preferably 10/90 or more, more preferably 20/80 or more, even more preferably 50/50 or more, and even more preferably 60/40 or more, and preferably 90/10 or less, more preferably 80/20 or less, even more preferably 70/30 or less, even more preferably 67/33 or less, and even more preferably 65/35 or less.

<21> The toner for electrophotography according to any one of the above <1> to <20>, wherein a mass ratio of a polyester of step 1 to a polyester of step 2, i.e. polyester of step 1/polyester of step 2, is preferably 90/10 or less, more preferably 70/30 or less, even more preferably 60/40 or less, even more preferably 50/50 or less, even more preferably 45/55 or less, even more preferably 40/60 or less, and even more preferably 35/65 or less, and preferably 1/99 or more, more preferably 3/97 or more, even more preferably 5/95 or more, even more preferably 10/90 or more, and even more preferably 15/85 or more.

<22> The toner for electrophotography according to any one of the above <1> to <20>, wherein a mass ratio of a polyester of step 1 to a polyester of step 2, i.e. polyester of step 1/polyester of step 2, is preferably from 90/10 to 1/99, more preferably from 70/30 to 3/97, even more preferably from 60/40 to 5/95, even more preferably from 50/50 to 10/90, even more preferably from 45/55 to 10/90, even more preferably from 40/60 to 15/85, and even more preferably from 35/65 to 15/85.

<23> The toner for electrophotography according to any one of the above <1> to <22>, wherein the content of lactic acid of the monomer constituting a polylactic acid is preferably 80% by mol or more, and more preferably 90% by mol or more, and preferably 100% by mol or less, and more preferably substantially 100% by mol.

<24> The toner for electrophotography according to any one of the above <1> to <23>, wherein the polylactic acid is a homopolymer of lactic acid.

<25> The toner for electrophotography according to any one of the above <1> to <24>, wherein the polylactic acid is a crystalline polylactic acid.

<26> The toner for electrophotography according to the above <25>, wherein the crystallinity of the crystalline polylactic acid is preferably 30% or more, more preferably 50% or more, even more preferably 70% or more, even more preferably 80% or more, and even more preferably 90% or more, and preferably 100% or less.

<27> The toner for electrophotography according to any one of the above <1> to <26>, wherein the polylactic acid has a number-average molecular weight of preferably 60,000 or more, more preferably 100,000 or more, even more preferably 150,000 or more, and even more preferably 180,000 or more, and preferably 300,000 or less, more preferably 250,000 or less, and even more preferably 200,000 or less.

<28> The toner for electrophotography according to any one of the above <1> to <27>, wherein the polylactic acid has a weight-average molecular weight of preferably 60,000 or more, more preferably 100,000 or more, even more preferably 250,000 or more, even more preferably 400,000 or more, and even more preferably 450,000 or more, and preferably 700,000 or less, more preferably 550,000 or less, and even more preferably 500,000 or less.

<29> The toner for electrophotography according to any one of the above <1> to <28>, wherein the polylactic acid has a melting point of preferably 155° C. or higher, and more preferably 160° C. or higher, and preferably 180° C. or lower, and more preferably 175° C. or lower.

<30> The toner for electrophotography according to any one of the above <1> to <29>, wherein a mass ratio of the polyester to the polylactic acid subjected to a transesterification reaction of step 1, i.e. polyester/polylactic acid, is preferably 90/10 or less, more preferably 80/20 or less, even more preferably 70/30 or less, and even more preferably 60/40 or less, and preferably 30/70 or more, more preferably 35/65 or more, even more preferably 40/60 or more, and even more preferably 45/55 or more.

<31> The toner for electrophotography according to any one of the above <1> to <29>, wherein a mass ratio of the polyester to the polylactic acid, i.e. polyester/polylactic acid, is preferably from 90/10 to 30/70, more preferably from 80/20 to 35/65, even more preferably from 70/30 to 40/60, and even more preferably from 60/40 to 45/55.

<32> The toner for electrophotography according to any one of the above <1> to <31>, wherein a transesterification ratio based on the polylactic acid in the transesterification reaction of step 1 is preferably 0.1% or more, more preferably 1.0% or more, even more preferably 3.0% or more, even more preferably 7.0% or more, and even more preferably 20% or more, and preferably 35% or less, more preferably 30% or less, even more preferably 25% or less, even more preferably 20% or less, even more preferably 15% or less, and even more preferably 10% or less, of all of the ester bonds in the polylactic acid.

<33> The toner for electrophotography according to any one of the above <1> to <32>, wherein the temperature for mixing a polyester and a polylactic acid in step 1 is preferably 150° C. or higher, and more preferably 160° C. or higher, and preferably 190° C. or lower, and more preferably 180° C. or lower.

<34> The toner for electrophotography according to any one of the above <1> to <33>, wherein the mixing time in step 1 is preferably 0.5 hours or more, more preferably 1 hour or more, even more preferably 2 hours or more, and even more preferably 4 hours or more, and preferably 15 hours or less, more preferably 13 hours or less, even more preferably 12 hours or less, even more preferably 11 hours or less, even more preferably 10 hours or less, even more preferably 9 hours or less, even more preferably 7 hours or less, and even more preferably 6 hours or less.

<35> The toner for electrophotography according to any one of the above <1> to <34>, wherein the polyester of step 1 and step 2 is an amorphous polyester, and a crystalline polyester is further mixed therewith in step 2.

<36> The toner for electrophotography according to any one of the above <35>, wherein a mass ratio of the crystalline polyester to the amorphous polyester, i.e. crystalline polyester/amorphous polyester, is preferably 1/99 or more, more preferably 3/97 or more, even more preferably 5/95 or more, even more preferably 7/93 or more, even more preferably 10/90 or more, and even more preferably 20/80 or more, and preferably 50/50 or less, more preferably 40/60 or less, even more preferably 35/65 or less, even more preferably 30/70 or less, even more preferably 20/80 or less, and even more preferably 15/85 or less.

<37> The toner for electrophotography according to any one of the above <35>, wherein a mass ratio of the crystalline polyester to the amorphous polyester, i.e. crystalline polyester/amorphous polyester, is preferably from 1/99 to 50/50, more preferably from 3/97 to 40/60, even more preferably from 5/95 to 35/65, even more preferably from 5/95 to 30/70, and even more preferably from 5/95 to 20/80.

<38> The toner for electrophotography according to any one of the above <35> to <37>, wherein the content of the crystalline polyester is preferably 1% by mass or more, more preferably 7% by mass or more, even more preferably 12% by mass or more, and even more preferably 18% by mass or more, and preferably 40% by mass or less, more preferably 35% by mass or less, even more preferably 28% by mass or less, and even more preferably 22% by mass or less, of the resin binder.

<39> The toner for electrophotography according to any one of the above <35> to <38>, wherein the alcohol component of the crystalline polyester contains an aliphatic diol having 4 or more, more preferably 6 or more, even more preferably 9 or more, and preferably 14 or less, and more preferably 12 or less.

<40> The toner for electrophotography according to any one of the above <35> to <39>, wherein the carboxylic acid component of the crystalline polyester preferably contains an aromatic dicarboxylic acid compound and/or an aliphatic dicarboxylic acid compound.

<41> The toner for electrophotography according to any one of the above <1> to <40>, wherein a hydrocarbon wax is further mixed in step 2 as a releasing agent.

<42> The toner for electrophotography according to the above <41>, wherein the hydrocarbon-based wax preferably contains at least one member selected from the group consisting of polypropylene, an α-olefin based polymer, paraffin wax and Fischer-Tropsch wax, more preferably contains at least one member selected from the group consisting of polypropylene, an α-olefin based polymer and paraffin wax, and even more preferably contains an α-olefin based polymer.

<43> The toner for electrophotography according to the above <41> or <42>, wherein the hydrocarbon-based wax has a melting point of preferably 60° C. or higher, more preferably 64° C. or higher, even more preferably 68° C. or higher, and even more preferably 72° C. or higher, and preferably 140° C. or lower, more preferably 130° C. or lower, even more preferably 120° C. or lower, and even more preferably 100° C. or lower.

<44> The toner for electrophotography according to any one of the above <41> to <43>, wherein the content of the hydrocarbon-based wax in the toner is preferably 0.5 parts by mass or more, more preferably 1.5 parts by mass or more, even more preferably 2.5 parts by mass or more, and even more preferably 4.0 parts by mass or more, and preferably 15 parts by mass or less, more preferably 10 parts by mass or less, and even more preferably 8.0 parts by mass or less, based on 100 parts by mass of the resin binder.

<45> The toner for electrophotography according to any one of the above <41> to <44>, wherein the content of the hydrocarbon-based wax in the releasing agent is preferably 50% by mass or more, more preferably 60% by mass or more, even more preferably 70% by mass or more, even more preferably 80% by mass or more, and even more preferably 90% by mass or more.

<46> The toner for electrophotography according to any one of the above <41> to <45>, wherein a positively chargeable charge control resin is further mixed in step 2.

<47> The toner for electrophotography according to the above <46>, wherein the positively chargeable charge control resin is preferably a styrene-acrylic resin.

<48> The toner for electrophotography according to the above <47>, wherein the styrene-acrylic resin is preferably a quaternary ammonium salt group-containing styrene-acrylic copolymer, and more preferably a quaternary ammonium salt group-containing styrene-acrylic copolymer obtained by polycondensing a mixture of a monomer represented by formula (II), a monomer represented by formula (III) and a monomer represented by formula (IV).

<49> The toner for electrophotography according to the above <48>, wherein the quaternary ammonium salt group-containing styrene-acrylic copolymer has a softening point of preferably 100° C. or higher, more preferably 105° C. or higher, and even more preferably 108° C. or higher, and preferably 140° C. or lower, more preferably 135° C. or lower, and even more preferably 130° C. or lower.

<50> The toner for electrophotography according to any one of the above <46> to <49>, wherein the content of the positively chargeable charge control resin is preferably 0.5 parts by mass or more, more preferably 1 part by mass or more, and even more preferably 1.5 parts by mass or more, and preferably 15 parts by mass or less, more preferably 10 parts by mass or less, even more preferably 8 parts by mass or less, even more preferably 6 parts by mass or less, and even more preferably 5 parts by mass or less, based on 100 parts by mass of the resin binder.

<51> The toner for electrophotography according to any one of the above <46> to <50>, wherein the content of the positively chargeable charge control resin is preferably 0.5 parts by mass or more, more preferably 1 part by mass or more, even more preferably 2 parts by mass or more, even more preferably 3 parts by mass or more, and even more preferably 4 parts by mass or more, and preferably 500 parts by mass or less, more preferably 100 parts by mass or less, even more preferably 80 parts by mass or less, even more preferably 60 parts by mass or less, and even more preferably 50 parts by mass or less, based on 100 parts by mass of the resin composition.

<52> The toner for electrophotography according to any one of the above <1> to <51>, wherein a colorant is further mixed in step 2.

<53> The toner for electrophotography according to any one of the above <1> to <52>, wherein the amount of the resin composition obtained in step 1 used is preferably 2% by mass or more, more preferably 5% by mass or more, even more preferably 8% by mass or more, even more preferably 10% by mass or more, and even more preferably 15% by mass or more, and preferably 100% by mass or less, more preferably 99% by mass or less, even more preferably 80% by mass or less, even more preferably 70% by mass or less, even more preferably 60% by mass or less, and even more preferably 50% by mass or less, of the resin binder.

<54> The toner for electrophotography according to any one of the above <1> to <53>, wherein a total content of the resin composition obtained in step 1 and a polyester of step 2 is preferably 90% by mass or more, and more preferably 95% by mass or more, and preferably 100% by mass or less, more preferably substantially 100% by mass, and even more preferably 100% by mass, of the resin binder.

<55> A method for producing a toner for electrophotography characterized in that the method includes:

step 1: mixing a polyester and a polylactic acid at a temperature of 140° C. or higher and 200° C. or lower and subjecting the mixture to a transesterification reaction to provide a resin composition; and step 2: mixing the resin composition obtained in step 1 with a polyester which is identical to and/or different from the polyester of step 1, in a production of a toner for electrophotography.

<56> The method for producing a toner for electrophotography according to the above <55>, wherein step 2 is step 2A: mixing the resin composition obtained in step 1 with a polyester which is identical to and/or different from the polyester of step 1 and melt-kneading the obtained raw material mixture for a toner, and wherein the method further includes step 3A: pulverizing and classifying the melt-kneaded mixture obtained in step 2A.

<57> The method for producing a toner for electrophotography according to the above <56>, therein an open-roller type kneader is preferably used in the melt-kneading in step 2A.

<58> The method for producing a toner for electrophotography according to any one of the above <56> or <57>, wherein the pulverization in step 3A is carried out in the presence of fine inorganic particles.

<59> The method for producing a toner for electrophotography according to the above <58>, wherein the fine inorganic particles are preferably a silica, and more preferably a hydrophobic silica that is hydrophobically treated.

<60> The method for producing a toner for electrophotography according to the above <58> or <59>, wherein the fine inorganic particles have a volume-average particle size of preferably 5 nm or more, more preferably 6 nm or more, and even more preferably 7 nm or more, and preferably 35 nm or less, more preferably 25 nm or less, and even more preferably 20 nm or less.

<61> The method for producing a toner for electrophotography according to any one of the above <58> to <60>, wherein the amount of fine inorganic particles used in step 3A is preferably 0.1 parts by mass or more, more preferably 0.3 parts by mass or more, even more preferably 0.5 parts by mass or more, even more preferably 0.8 parts by mass or more, even more preferably 1.2 parts by mass or more, and even more preferably 1.5 parts by mass or more, and preferably 10 parts by mass or less, more preferably 8 parts by mass or less, even more preferably 5 parts by mass or less, even more preferably 4 parts by mass or less, and even more preferably 2.5 parts by mass or less, based on 100 parts by mass of the melt-kneaded mixture.

<62> The method for producing a toner for electrophotography according to any one of the above <56> to <61>, wherein a fluidised bed opposed jet mill or an impact type jet mill is preferably used, and a fluidised bed opposed jet mill is more preferably used in the pulverization of step 3A.

<63> The method for producing a toner for electrophotography according to any one of the above <56> to <62>, wherein the method preferably further includes the step of mixing the toner particles obtained, in other words, toner matrix particles, with an external additive after step 3A.

<64> The method for producing a toner for electrophotography according to the above <63>, wherein the additive is preferably a silica, and more preferably a hydrophobic silica that is hydrophobically treated.

<65> The method for producing a toner for electrophotography according to the above <55>, wherein the step 2 is step 2B: dispersing the resin composition obtained in step 1 in an aqueous dispersion and mixing the dispersed mixture with an aqueous dispersion containing a polyester which is identical to and/or different from the polyester of step 1 to provide a liquid mixture, and wherein the method further includes step 3B: aggregating and thermally depositing a resin composition particle, in the liquid mixture obtained in step 2B.

<66> The method for producing a toner for electrophotography according to the above <65>, wherein the system in the aggregating step preferably has a temperature equal to or higher than "softening point of polyester having lowest softening point −70° C.," and equal to or lower than the softening point of polyester having lowest softening point.

<67> The method for producing a toner for electrophotography according to the above <65> or <66>, wherein an aggregating agent is preferably added in the aggregating step.

<68> The method for producing a toner for electrophotography according to the above <67>, wherein the aggregating agent is preferably an inorganic metal salt.

<69> The method for producing a toner for electrophotography according to the above <68>, wherein the inorganic metal salt is preferably calcium chloride.

<70> The method for producing a toner for electrophotography according to any one of the above <67> to <69>, wherein the amount of the aggregating agent is preferably 0.1 parts by mass or more, and more preferably 0.2 parts by mass or more, and preferably 60 parts by mass or less, more preferably 55 parts by mass or less, and even more preferably 50 parts by mass or less, based on 100 parts by mass of the resin binder.

<71> The method for producing a toner for electrophotography according to any one of the above <65> to <70>, wherein the aggregated particles have a volume-median particle size $D_{50}$ of preferably 1 μm or more, more preferably 2 μm or more, and even more preferably 3 μm or more, and preferably 15 μm or less, and more preferably 10 μm or less.

<72> The method for producing a toner for electrophotography according to any one of the above <65> to <71>, wherein the temperature in a system in the thermally depositing step is preferably a temperature equal to or higher "the softening point of polyester having lowest softening point minus(−)50° C." and a temperature equal to or lower than "the softening point +50° C.," more preferably a temperature equal to or higher than "the softening point −35° C." and a temperature equal to or lower than "the softening point +35° C.," and even more preferably a temperature equal to or higher than "the softening point −20° C." and a temperature equal to or lower than "the softening point +20° C."

<73> The method for producing a toner for electrophotography according to any one of the above <65> to <72>, wherein the temperature in the system in the thermally depositing step is preferably 60° C. or higher, and more preferably 70° C. or higher, and preferably 140° C. or lower, and more preferably 120° C. or lower.

<74> The method for producing a toner for electrophotography according to any one of the above <65> to <73>, wherein the method preferably further includes the step of mixing the toner particles obtained, in other words, toner matrix particles, with an external additive after step 3B.

<75> The method for producing a toner for electrophotography according to the above <74>, wherein the additive is preferably a silica, and more preferably a hydrophobic silica that is hydrophobically treated.

<76> The method for producing a toner for electrophotography according to any one of the above <55> to <75>, wherein the toner for electrophotography obtained has a volume-median particle size $D_{50}$ of preferably 3 μm or more, more preferably 4 μm or more, and even more preferably from 6 μm or more, and preferably 15 μm or less, more preferably 12 μm or less, and even more preferably 9 μm or less.

<77> The method for producing a toner for electrophotography according to the above <55> to <76>, wherein a mass ratio of a polyester of step 1 to a polyester of step 2, i.e. polyester of step 1/polyester of step 2, is preferably 90/10 or less, more preferably 70/30 or less, even more preferably 60/40 or less, even more preferably 50/50 or less, even more preferably 45/55 or less, even more preferably 40/60 or less, and even more preferably 35/65 or less, and preferably 1/99 or more, more preferably 3/97 or more, even more preferably 5/95 or more, even more preferably 10/90 or more, and even more preferably 15/85 or more.

<78> The method for producing a toner for electrophotography according to any one of the above <55> to <77>, wherein a transesterification ratio based on the polylactic acid in the transesterification reaction of step 1 is preferably 0.1% or more, more preferably 1.0% or more, even more preferably 3.0% or more, even more preferably 7.0% or more, and even more preferably 20% or more, and preferably 35% or less, more preferably 30% or less, even more preferably 25% or less, even more preferably 20% or less, even more preferably 15% or less, and even more preferably 10% or less, of all of the ester bonds in the polylactic acid.

<79> The method for producing a toner for electrophotography according to any one of the above <55> to <78>, wherein the mixing time in step 1 is preferably 0.5 hours or more, more preferably 1 hour or more, even more preferably 2 hours or more, and even more preferably 4 hours or more, and preferably 15 hours or less, more preferably 13 hours or less, even more preferably 12 hours or less, even more preferably 11 hours or less, even more preferably 10 hours or less, even more preferably 9 hours or less, even more preferably 7 hours or less, and even more preferably 6 hours or less.

<80> The method for producing a toner for electrophotography according to any one of the above <55> to <79>, wherein a colorant is further mixed in step 2.

EXAMPLES

The present invention will be specifically described hereinbelow by the Examples, without intending to limit the scope of the present invention thereto. In addition, since the present invention comprises various embodiments, an example of an embodiment may be described as a comparative example of other embodiments, but they are common in that the above-mentioned step 1 and step 2 are carried out.

Example A

[Softening Point of Polyester]

The softening point refers to a temperature at which a half of the sample flows out, when plotting a downward movement of a plunger of a flow tester "CFT-500D" manufactured by Shimadzu Corporation, against temperature, in which a 1 g sample is extruded through a nozzle having a die pore size of 1 mm and a length of 1 mm with applying a load of 1.96 MPa thereto with the plunger, while heating the sample so as to raise the temperature at a rate of 6° C./min.

[Highest Temperature of Endothermic Peak and Melting Point of Polyester]

Measurements are taken using a differential scanning calorimeter "Q-100," manufactured by TA Instruments, Japan, by weighing out a 0.01 to 0.02 g sample in an aluminum pan, cooling the sample from room temperature to 0° C. at a cooling rate of 10° C./min, and keeping at 0° C. for one minute. Thereafter, the measurements are taken while heating at a rate of 50° C./min. Of the endothermic peaks observed, a temperature of the peak of the highest temperature side is defined as a highest temperature of endothermic peak of a resin. When a difference between a highest temperature of endothermic peak and a softening point is within 20° C., the highest temperature is defined as a melting point.

[Glass Transition Temperature of Polyester]

Measurements are taken using a differential scanning calorimeter "Q-100," manufactured by TA Instruments, Japan, by weighing out a 0.01 to 0.02 g sample in an aluminum pan, heating the sample to 200° C., and cooling the sample from that temperature to 0° C. at a cooling rate of 10° C./min. Next, the measurements are taken while heating at a rate of 10° C./min. A temperature of an intersection of the extension of the baseline of equal to or lower than the highest temperature of endothermic peak and the tangential line showing the maximum inclination between the kick-off of the peak and the top of the peak in the above measurement is defined as a glass transition temperature.

[Acid Value of Polyester]

The acid value is determined by a method according to JIS K0070 except that only the determination solvent is changed from a mixed solvent of ethanol and ether as defined in JIS K0070 to a mixed solvent of acetone and toluene in a volume ratio of acetone:toluene=1:1.

[Crystallinity of Polylactic Acid]

The peak intensity s measured in accordance with a continuous scanning method with a powder X-ray diffractometer (XRD) "Rigaku RINT 2500VC X-RAY diffractometer," manufactured by Rigaku Corporation, under the conditions of X-ray source: Cu/Kα-radiation, tube voltage: 40 kV, tube current: 120 mA, measurement range: diffraction angle (2θ): 5 to 40°, scanning rate: 5.0°/min. Here, the samples are filled into a glass plate and measured after pulverization. From the X-ray diffraction obtained, a value calculated by the following formula is defined as a crystallinity of the polylactic acid.

$$\text{Crystallinity (\%)} = \frac{\text{Integrated Value of Diffraction Peak Intensity Derived from Crystals}}{\text{Integrated Value of Overall Diffraction Peak Intensity}} \times 100$$

[Melting Point of Polylactic Acid]

Measurements are taken using a differential scanning calorimeter "DSC Q20," manufactured by TA Instruments, Japan, by weighing out a 0.01 to 0.02 g sample in an aluminum pan, heating the sample from 20° to 200° C. at a heating rate of 10° C./min. A highest temperature of endothermic peak observed in the melting endothermic curve in the above measurements obtained is defined as a melting point of a polylactic acid.

[Average Molecular Weight of Polylactic Acid]

The number-average molecular weight (Mn) and the weight-average molecular weight (Mw) are obtained by measuring a molecular weight distribution in accordance with a gel permeation chromatography (GPC) method.

(1) Preparation of Sample Solution

The sample is dissolved in chloroform at 25° C. so as to have a concentration of 0.5 g/100 mL. Next, this solution is filtered with a fluororesin filter "DISMIC-25JP," manufactured by ADVANTEC, having a pore size of 0.2 μm, to remove insoluble components, to provide a sample solution.

(2) Measurement of Molecular Weight

Using the following measurement apparatus and analyzing column, the measurement is taken by allowing chloroform to flow through a column as an eluent at a flow rate of 1 mL per minute, and stabilizing the column in a thermostat at 40° C., and loading 100 μL of a sample solution. The molecular weight of the sample is calculated based on the previously drawn calibration curve. At this time, a calibration curve is drawn from several kinds of monodisperse polystyrenes, manufactured by Tosoh Corporation, A-500 (Mw $5.0\times10^2$), A-1000 (Mw $1.01\times10^3$), A-2500 (Mw $2.63\times10^3$), A-5000 (Mw $5.97\times10^3$), F-1 (Mw $1.02\times10^4$), F-2 (Mw $1.81\times10^4$), F-4 (Mw $3.97\times10^4$), F-10 (Mw $9.64\times10^4$), F-20 (Mw $1.90\times10^5$), F-40 (Mw $4.27\times10^5$), F-80 (Mw $7.06\times10^5$), and F-128 (Mw $1.09\times10^6$) as standard samples.

Measurement Apparatus: HLC-8220GPC, manufactured by Tosoh Corporation

Analyzing Column; GMHLX+G3000HXL, manufactured by Tosoh Corporation.

[Transesterification Ratio Based on Polylactic Acid]

According to the following method, the varied amount of the carbonyl carbons of the ester bonds of the polylactic acid is quantified by the $^{13}$C-NMR method to obtain transesterification ratio based on the polylactic acid.

(1) Preparation of Sample Solution

To 1 g of chloroform-D, manufactured by Wako Pure Chemical Industries, Ltd., D, 99.8%, 0.05 v/v % containing TMS, 0.15 g of a resin composition is dissolved to provide a sample solution, a sample concentration of which is 12% by mass.

(2) $^{13}$C-NMR Spectral Measurement

The NMR measurement tube, manufactured by NIHON SEIMITSU KAGAKU CO. LTD., inner diameter of 5 mm, length of 210 mm, was charged with the above-mentioned sample solution such that the volume of the solution achieve to 5 cm from the bottom of the tube, and the $^{13}$C-NMR spectrum is measured according to the following conditions.

<Measurement Conditions>

Apparatus: 400MR, manufactured by Agilent Technologies

Magnetic Fields: 400 MHz

Pulse Program: CARBON (s2pul)

Number of Integration: 20,000

45° pulse: 4.35 μs

Relaxation Delay: 1 s

Receiver Gain: 60

TEMP: 25° C.

(3) Calculation of Esterification Ratio

According to the integral intensity of peak (a) ascribed to the carbonyl carbons of the ester bonds of the polylactic acid observed at 169.5 ppm to 169.6 ppm and the integral intensity of peak (b) ascribed to the carbonyl carbons of the ester bonds between the polyester and the polylactic acid newly generated by a transesterification reaction observed at 168 ppm to 176 ppm, the value calculated from the following formula is defined as a transesterification ratio based on the polylactic acid.

$$\text{Transesterification Ratio (\%)} = \frac{\text{Integral Intensity of Peak } (b)}{\text{Sum of Integral Intensities of Peak } (a) \text{ and Peak } (b)} \times 100$$

[Melting Point of Releasing Agent]

Measurements are taken using a differential scanning calorimeter "DSC Q20," manufactured by TA Instruments, Japan, by weighing out a 0.01 to 0.02 g sample in an aluminum pan, heating the sample to 200° C. at a heating rate of 10° C./min, and cooling the sample from that temperature to −10° C. at a cooling rate of 5° C./min. Next, the measurements are taken while heating the sample at a rate of 10° C./min to 180° C. A highest temperature of endothermic peak observed in the melting endothermic curve in the above measurements obtained is defined as a melting point of a releasing agent.

[Volume-Median Particle Size of Resin Composition Particles, Polyester Particles, Colorant Particles, Releasing Agent Particles and Charge Control Agent Particles]

(1) Measuring Apparatus: Laser Diffraction Particle Size Analyzer "LA-920," manufactured by HORIBA, Ltd.

(2) Measurement Conditions: Distilled water is added to a cell for measurement, and the volume-median particle size is measured at a temperature in which absorbance is within the suitable range.

[Solid Content Concentration of Aqueous Dispersion of Resin Composition, Aqueous Dispersion of Polyester, Colorant Dispersion, Releasing Agent Dispersion and Charge Control Agent Dispersion]

Water (% by mass) in 5 g of measurement sample is measured with an infrared moisture meter "FD-230," manufactured by KETT ELECTRIC LABORATORY, at a drying temperature of 150° C., measurement mode 96 (monitoring time 2.5 min/fluctuation width 0.05%). The solid content concentration is calculated according to the following formula:

$$\text{Solid Content Concentration (\% by mass)} = 100 - \text{Water (\% by mass)}.$$

[Volume-Median Particle Size of Aggregated Particles]

Measuring Apparatus: Coulter Multisizer II, manufactured by Beckman Coulter, Inc.

Aperture Diameter: 100 μm

Analyzing Software: Coulter Multisizer AccuComp Ver. 1.19, manufactured by Beckman Coulter, Inc.

Electrolytic Solution: Isotone II, manufactured by Beckman Coulter, Inc.

Measurement Conditions: The above sample dispersion containing aggregated particles is added to 100 ml of the above electrolytic solution to adjust to a concentration at which particle sizes of 30,000 particles can be measured in 20 seconds, and thereafter the 30,000 particles are measured, and a volume-median particle size $D_{50}$ is obtained from the particle size distribution.

[Volume-Average Particle Size of External Additive]

The volume-average particle size of the primary particles is obtained from the following formula:

$$\text{Average Particle Size (nm)} = 6/(\rho \times \text{Specific Surface Area } (m^2/g)) \times 1000.$$

wherein ρ is a true specific gravity of an external additive, and, for example, the specific gravity of silica is 2.2; and a specific surface area is a BET specific surface area obtained by nitrogen adsorption method. Incidentally, the above formula is obtained from $$\text{Specific Surface Area}=S\times(1/m)$$

$$m(\text{Weight of Particle})=4/3\times\pi\times(R/2)^3\times\text{True Specific Gravity}$$

$$S(\text{Surface Area})=4\pi(R/2)^2$$

supposing that a sphere has a particle size R.

[Volume-Median Particle Size of Toner]

Measuring Apparatus: Coulter Multisizer II, manufactured by Beckman Coulter, Inc.

Aperture Diameter: 100 μm

Analyzing Software: Coulter Multisizer AccuComp Ver. 1.19, manufactured by Beckman Coulter, Inc.

Electrolytic solution: "Isotone II," manufactured by Beckman Coulter, Inc.

Dispersion: "EMULGEN 1.09P," manufactured by KAO Corporation, polyoxyethylene lauryl ether, HLB: 13.6, is dissolved in the above electrolytic solution so as to have a concentration of 5% by mass to provide a dispersion.

Dispersion Conditions: Ten milligrams of a measurement sample is added to 5 ml of the above dispersion, the mixture is dispersed with an ultrasonic disperser, 25 ml of the above electrolytic solution is added thereto, and further dispersed with the ultrasonic disperser for 1 minute, to provide a sample dispersion.

Measurement Conditions: The above sample dispersion is added to 100 ml of the above electrolytic solution to adjust the concentration to a concentration at which particle sizes of 30,000 particles can be measured in 20 seconds, and thereafter the 30,000 particles are measured, and a volume-median particle size $D_{50}$ is obtained from the particle size distribution.

Production Example 1 of Polyester Resins [H-1, H-2 and L-1]

A 10-liter four-neck flask equipped with a nitrogen inlet tube, a dehydration tube, a stirrer, and a thermocouple was charged with raw material monomers other than trimellitic anhydride and an esterification catalyst, as listed in Table A-1. The temperature was raised to 200° C. in a nitrogen atmosphere, and the contents were reacted at that temperature for 6 hours. Further, the temperature was raised to 210° C., trimellitic anhydride was then added to the reaction mixture, and the components were reacted at an ambient pressure, 101.3 kPa, for 1 hour, and further reacted at 40 kPa until a desired softening point was reached to provide each of polyesters. The physical properties of the polyesters obtained are shown in Table A-1. Here, the reaction percentage refers to a value calculated by [amount of water generated/theoretical amount of water generated]×100.

Production Example 2 of Polyester Resin [L-2]

A 10-liter four-neck flask equipped with a nitrogen inlet tube, a dehydration tube, a stirrer, and a thermocouple was charged with raw material monomers and an esterification catalyst as listed in Table A-1. The temperature was raised to 200° C. in a nitrogen atmosphere, and the contents were reacted at that temperature for 6 hours. Further, the temperature was raised to 210° C., and the components were reacted at an ambient pressure, 101.3 kPa, for 1 hour, and further reacted at 40 kPa until a softening point reached 108° C. to provide a polyester. The physical properties of the polyester obtained are shown in Table A-1.

TABLE 1

Table A-1

| | | H-1 | H-2 | L-1 | L-2 |
|---|---|---|---|---|---|
| Raw Material Monomers | Alcohol Component | | | | |
| | 1,2-Propanediol | 2,815 g (100) | — | 2,815 g (100) | — |
| | BPA-PO[1)] | — | 4,410 g (70) | — | 6,300 g (100) |
| | BPA-EO[2)] | — | 1,755 g (30) | — | — |
| | Carboxylic Acid Component | | | | |
| | Terephthalic Acid | 4,918 g (80) | 2,093 g (70) | 5,225 g (85) | 2,542 g (85) |
| | Trimellitic Anhydride | 711 g (10) | 519 g (15) | 355 g (5) | — |
| Esterification Catalyst | Dibutyltin Oxide | 17 g | 18 g | 17 g | 18 g |
| Physical Properties of the Resin | Softening Point (° C.) | 134 | 133 | 112 | 108 |
| | Highest Temp. of Endothermic Peak (° C.) | 70 | 73 | 69 | 69 |
| | Softening Point/ Highest Temp. of Endothermic Peak | 1.9 | 1.8 | 1.6 | 1.6 |
| | Glass Transition Temp. (° C.) | 68 | 70 | 66 | 66 |
| | Acid Value (mgKOH/g) | 18.3 | 18.6 | 17.6 | 20.6 |

Note)

Numerical values inside the parentheses express molar ratios when the total number of moles of the alcohol component is 100.

[1)]BPA-PO: Polyoxypropylene(2.2)-2,2-bis(4-hydroxyphenyl)propane

[2)]BPA-EO: Polyoxyethylene(2.2)-2,2-bis(4-hydroxyphenyl)propane

Production Example of Toners

Examples 1 to 9 and 11

(Step 1)

A 10-liter four-neck flask equipped with a nitrogen inlet tube, a dehydration tube, a stirrer, and a thermocouple was charged with a polyester in a given amount as listed in Table A-2. The temperature was raised to a temperature described in Table A-2 in a nitrogen atmosphere, to melt the polyester. Thereafter, a polylactic acid in a given amount as listed in Table A-2 was added thereto, and the mixture was stirred for a given time as listed in Table A-2 to carry out partial transesterification to provide a resin composition containing a polyester-polylactic acid copolymer. The resulting resin composition was cooled to 40° C. or lower, and the resin composition was then roughly pulverized with Rotoplex, manufactured by Hosokawa Micron Corporation, and a sieve having a sieve opening of 2 mm was used to provide a resin composition containing a polyester-polylactic acid copolymer having a particle size of 2 mm or less. The resin compositions prepared in each of Examples and Comparative Examples are shown as RC-1 to RC-7 usable in step 2.

TABLE 2

Table A-2

| | | | RC-1 | RC-2 | RC-3 | RC-4 | RC-5 | RC-6 | RC-7 |
|---|---|---|---|---|---|---|---|---|---|
| Resin | Polyester | L-1 | 50 | 50 | 50 | 50 | 50 | — | 50 |
| | | L-2 | — | — | — | — | — | 50 | — |
| | Polylactic | PLA-1 | 50 | 50 | 50 | 50 | 50 | 50 | — |
| | Acid | PLA-2 | — | — | — | — | — | — | 50 |
| Transesterification | Temp. (° C.) | | 170 | 170 | 170 | 170 | 170 | 170 | 170 |
| Reaction | Time (Hours) | | 5 | 1 | 3 | 10 | 12 | 5 | 5 |
| | Transesterification Ratio (%) | | 8.6 | 1.6 | 4.1 | 18.4 | 28.3 | 8.5 | 8.3 |

Note)
PLA-1: N-3000, manufactured by Nature Works, Mn 188,000, Mw 472,000, melting point 170° C., crystallinity 92%
PLA-2: N-4000, manufactured by Nature Works, Mn 238,000, Mw 524,000, melting point 170° C., crystallinity 92%

(Step 2A)

A resin composition and a polyester obtained step 1 in given amounts as listed in Table A-4, 3.0 parts by mass of a colorant "ECB-301," manufactured by DAINICHISEIKA COLOR & CHEMICALS MFG. CO., LTD., Phthalocyanine Blue, P.B. 15:3, 3.0 parts by mass of a releasing agent "WEP-9," manufactured by NOF CORPORATION, a synthetic ester wax, melting point of 72° C., and 1.0 part by mass of a negatively chargeable charge control agent "BONTRON E-84," manufactured by Orient Chemical Industries Co., Ltd., were mixed with a Henschel mixer, manufactured by NIPPON COKE & ENGINEERING CO., LTD., for 1 minute, and the mixture was melt-kneaded under the conditions given below.

A continuous twin open-roller type kneader "Kneadex," manufactured by NIPPON COKE & ENGINEERING CO., LTD., having an outer diameter of roller of 14 cm and an effective length of roller of 80 cm, was used. The operating conditions of the continuous twin open-roller type kneader are a peripheral speed of a high-rotation roller, a front roller, of 32.4 m/min, a peripheral speed of a low-rotation roller, a back roller, of 21.7 m/min, and a gap between the rollers of 0.1 mm. The temperatures of the heating medium and the cooling medium inside the rollers are as follows. The high-rotation roller had a temperature at the raw material supplying side of 145° C., and a temperature at the kneaded product discharging side of 100° C., and the low-rotation roller had a temperature at the raw material supplying side of 75° C., and a temperature at the kneaded product discharging side of 35° C. In addition, the feeding rate of the raw material mixture was 10 kg/hr, and the average residence time was about 3 minutes.

(Step 3A)

The melt-kneaded mixture was cooled, and then roughly pulverized with a pulverizer "Rotoplex," manufactured by Hosokawa Micron Corporation using a sieve having a sieve opening of 2 mm, to provide a roughly pulverized product having a particle size of 2 mm or less. The resulting roughly pulverized product was subjected to fine pulverization with an air jet-type classifier Model DS2, impact jet type, manufactured by Nippon Pneumatic Mfg. Co., Ltd., while adjusting a pulverization pressure so as to have a volume-median particle size of 8.0 μm. The resulting finely pulverized product was subjected to classification with an air jet-type classifier Model DSX2, manufactured by Nippon Pneumatic Mfg. Co., Ltd., while adjusting a static pressure (internal pressure) so as to have a volume-median particle size of 8.5 μm, to provide toner matrix particles.

One hundred parts by mass of the toner matrix particles obtained were mixed with 1.0 part by mass of a hydrophobic silica "R972," manufactured by Nippon Aerosil Co., Ltd., volume-average particle size: 16 nm, and 1.0 part by mass of a hydrophobic silica "NAX50," manufactured by Nippon Aerosil Co., Ltd., volume-average particle size: 30 nm, with a Henschel mixer manufactured by NIPPON COKE & ENGINEERING CO., LTD. at 2,100 r/min, i.e. a peripheral speed of 29 m/sec, for 3 minutes, to provide each of the toners.

Example 10

Toner raw materials were mixed in Example 1 with a Henschel mixer, and the mixture was melt-kneaded under the conditions given below.

The melt-kneading was carried out with a co-rotating twin-screw extruder "PCM-30," manufactured by IKEGAI Corporation, having a screw diameter of 2.9 cm and a cross-sectional area of the screw of 7.06 $cm^2$. The operating conditions were such that the barrel setting temperature was 100° C., a rotational speed of the screw was 200 r/min, i.e. a peripheral speed of the screw rotations was 0.30 m/sec, and a mixture supplying rate was 10 kg/hr, i.e. a feeding rate of the mixture per unit cross-sectional area of the screw was 1.42 $kg/hr \cdot cm^2$, to provide a melt-kneaded mixture.

The resulting melt-kneaded mixture was subjected to rough pulverization and fine pulverization in the same manner as in Example 1, and the finely pulverized product was subjected to a classification treatment, to provide toner matrix particles.

The resulting toner matrix particles were mixed with an external additive in the same manner as in Example 1, to provide a toner.

Example 12

(Step 2B)

In 1-liter beaker, 30 g of resin composition RC-1 and 270 g of chloroform were mixed while stirring at 25° C. to dissolve the RC-1, 24 g of an anionic surfactant "NEOPELEX G-15," manufactured by KAO Corporation., 15% by mass sodium dodecylbenzenesulfonate solution, and 147.5 g of deionized water were added thereto, and thereafter the mixture was stirred for 30 minutes, at a rotational speed of 8,000 r/min with "T.K. ROBOMIX," manufactured by PRIMIX Corporation, to prepare the emulsion. Chloroform was distilled away from the resulting emulsion under a reduced pressure to provide an aqueous dispersion of resin composition RC-1 (Aqueous Dispersion E-1).

(Preparation of Aqueous Dispersions of Polyester)

A 3-liter vessel equipped with a stirrer, a reflux condenser, a dropping funnel, a thermometer and a nitrogen inlet tube was charged with 150 g of polyester II-1 and 75 g of ethyl acetate, and the mixture was dissolved at 70° C. over 2 hours. A 20% by mass aqueous ammonia solution (pKa: 9.3) was added to the solution obtained so as to have 100% by mol neutralization degree based on the acid value of the resin, and the content was stirred for 30 minutes to provide a mixture.

While keeping the temperature at 70° C., 675 g of deionized water was added thereto over 77 minutes while stirring the mixture at 280 r/min (peripheral speed: 88 in/min) the mixture was subjected to an emulsion phase-conversion, and thereafter the ethyl acetate was distilled away under a reduced pressure while continuously keeping the temperature at 70° C. Then the residue was cooled to 30° C. while stirring at 280 r/min (peripheral speed: 88 m/min), 16.7 g of an anionic surfactant "EMAL E-27C," manufactured by KAO Corporation, sodium polyoxyethylene lauryl ether sulfate, solid content of 28% by mass, was added and mixed therewith, and the deionized water was added thereto to adjust the solid content concentration to 20% by mass to provide an aqueous dispersion of a polyester (Aqueous Dispersion A-1).

In the preparation of the above aqueous dispersion of a polyester, the same procedures were carried out except that the polyester H-1 was changed to polyester L-1, to provide an aqueous dispersion of a polyester (Aqueous Dispersion A-2).

The volume-median particle sizes of the resin composition and the polyester in the resulting aqueous dispersion, and the solid content concentration of the aqueous dispersion are shown in Table A-3.

TABLE 3

Table A-3

| | Aqueous Dispersion E-1 | Aqueous Dispersion A-1 | Aqueous Dispersion A-2 |
|---|---|---|---|
| Resin (Composition) | RC-1 | H-1 | L-1 |
| Volume-Median Particle Size $D_{50}$ (nm) of Resin (Composition) Particles | 256 | 194 | 188 |
| Solid Content Concentration (% by mass) | 17 | 20 | 20 |

(Preparation of Colorant Dispersion)

A colorant dispersion was obtained by mixing 50 g of a colorant "ECB-301," manufactured by DAINICHISEIKA COLOR & CHEMICALS MFG. CO., LTD., Phthalocyanine Blue, P. B. 15:3, 5 g of an nonionic surfactant "EMULGEN 150," manufactured by KAO Corporation, polyoxyethylene lauryl ether and 200 g of deionized water and dispersing the mixture with a homogenizer for 10 minutes to provide a colorant dispersion. In the colorant dispersion, the volume-median particle size $D_{50}$ of the colorant particles was 120 nm, and the solid content concentration was 22% by mass.

(Preparation of Releasing Agent Dispersion)

In 1-liter beaker, 3.8 g of an aqueous solution of a sodium acrylate-sodium maleate copolymer "Poise 521," manufactured by KAO Corporation, effective concentration of 40% by mass was dissolved in 200 g of deionized water as an aqueous solution of sodium polycarboxylate, 50 g of a releasing agent "WEP-9," manufactured by NOF CORPORATION, a synthetic ester wax, melting point of 72° C. was added thereto. The mixture was subjected to a dispersion treatment with a ultrasonic homogenizer "US-600T," manufactured by NIPPON SEIKI CO., LTD. while keeping the temperature at from 90° to 95° C. and melting and stirring for 30 minutes. The component was cooled to 25° C., the deionized water was added thereto to adjust the solid content of the releasing agent to 20% by mass to provide a releasing agent dispersion. The volume-median particle size $D_{50}$ of the releasing agent particles in the releasing agent dispersion was 364 nm.

(Preparation of Charge Control Agent Dispersion)

Fifty grams of a negatively chargeable charge control agent "BONTRON E-84," manufactured by Orient Chemical Industries Co., Ltd., 5 g of a nonionic surfactant "EMULGEN 150," manufactured by KAO Corporation, polyoxyethylene lauryl ether and 200 g of deionized water, and dispersing the mixture for 10 minutes with glass beads using a sand grinder to provide a charge control agent dispersion. In the charge control agent dispersion, the volume-median particle size $D_{50}$ of the charge control agent particles in the charge control agent dispersion was 400 nm, and the solid content concentration was 22% by mass.

(Step 3B)

A 3-liter vessel was charged with 177.4 g of the aqueous dispersion E-1, 166.5 g of the aqueous dispersion A-1, 33.3 g of the aqueous dispersion A-2, 9 g of the colorant dispersion, 10 g of the releasing agent dispersion, 3 g of the charge control agent dispersion and 60 g of deionized water, and 150 g of a 0.1% by mass aqueous calcium chloride solution was added dropwise thereto over at 20° C. 30 minutes, while stirring the mixture with an anchor type stirrer at 100 r/min (peripheral speed 31 m/min). Thereafter, the mixture was heated to 50° C. while stirring. A diluted solution prepared by diluting 4.2 g of an anionic surfactant "EMAL E-27C," manufactured by KAO Corporation, sodium polyoxyethylene lauryl ether sulfate, solid content of 28% by mass, with 37 g of deionized water was added thereto as an aggregating inhibitor after a volume-median particle size achieved to 8.5 μm. Next, the mixture was heated to 80° C., the heated mixture was maintained for 1 hour from a point when the temperature reached 80° C., and the heating was terminated. The temperature was gradually cooled to 20° C., and the mixture was filtered with a metal gauze having 150 mesh (sieve opening 150 μm) and subjected to suction filtration, and thereafter allowed to pass through washing and drying steps to provide toner particles.

The resulting toner particles as matrix particles were mixed with external additives in the same manner as in Example 1 to provide a toner.

Comparative Examples 1 and 2

A polyester in a given amount as listed in Table A-4, 3.0 parts by mass of a colorant "ECB-301," manufactured by DAINICHISEIKA COLOR & CHEMICALS MFG. CO., LTD., Phthalocyanine Blue, P. B. 15:3, 3.0 parts by mass of a releasing agent "WEP-9," manufactured by NOF CORPORATION, a synthetic ester wax, melting point of 72° C., and 1.0 part by mass of a negatively chargeable charge control agent "BONTRON E-84," manufactured by Orient Chemical Industries Co., Ltd., were mixed with a Henschel mixer for 1 minute, and the mixture was melt-kneaded in the same manner as in Example 1.

The resulting melt-kneaded mixture was subjected to rough pulverization and fine pulverization in the same manner as in Example 1, and the pulverized mixture was subjected to classifying treatment to provide toner matrix particles.

The resulting toner matrix particles were mixed with external additives in the same manner as in Example 1 to provide a toner.

Comparative Example 3

A polyester and a polylactic acid in given amounts as listed in Table A-4, 3.0 parts by mass of a colorant "ECB-301," manufactured by DAINICHISEIKA. COLOR & CHEMICALS MFG. CO., LTD., Phthalocyanine Blue, P.B. 15:3, 3.0 parts by mass of a releasing agent "WEP-9," manufactured by NOF CORPORATION, a synthetic ester wax, melting point of 72° C., and 1.0 part by mass of a negatively chargeable charge control agent "BONTRON E-84," manufactured by Orient Chemical Industries Co., Ltd., were mixed with a Henschel mixer for 1 minute, and the mixture was melt-kneaded in the same manner as in Example 1, and the melt-kneaded mixture was subjected to pulverization and classification. However, in the resulting particles, the polyester and the polylactic acid were separated without being compatible to each other, so that the particles could not be used as a toner.

Comparative Example 4

A polyester and a polylactic acid in given amounts as listed in Table A-4 were mixed with a Henschel mixer, and the mixture was melt-kneaded under the conditions shown below.

A co-rotating twin-screw extruder PCM-30, manufactured by IKEGAI Corporation, having a screw diameter of 2.9 cm and a cross-sectional area of the screw of 7.06 $cm^2$ was used. The operating conditions were as follows: The barrel setting temperature was 160° C., a rotational speed of the screw was 200 r/min, i.e. a peripheral speed of the screw rotations was 0.30 m/sec, and a mixture supplying rate was 10 kg/hr, i.e. a feeding rate of the mixture per unit cross-sectional area of the screw was 1.42 $kg/hr \cdot cm^2$. The resulting mixture was cooled to 40° C. or lower, and subjected to rough pulverization with Rotoplex, manufactured by Hosokawa Micron Corporation with a sieve having opening of 2 min, to provide a kneaded composition having a particle size of 2 mm or less.

One hundred parts by mass of the resulting kneaded composition, 3.0 parts by mass of a colorant "ECB-301," manufactured by DAINICHISEIKA COLOR & CHEMICALS MFG. CO., LTD., Phthalocyanine Blue, P.B. 15:3, 3.0 parts by mass of a releasing agent "WEP-9," manufactured by NOF CORPORATION, a synthetic ester wax, melting point of 72° C., and 1.0 part by mass of a negatively chargeable charge control agent "BONTRON E-84," manufactured by Orient Chemical Industries Co., Ltd., were mixed with a Henschel mixer for 1 minute, and then the mixture was melt-kneaded in the same manner as in Example 1.

The resulting melt-kneaded mixture was subjected to rough pulverization and fine pulverization in the same manner as in Example 1, and a pulverized product was subjected to classifying treatment to provide toner matrix particles.

The resulting toner matrix particles were mixed with external additives in the same manner as in Example 1 to provide a toner.

Test Example 1: Low-Temperature Fusing Ability

Each of the toners was loaded to a printer "OKI MICROLINE 5400," manufactured by Oki Data Corporation, modified so as to obtain an unfused image, and an unfused image which was a solid image of a square having a side of 2 cm was printed. Thereafter, this unfused image was subjected to a fusing treatment, with an external fusing device, a modified device of "OKI MICROLINE 3010" manufactured by Oki Data Corporation, at a rotational speed of the fusing roller of 120 mm/sec at each temperature, while raising the fusing roller temperatures from 100° to 230° C. in an increment of 5° C., to provide each of fused images. A sand-rubber eraser "ER-502R," manufactured by LION Office Products Corp., to which a load of 500 g was applied was moved backward and forward five times over a fused image obtained at each fusing temperature, and optical densities of the fused image before and after rubbing were measured with an optical densitometer "GRETAG SPM-50," manufactured by Gretag. The temperature of the fusing roller at which a ratio of optical densities before and after rubbing, i.e. optical densities after rubbing/before rubbing× 100, initially exceeds 90% is defined as a lowest fusing temperature, which was used as an index for low-temperature fusing ability. The lower the value, the more excellent the low-temperature fusing ability. The results are shown in Table A-4.

Test Example 2: Durability

Each of the toners was loaded to an ID cartridge "ML-5400 image drum," manufactured by Oki Data Corporation, modified such that the developer roller can be visually found, an idle run was operated under the conditions of temperature of 30° C. and humidity of 50%, at 70 r/min (corresponding to 36 ppm), and filming on the developer roller was visually observed. The time until generation of filming took place was used as an index of durability. It is shown that the longer the time until generation of filming of a developer roller took place, the more excellent the durability. The results are shown in Table A-4.

TABLE 4

Table A-4

| | Resin Composition | | | | | | | | | | | | | |
|---|---|---|---|---|---|---|---|---|---|---|---|---|---|---|
| | | | Details | | | | | | | | | | Properties of Toner | |
| | | | Polyester[1)] | | Polylactic Acid[2)] | | | Polyester[3)] | | | Polylactic Acid[4)] | | Low-Temp. | |
| | Kinds | Parts by Mass | Kinds | Parts by Mass | Kinds | Parts by Mass | Transesterification Ratio (%) | Kinds | Parts by Mass | Kinds | Parts by Mass | Kinds | Parts by Mass | Fusing Ability (° C.) | Durability (Hours) |
| Ex. 1 | RC-1 | 40 | L-1 | 20 | PLA-1 | 20 | 8.6 | H-1 | 50 | L-1 | 10 | — | — | 140 | 14.5 |
| Ex. 2 | RC-2 | 40 | L-1 | 20 | PLA-1 | 20 | 1.6 | H-1 | 50 | L-1 | 10 | — | — | 145 | 13.0 |
| Ex. 3 | RC-3 | 40 | L-1 | 20 | PLA-1 | 20 | 4.1 | H-1 | 50 | L-1 | 10 | — | — | 145 | 14.0 |
| Ex. 4 | RC-4 | 40 | L-1 | 20 | PLA-1 | 20 | 18.4 | H-1 | 50 | L-1 | 10 | — | — | 140 | 12.5 |
| Ex. 5 | RC-5 | 40 | L-1 | 20 | PLA-1 | 20 | 28.3 | H-1 | 50 | L-1 | 10 | — | — | 115 | 9.5 |
| Ex. 6 | RC-1 | 60 | L-1 | 30 | PLA-1 | 30 | 8.6 | H-1 | 40 | — | — | — | — | 145 | 13.5 |
| Ex. 7 | RC-1 | 20 | L-1 | 10 | PLA-1 | 10 | 8.6 | H-1 | 60 | L-1 | 20 | — | — | 140 | 14.0 |
| Ex. 8 | RC-1 | 10 | L-1 | 5 | PLA-1 | 5 | 8.6 | H-1 | 65 | L-1 | 25 | — | — | 140 | 12.0 |
| Ex. 9 | RC-6 | 40 | L-2 | 20 | PLA-1 | 20 | 8.5 | H-2 | 50 | L-2 | 10 | — | — | 145 | 14.5 |
| Ex. 10 | RC-1 | 40 | L-1 | 20 | PLA-1 | 20 | 8.6 | H-1 | 50 | L-1 | 10 | — | — | 145 | 13.0 |
| Ex. 11 | RC-7 | 40 | L-1 | 20 | PLA-2 | 20 | 8.3 | H-1 | 50 | L-1 | 10 | — | — | 145 | 14.5 |
| Ex. 12 | RC-1 | 40 | L-1 | 20 | PLA-1 | 20 | 8.6 | H-1 | 50 | L-1 | 10 | — | — | 140 | 15.0 |
| Comp. Ex. 1 | — | — | — | — | — | — | — | H-1 | 70 | L-1 | 30 | — | — | 155 | 1.0 |
| Comp. Ex. 2 | — | — | — | — | — | — | — | H-2 | 70 | L-2 | 30 | — | — | 155 | 1.5 |
| Comp. Ex. 3 | — | — | — | — | — | — | — | H-1 | 50 | L-1 | 30 | PLA-1 | 20 | Unable to form into toner | |
| Comp. Ex. 4 | — | — | — | — | — | — | — | H-1 | 50 | L-1 | 30 | PLA-1 | 20 | 165 | 1.5 |

[1)]Kinds and amount of a polyester subjected to a transesterification reaction.
[2)]Kinds and amount of a polylactic acid subjected to a transesterification reaction.
[3)]Kinds and amount of a polyester added other than a resin composition.
[4)]Kinds and amount of a polylactic acid added other than a resin composition.

It can be seen from the above results that the toners of Examples 1 to 12 have excellent low-temperature fusing ability and durability, as compared to those of Comparative Examples 1 to 4.

Example B

[Softening Point of Resins]

The measurement is taken in accordance with the same method as in the softening point of the polyester of Example A.

[Highest Temperature of Endothermic Peak and Melting Point of Resins]

The measurement is taken in accordance with the same method as in the highest temperature of endothermic peak and melting point of the polyester of Example A.

[Glass Transition Temperature of Resins]

The measurement is taken in accordance with the same method as in the glass transition temperature of the polyester of Example A.

[Acid Value of Resins]

The measurement is taken in accordance with the same method as in the acid value of the polyester of Example A.

[Crystallinity of Polylactic Acid]

The measurement is taken in accordance with the same method as in Example A.

[Melting Point of Polylactic Acid]

The measurement is taken in accordance with the same method as in Example A.

The measurement is taken in accordance with the same method as in Example A.

[Transesterification Ratio Based on Polylactic Acid]

The measurement is taken in accordance with the same method as in Example A.

[Melting Point of Releasing Agents]

The measurement is taken in accordance with the same method as in Example A.

[Melt Viscosity of Releasing Agents]

The measurements are taken in accordance with a Brookfield method using B-type viscometer LVT manufactured by Nippon ST Johnson, and the samples to be measured are heated and measured at 100° C., a temperature equal to or higher than a melting temperature of a releasing agent.

[Volume-Average Particle Size of External Additives]

The measurement is taken in accordance with the same method as in Example A.

[Volume-Median Particle Size of Toners]

The measurement is taken in accordance with the same method as in Example A.

Production Example 1 of Amorphous Polyesters [APES-1 and -2]

A 10-liter four-neck flask equipped with a nitrogen inlet tube, a dehydration tube, a stirrer, and a thermocouple was charged with raw material monomers other than trimellitic anhydride and an esterification catalyst, as listed in Table B-1. The temperature was raised to 200° C. under a nitrogen atmosphere, and the contents were reacted at that temperature for 6 hours. Further, the temperature was raised to 210° C., trimellitic anhydride was then added to the reaction mixture, and the contents were reacted at an ambient pressure, 101.3 kPa, for 1 hour, and further reacted at 40 kPa until a desired softening point was reached to provide each of amorphous polyesters, APES-1 and APES-2. The physical properties of APES-1 and APES-2 are shown in Table B-1. Here, the reaction percentage refers to a value calculated by [amount of water generated/theoretical amount of water generated]×100.

TABLE 5

Table B-1

| | | APES-1 | APES-2 |
|---|---|---|---|
| Raw Material Monomers | Alcohol Component | | |
| | 1,2-Propanediol | 2,815 g (100) | — |
| | BPA-PO[1)] | — | 3,150 g (50) |
| | BPA-EO[2)] | — | 2,925 g (50) |
| | Carboxylic Acid Component | | |
| | Terephthalic Acid | 5,225 g (85) | 2,542 g (85) |
| | Trimellitic Anhydride | 355 g (5) | 104 g (3) |
| Esterification Catalyst | Dibutyltin Oxide | 17 g | 18 g |
| Physical Properties of Resin | Softening Point (° C.) | 125 | 125 |
| | Highest Temp. of Endothermic Peak (° C.) | 69 | 69 |
| | Softening Point/Highest Temp. of Endothermic Peak | 1.8 | 1.8 |
| | Glass Transition Temp. (° C.) | 67 | 66 |
| | Acid Value (mgKOH/g) | 9.0 | 11.4 |

Note)
Numerical values inside the parentheses express molar ratios when the total number of moles of the alcohol component is 100.
[1)]BPA-PO: Polyoxypropylene(2.2)-2,2-bis(4-hydroxyphenyl)propane
[2)]BPA-EO: Polyoxyethylene(2.2)-2,2-bis(4-hydroxyphenyl)propane

Production Example 1 of Crystalline Polyester [CPES-1]

A 10-liter four-neck flask equipped with a nitrogen inlet tube, a dehydration tube, a stirrer, and a thermocouple was charged with raw material monomers as listed in Table B-2. The temperature was raised from 130° C. to 200° C., over 10 hours under nitrogen atmosphere, and the components were reacted at a pressure of 8 kPa for 1 hour at 200° C. to provide a crystalline polyester, CPES-1. The physical properties of the resulting CPES-1 are shown in Table B-2.

Production Example 2 of Crystalline Polyester [CPES-2]

A 10-liter four-neck flask equipped with a nitrogen inlet tube, a dehydration tube, a stirrer, and a thermocouple was charged with raw material monomers, esterification catalyst and polymerization inhibitor as listed in Table B-2. The temperature was raised from 130° C. to 200° C., over 10 hours under nitrogen atmosphere, and the components were reacted at a pressure of 8 kPa for 1 hour at 200° C. to provide a crystalline polyester, CPES-2. The physical properties of the resulting CPES-2 are

TABLE 6

Table B-2

| | | CPES-1 | CPES-2 |
|---|---|---|---|
| Raw Material Monomers | 1,10-Decanediol | 4,183 g (100) | — |
| | 1,6-Hexanediol | — | 4,490 g (100) |
| | Sebacic Acid | 4,854 g (100) | — |

TABLE 6-continued

Table B-2

| | | CPES-1 | CPES-2 |
|---|---|---|---|
| | Fumaric Acid | — | 4,411 g (100) |
| Esterification Catalyst | Tin(II) 2-Ethylhexanoate | 18 g | 18 g |
| Polymerization Inhibitor | tert-Butyl Catechol | — | 4.5 g |
| Physical Properties of Crystalline Resin | Softening Point (° C.) | 89 | 110 |
| | Highest Temp. of Endothermic Peak [Melting Point] (° C.) | 78 | 111 |
| | Softening Point/Highest Temp. of Endothermic Peak | 1.1 | 1.0 |

Note)
Numerical values inside the parentheses express molar ratios when the total number of moles of the alcohol component is 100.

Production Example 3 of Crystalline Polyester [CPES-3]

A 10-liter four-neck flask equipped with a nitrogen inlet tube, a dehydration tube, a stirrer, and a thermocouple was charged with raw material monomers of the polyester component other than acrylic acid, a dually reactive monomer, in given amounts as listed in Table B-3. The contents were heated to 160° C. to dissolve. To the solution was added dropwise over an hour with a dropwise funnel a solution of styrene, dicumyl peroxide, and acrylic acid previously mixed. The mixture was continued stirring for 1 hour while keeping the temperature to 170° C. to polymerize styrene and acrylic acid. Thereafter, 13 g of tin(II) 2-ethylhexanote was added to the polymerization mixture, the temperature was raised to 210° C., and the components were reacted at that temperature for 8 hours. Further, the components were reacted at 8.3 kPa for 1 hour, to provide a composite resin containing a crystalline polyester component, CPES-3. The physical properties of the resulting CPES-3 are shown in Table B-3.

TABLE 7

Table B-3

| | | | CPES-3 |
|---|---|---|---|
| Raw Material Monomers | Raw Material Monomers (P) for Polyester Component[1)] | 1,6-Hexanediol | 2,313 g (70) |
| | | 1,4-Butanediol | 756 g (30) |
| | | Terephthalic Acid | 3,347 g (72) |
| | | Acrylic Acid (Dually Reactive Monomer) | 202 g (10) |
| | Raw Material Monomers (S) for Styrenic Resin Component[2)] | Styrene | 2,593 g (100) |
| | | Dicumyl Peroxide (Polymerization Initiator) | 156 g (6) |
| Total Amount of P/Total Amount of S (Mass Ratio)[3)] | | | 72/28 |
| Esteriflcation Catalyst | | Tin(II) 2-Ethylhexanoate | 13 g |
| Physical Properties of Crystalline Resin | Softening Point (° C.) | | 104 |
| | Highest Temp. of Endothermic Peak [Melting Point] (° C.) | | 105 |
| | Softening Point/Highest Temp. of Endothermic Peak | | 1.0 |

[1)]Numerical values inside the parentheses express molar ratios when the total number of moles of the alcohol component is 100.
[2)]Numerical values inside the parentheses express mass ratios when the mass of styrene is 100.
[3)]The total amount of the raw material monomers for the styrenic resin component does not include dicumyl peroxide.

Production Example 1 of α-Olefin Based Copolymer (Releasing Agent 1)

"LINEALENE 26+" manufactured by Idemitsu Kosan Co., Ltd., a blend of α-olefins mainly composed of those having 26 or more carbon atoms, was distilled at a reduced pressure of 0.1 kPa, to provide a monomer A, a distillation fraction at a distillation temperature of from 200° to 300° C. This distillation fraction had a compositional ratio as follows: C(number of carbon atoms, hereinafter referred to the same) 24:1% by mol, C26:59% by mol, C28:38% by mol, C30:2% by mol.

Next, the monomer A and toluene were subjected to a dehydration treatment in an nitrogen atmosphere with dry nitrogen and active alumina, and a homogeneous supernatant solution was then extracted at room temperature of 25° C., to provide a toluene solution of the monomer A, a concentration of which was 23% by mass.

A 200 ml Schlenk flask previously heated and dried was charged with 50 ml of the obtained toluene solution of the monomer A. Thereto were added 0.5 mmol of triisobutylaluminum, 2 μmol of (1,2'-dimethylsilylene)(2,1'-dimethylsilylene)bis(3-trimethylsilylmethylindenyl)zirconium dichloride and 8 μmol of dimethylanilinium tetrakis(pentafluorophenyl)borate, hydrogen was introduced at 85° C. in an amount so as to have a pressure of 0.15 MPa, and the components were polymerized for 60 minutes. After the termination of the polymerization reaction, the precipitated reaction product was separated at room temperature, 25° C., and the precipitates were washed with toluene and acetone, and thereafter subjected to a drying treatment under heating and a reduced pressure, to provide an α-olefin based copolymer, Releasing Agent 1. The resulting Releasing Agent 1 had a melting point of 76° C., and a melt viscosity at 100° C. of 200 mPa·s.

Production Example of Resin Compositions

A 10-liter four-neck flask equipped with a nitrogen inlet tube, a dehydration tube, a stirrer, and a thermocouple was charged with an amorphous polyester in a given amount as listed in Table B-4. The contents were heated to a temperature as listed in Table B-4 in the nitrogen atmosphere to melt the amorphous polyester. Thereafter, a polylactic acid in a given amount as listed in Table B-4 was added thereto and the mixture was stirred for a given time as listed in Table 4. The resulting resin compositions were cooled to 40° C. or lower, the cooled product was subjected to rough pulverization with Rotoplex, manufactured by Hosokawa Micron Corporation using a sieve having a sieve opening of 2 min, to provide each of resin compositions (RC-1 to RC-6) containing polyester-polylactic acid copolymer having a particle size of 2 mm or less.

TABLE 8

Table B-4

| | | | RC-1 | RC-2 | RC-3 | RC-4 | RC-5 | RC-6 |
|---|---|---|---|---|---|---|---|---|
| Resin | Amorphous Polyester | APES-1 | 50 | 50 | 50 | 50 | 50 | — |
| | | APES-2 | — | — | — | — | — | 50 |
| | Polylactic Acid | PLA-1 | 50 | 50 | 50 | 50 | 50 | 50 |
| Transesterification Reaction | Temp. (° C.) | | 170 | 170 | 170 | 170 | 170 | 170 |
| | Time (Hours) | | 5 | 1 | 3 | 10 | 12 | 5 |
| | Transesterification Ratio (%) | | 9.0 | 1.6 | 4.9 | 19.1 | 26.5 | 8.8 |

Note)
PLA-1: N-3000, manufactured by Nature Works, Mn 188,000, Mw 472,000, melting point 170° C., crystallinity 92%

Production Example of Toners

Examples 1 to 14 and Comparative Examples 1 and 2

A resin composition, an amorphous polyester, a crystalline polyester in given amounts as listed in Table 5, 3.0 parts by mass of a colorant "ECB-301," manufactured by DAINICHISEIKA COLOR & CHEMICALS MFG. CO., LTD., Phthalocyanine Blue, P.B. 15:3, 1.0 part by mass of a negatively chargeable charge control agent "BONTRON E-84," manufactured by Orient Chemical Industries Co., Ltd., and 3.0 parts by mass of a releasing agent "Releasing Agent 1," Production Example 1 of α-olefin based polymer, α-olefin based copolymer, melting point of 76° C., were mixed with a Henschel mixer, manufactured by NIPPON COKE & ENGINEERING CO., LTD., for 1 minute, and the mixture was melt-kneaded under the condition set forth below.

A continuous twin open-roller type kneader "Kneadex," manufactured by NIPPON COKE & ENGINEERING CO., LTD., having an outer diameter of roller of 14 cm and an effective length of roller of 80 cm, was used. The operating conditions of the continuous twin open-roller type kneader were a peripheral speed of a high-rotation roller, a front roller, of 32.4 m/min, a peripheral speed of a low-rotation roller, a back roller, of 21.7 m/min, and a gap between the rollers of 0.1 mm. The temperatures of the heating medium and the cooling medium inside the rollers are as follows. The high-rotation roller had a temperature at the raw material supplying side of 145° C., and a temperature at the kneaded product discharging side of 100° C., and the low-rotation roller had a temperature at the raw material supplying side of 75° C., and a temperature at the kneaded product discharging side of 35° C. In addition, the feeding rate of the raw material mixture was 10 kg/hr, and the average residence time was about 3 minutes.

The melt-kneaded mixture was cooled, and the cooled mixture was then roughly pulverized with a pulverizer "Rotoplex," manufactured by Hosokawa Micron Corporation using a sieve having a sieve opening of 2 mm, to provide a roughly pulverized product having a particle size of 2 mm or less. The resulting roughly pulverized product was subjected to fine pulverization with an air jet-type classifier Model DS2, impact jet type, manufactured by Nippon Pneumatic Mfg. Co., Ltd., while adjusting a pulverization pressure so as to have a volume-median particle size of 8.0 μm. The resulting finely pulverized product was subjected to classification with an air jet-type classifier Model DSX2, manufactured by Nippon Pneumatic Mfg. Co., Ltd., while adjusting a static pressure (internal pressure) so as to have a volume-median particle size of 8.5 μm, to provide toner matrix particles.

One hundred parts by mass of the toner matrix particles obtained were mixed with 1.0 part by mass of a hydrophobic silica "R972," manufactured by Nippon Aerosil Co., Ltd., volume-average particle size: 16 nm, and 1.0 part by mass of a hydrophobic silica "NAX50," manufactured by Nippon Aerosil Co., Ltd., volume-average particle size: 30 nm, with a Henschel mixer manufactured by NIPPON COKE & ENGINEERING CO., LTD. at 2,100 r/min, i.e. a peripheral speed of 29 m/sec, for 3 minutes, to provide each of toners.

Example 15

Toner raw materials were mixed in Example 1 with a Henschel mixer, and melt-kneaded under the conditions shown below.

A co-rotating twin-screw extruder PCM-30, manufactured by IKEGAI Corporation, having a screw diameter of 2.9 cm and a cross-sectional area of the screw of 7.06 $cm^2$, was used. The operating conditions were as follows: The barrel setting temperature was 100° C., a rotational speed of the screw was 200 r/min, i.e. a peripheral speed of the screw rotations was 0.30 m/sec, and a mixture supplying rate was 10 kg/hr, i.e. a feeding rate of the mixture per unit cross-sectional area of the screw was 1.42 $kg/hr \cdot cm^2$.

The resulting melt-kneading mixture was subjected to rough pulverization and fine pulverization in the same manner as in Example 1, and a pulverized product was subjected to classification treatment, to provide toner matrix particles.

The resulting toner matrix particles were mixed with external additives in the same manner as in Example 1 to provide a toner.

Example 16

Toner raw materials were melt-kneaded in Example 1, the resulting melt-kneaded mixture was pressed with a cooling roller and cooled to 20° C. or lower, and thereafter the cooled product was subjected to heat-treatment in an oven at 70° C., for 9 hours.

The heat-treated product after heat-treatment was cooled to 30° C., and subjected to pulverization and classification in the same manner as in Example 1, to provide a toner matric particle. The resulting toner matrix particle was subjected to externally adding treatment in the same manner as in Example 1 to provide a toner.

Comparative Example 3

An amorphous polyester, a crystalline polyester and a polylactic acid in given amounts as listed in Table B-5, 4.0 parts by mass of a colorant "ECB-301," manufactured by DAINICHISEIKA COLOR & CHEMICALS MFG. CO., LTD., Phthalocyanine Blue, P.B. 15:3, 0.5 parts by mass of a negatively chargeable charge control agent "BONTRON E-304," manufactured by Orient Chemical Industries Co., Ltd., and 3.0 parts by mass "HNP-9," manufactured by NIPPON SEIRO CO., LTD., paraffin wax, melting point of 75° C., were mixed with a Henschel mixer for 1 minute and the mixture was melt-kneaded and subjected to pulverization and classification in the same manner as in Example 1. However, in the resulting particles, the amorphous polyester and the polylactic acid were separated without being compatible to each other, so that the particles could not be used as a toner.

Comparative Example 4

An amorphous polyester and a polylactic acid in given amount listed as Table B-5 were mixed with Henschel mixer, and thereafter the mixture was melt-kneaded under the conditions shown below.

A co-rotating twin-screw extruder "PCM-30," manufactured by IKEGAI Corporation, having a screw diameter of 2.9 cm and a cross-sectional area of the screw of 7.06 $cm^2$, was used. The operating conditions were as follows: The barrel setting temperature was 160° C., a rotational speed of the screw was 200 r/min, i.e. a peripheral speed of the screw rotations was 0.30 m/sec, and a mixture supplying rate was 10 kg/hr, i.e. a feeding rate of the mixture per unit cross-sectional area of the screw was 1.42 $kg/hr \cdot cm^2$. The resulting melt-kneaded mixture was cooled to 40° C. or lower, and then roughly pulverized with Rotoplex, manufactured by Hosokawa Micron Corporation using a sieve having a sieve opening of 2 mm to provide a kneaded composition having a particle size of 2 mm or less.

Ninety parts by mass of the resulting kneaded composition, 10 parts by mass of a crystalline polyester, 3.0 parts by mass of a colorant "ECB-301," manufactured by DAINICHISEIKA COLOR & CHEMICALS MFG. CO., LTD., Phthalocyanine Blue, P.B. 15:3, 1.0 part by mass of a negatively chargeable charge control agent "BONTRON E-84," manufactured by Orient Chemical Industries Co., Ltd., and 3.0 parts by mass of a releasing agent "Releasing Agent 1," Production Example 1 of α-Olefin Based Polymer, α-olefin based copolymer, melting point of 76° C., were mixed with a Henschel mixer for 1 minute and the mixture was melt-kneaded in the same manner as in Example 1.

The resulting melt-kneaded mixture was subjected to rough pulverization and fine pulverization in the same manner as in Example 1, and subjected to classification treatment, to provide toner matrix particles.

The resulting toner matrix particle was mixed with external additive in the same manner as in Example 1 to provide a toner.

Test Example 1: Low-Temperature Fusing Ability

The evaluation was taken in accordance with the same method as in Test Example 1 of Example A.

In other words, each of the toilers was loaded to a printer "OKI MICROLINE 5400," manufactured by Oki Data Corporation, modified so as to obtain an unfused image, and an unfused image which was a solid image of a square having a side of 2 cm was printed. Thereafter, this unfused image was subjected to a fusing treatment, with an external fusing device, a modified device of "OKI MICROLINE 3010" manufactured by Oki Data Corporation, at a rotational speed of the fusing roller of 120 mm/sec at each temperature, while raising the fusing roller temperatures from 100° to 230° C. in an increment of 5° C., to provide each of fused images. A sand-rubber eraser "ER-502R," manufactured by LION Office Products Corp., to which a load of 500 g was applied was moved backward and forward five times over a fused image obtained at each fusing temperature, and optical densities of the fused image before and after rubbing were measured with an optical densitometer "GRETAG SPM-50," manufactured by Gretag. The temperature of the fusing roller at which a ratio of optical densities before and after rubbing, i.e. optical densities after rubbing/before rubbing× 100, initially exceeds 90% is defined as a lowest fusing temperature, which was used as an index for low-temperature fusing ability. The lower the value, the more excellent the low-temperature fusing ability. The results are shown in Table B-5.

Test Example 2: Gloss

Each of the toners was loaded to a nonmagnetic monocomponent developer device "OKI MICROLINE 5400," manufactured by Oki Data Corporation. With adjusting the amount of toner adhesion to 0.40±0.03 mg/cm$^2$, a solid image having a size of 4.1 cm×4.11 cm was printed on J sheet, manufactured by Fuji Xerox Co Ltd. The solid image was taken out before passing through a fusing device, to provide an unfused image. A sheet containing the resulting unfused image was fed to a nonmagnetic monocomponent developer device "OKI MICROLINE 5400," manufactured by Oki Data Corporation, and a solid image having a size of 4.1 cm×4.1 cm was again printed thereon. The solid image was taken out before passing through a fusing device, to provide a two-layered unfused image, having an amount of toner adhesion of 0.80±0.06 mg/cm$^2$. The same procedures were repeated, to provide a three-layered unfused image having an amount of toner adhesion of 1.20±0.09 mg/cm$^2$.

The resulting three-layered unfused image was fused with an external fusing device, which was a fusing device obtained from "OKI MICROLINE 3010," manufactured by Oki Data Corporation for external fusing, while setting the temperature of the fusing roller to 100° C. and a fusing speed to 120 mm/sec. Thereafter, the same procedures were carried out with setting the fusing roller temperature at 105° C., and raising the temperature to 190° C. in an increment of 5° C. The glossiness of the resulting three-layered fused image at each fusing temperature was measured, and a maximum value thereof is defined as gloss of the sample. The glossiness was measured with a Gloss Meter "PG-1," manufactured by NIPPON DENSHOKU INDUSTRIES CO., LTD., with a light source set at an angle of 60°. The higher the glossiness, the more excellent the gloss. The results are shown in Table B-5.

Test Example 3: Durability

The evaluation was carried out by the same method as in Example 2 of Example A

In other words, each of the toners was loaded to an ID cartridge "ML-5400 image drum," manufactured by Oki Data Corporation, modified such that the developer roller can be visually found, an idle run was operated under the conditions of a temperature of 30° C. and humidity of 50%, at 70 r/min (corresponding to 36 ppm), and filming on the developer roller was visually observed. The time until generation of filming took place was used as an index of durability. It is shown that the longer the time until generation of filming of a developer roller took place, the more excellent the durability. The results are shown in Table B-5.

TABLE 9

Table B-5

| | Resin Composition | | | | | | | | | | | | | | | |
|---|---|---|---|---|---|---|---|---|---|---|---|---|---|---|---|---|
| | | | Details | | | | | | | | | | | | | |
| | | | Amorphous Polyester[1)] | | Polylactic Acid[2)] | | | Crystalline Polyester | | Amorphous Polyester[3)] | | Polylactic Acid[4)] | | Properties of Toner | | |
| | Kinds | Parts by Mass | Kinds | Parts by Mass | Kinds | Parts by Mass | Transesterification Ratio (%) | Kinds | Parts by Mass | Kinds | Parts by Mass | Kinds | Parts by Mass | Lowest Fusing Temp. (° C.) | Gloss | Durability (Hours) |
| Ex. 1 | RC-1 | 40 | APES-1 | 20 | PLA-1 | 20 | 9.0 | CPES-1 | 10 | APES-1 | 50 | — | — | 135 | 29 | 11.0 |
| Ex. 2 | RC-2 | 40 | APES-1 | 20 | PLA-1 | 20 | 1.6 | CPES-1 | 10 | APES-1 | 50 | — | — | 140 | 20 | 9.5 |
| Ex. 3 | RC-3 | 40 | APES-1 | 20 | PLA-1 | 20 | 4.9 | CPES-1 | 10 | APES-1 | 50 | — | — | 140 | 23 | 10.0 |
| Ex. 4 | RC-4 | 40 | APES-1 | 20 | PLA-1 | 20 | 19.1 | CPES-1 | 10 | APES-1 | 50 | — | — | 135 | 30 | 9.5 |
| Ex. 5 | RC-5 | 40 | APES-1 | 20 | PLA-1 | 20 | 26.5 | CPES-1 | 10 | APES-1 | 50 | — | — | 130 | 32 | 9.0 |
| Ex. 6 | RC-1 | 60 | APES-1 | 30 | PLA-1 | 30 | 9.0 | CPES-1 | 10 | APES-1 | 30 | — | — | 140 | 21 | 12.0 |
| Ex. 7 | RC-1 | 20 | APES-1 | 10 | PLA-1 | 10 | 9.0 | CPES-1 | 10 | APES-1 | 70 | — | — | 135 | 29 | 10.5 |
| Ex. 8 | RC-1 | 10 | APES-1 | 5 | PLA-1 | 5 | 9.0 | CPES-1 | 10 | APES-1 | 80 | — | — | 135 | 31 | 9.5 |
| Ex. 9 | RC-1 | 40 | APES-1 | 20 | PLA-1 | 20 | 9.0 | CPES-1 | 5 | APES-1 | 55 | — | — | 140 | 23 | 11.5 |
| Ex. 10 | RC-1 | 40 | APES-1 | 20 | PLA-1 | 20 | 9.0 | CPES-1 | 20 | APES-1 | 40 | — | — | 130 | 32 | 8.0 |
| Ex. 11 | RC-1 | 40 | APES-1 | 20 | PLA-1 | 20 | 9.0 | CPES-1 | 30 | APES-1 | 30 | — | — | 125 | 34 | 6.0 |
| Ex. 12 | RC-6 | 40 | APES-2 | 20 | PLA-1 | 20 | 8.8 | CPES-1 | 10 | APES-2 | 50 | — | — | 135 | 25 | 11.0 |
| Ex. 13 | RC-1 | 40 | APES-1 | 20 | PLA-1 | 20 | 9.0 | CPES-2 | 10 | APES-1 | 50 | — | — | 140 | 30 | 9.5 |
| Ex. 14 | RC-1 | 40 | APES-1 | 20 | PLA-1 | 20 | 9.0 | CPES-3 | 10 | APES-1 | 50 | — | — | 140 | 28 | 10.5 |
| Ex. 15 | RC-1 | 40 | APES-1 | 20 | PLA-1 | 20 | 9.0 | CPES-1 | 10 | APES-1 | 50 | — | — | 140 | 28 | 9.0 |
| Ex. 16 | RC-1 | 40 | APES-1 | 20 | PLA-1 | 20 | 9.0 | CPES-1 | 10 | APES-1 | 50 | — | — | 140 | 29 | 11.5 |
| Comp. Ex. 1 | RC-1 | 40 | APES-2 | 20 | PLA-1 | 20 | 9.0 | — | — | APES-2 | 60 | — | — | 150 | 12 | 12.0 |
| Comp. Ex. 2 | — | — | — | — | — | — | — | CPES-1 | 10 | APES-1 | 90 | — | — | 145 | 32 | 1.0 |
| Comp. Ex. 3 | — | — | — | — | — | — | — | CPES-1 | 10 | APES-1 | 70 | PLA-1 | 20 | Unable to form into toner | | |

TABLE 9-continued

Table B-5

| | Resin Composition | | | | | | | | | | | | | | | |
|---|---|---|---|---|---|---|---|---|---|---|---|---|---|---|---|---|
| | | | Details | | | | | | | | | | | | | |
| | | | Amorphous Polyester[1)] | | Polylactic Acid[2)] | | | Crystalline Polyester | | Amorphous Polyester[3)] | | Polylactic Acid[4)] | | Properties of Toner | | |
| | Kinds | Parts by Mass | Kinds | Parts by Mass | Kinds | Parts by Mass | Transesterification Ratio (%) | Kinds | Parts by Mass | Kinds | Parts by Mass | Kinds | Parts by Mass | Lowest Fusing Temp. (° C.) | Gloss | Durability (Hours) |
| Comp. Ex. 4 | — | — | — | — | — | — | — | CPES-1 | 10 | APES-1 | 70 | PLA-1 | 20 | 165 | 5 | 1.0 |

[1)]Kinds and amount of an amorphous polyester subjected to a transesterification reaction.
[2)]Kinds and amount of a polylactic acid subjected to a transesterification reaction.
3)Kinds and amount of an amorphous polyester added other than a resin composition.
[4)]Kinds and amount of a polylactic acid added other than a resin composition.

It can be seen from the above results that the toners of Examples 1 to 16 have excellent low-temperature fusing ability, gloss and durability, as compared to the toners of Comparative Examples 1 to 4.

Example C

[Softening Point of Polyesters]
The measurement is taken in accordance with the same method as in Example A.
[Glass Transition Temperature of Polyesters]
The measurement is taken in accordance with the same method as in Example A.
[Acid Value of Polyesters]
The measurement is taken in accordance with the same method as in Example A.
[Crystallinity of Polylactic Acids]
The measurement is taken in accordance with the same method as in Example A.
[Melting Point of Polylactic Acids]
The measurement is taken in accordance with the same method as in Example A.
[Average Molecular Weight of Polylactic Acids]
The measurement is taken in accordance with the same method as in Example A.
[Transesterification Ratio Based on Polylactic Acids]
The measurement is taken in accordance with the same method as in Example A.
[Melting Point of Releasing Agents]
The measurement is taken in accordance with the same method as in Example A.
[Melt Viscosity of Releasing Agents]
The measurement is taken in accordance with the same method as in Example B.
[Volume-Average Particle Size of External Additives]
The measurement is taken in accordance with the same method as in Example A.
[Volume-Median Particle Size of Toners]
The measurement is taken in accordance with the same method as in Example A.

Production Example 1 of Polyester Resins [H-1, H-2 and L-1]

A 10-liter four-neck flask equipped with a nitrogen inlet tube, a dehydration tube, a stirrer, and a thermocouple was charged with raw material monomers other than trimellitic anhydride and an esterification catalyst, as listed in Table C-1. The temperature was raised to 200° C. under a nitrogen atmosphere, and the contents were reacted at that temperature for 6 hours. Further, the temperature was raised to 210° C., trimellitic anhydride was then added to the reaction mixture, and the contents were reacted at an ambient pressure, 101.3 kPa, for 1 hour, and further reacted at 40 kPa until a desired softening point was reached to provide each of polyesters. The physical properties of resulting polyesters are shown in Table C-1. Here, the reaction percentage refers to a value calculated by [amount of water generated/theoretical amount of water generated]×100.

Production Example 2 of Polyester Resin [L-2]

A 10-liter four-neck flask equipped with a nitrogen inlet tube, a dehydration tube, a stirrer, and a thermocouple was charged with raw material monomers and an esterification catalyst, as listed in Table C-1. The temperature was raised to 200° C. under a nitrogen atmosphere, and the contents were reacted at that temperature for 6 hours. Further, the temperature was raised to 210° C., the components were reacted at an ambient pressure, 101.3 kPa, for 1 hour, and further reacted at 40 kPa until a softening point of 108° C. was reached to provide a polyester. The physical properties of resulting polyester are shown in Table C-1.

TABLE 10

Table C-1

| | | H-1 | H-2 | L-1 | L-2 |
|---|---|---|---|---|---|
| Raw Material Monomers | Alcohol Component | | | | |
| | 1,2-Propanediol | 2,815 g (100) | — | 2,815 g (100) | — |
| | BPA-PO[1)] | — | 4,410 g (70) | — | 6,300 g (100) |
| | BPA-EO[2)] | — | 1,755 g (30) | — | — |
| | Carboxylic Acid Component | | | | |
| | Terephthalic Acid | 4,918 g (80) | 2,093 g (70) | 5,225 g (85) | 2,542 g (85) |
| | Trimellitic Anhydride | 711 g (10) | 519 g (15) | 355 g (5) | — |

TABLE 10-continued

Table C-1

| | | H-1 | H-2 | L-1 | L-2 |
|---|---|---|---|---|---|
| Esterification Catalyst | Dibutyltin Oxide | 17 g | 18 g | 17 g | 18 g |
| Physical Properties of Resin | Softening Point (° C.) | 134 | 133 | 112 | 108 |
| | Glass Transition Temp. (° C.) | 68 | 70 | 66 | 66 |
| | Acid Value (mgKOH/g) | 18.3 | 18.6 | 17.6 | 10.6 |

Note)
Numerical values inside the parentheses express molar ratios when the total number of moles of the alcohol component is 100.
1)BPA-PO: Polyoxypropylene(2.2)-2,2-bis(4-hydroxyphenyl)propane
2)BPA-EO: Polyoxyethylene(2.2)-2,2-bis(4-hydroxyphenyl)propane

Production Example 1 of α-Olefin-Based Copolymer (Releasing Agent 1)

"LINEALENE 26+," manufactured by Idemitsu. Kosan Co., Ltd., a blend of α-olefins mainly composed of those having 26 or more carbon atoms, was distilled at a reduced pressure of 0.1 kPa, to provide a monomer A, a distillation fraction at a distillation temperature of from 200° to 300° C. This distillation fraction had a compositional ratio as follows: C(number of carbon atoms, hereinafter referred to the same) 24:1% by mol, C26:59% by mol, C28:38% by mol, C30:2% by mol.

Next, the monomer A and toluene were subjected to a dehydration treatment in an nitrogen atmosphere with dry nitrogen and active alumina, and a homogeneous supernatant solution was then extracted at room temperature, 25° C., to provide a toluene solution of the monomer A (concentration: 23% by mass).

A 200 ml Schlenk flask previously heated and dried was charged with 50 ml of the obtained toluene solution of the monomer A. Thereto were added 0.5 mmol of triisobutylaluminum, 2 μmol of (1,2'-dimethylsilylene)(2,1'-dimethylsilylene)bis(3-trimethylsilylmethylindenyl)zirconium dichloride and 8 μmol of dimethylanilinium tetrakis(pentafluorophenyl)borate, hydrogen was introduced at 85° C. in an amount so as to have a pressure of 0.15 MPa, and the components were polymerized for 60 minutes. After the termination of the polymerization reaction, the precipitated reaction product was separated at room temperature, 25° C., and the precipitates were washed with toluene and acetone, and thereafter subjected to a drying treatment under heating and a reduced pressure, to provide an α-olefin based copolymer, Releasing Agent 1. The resulting Releasing Agent 1 had a melting point of 76° C., and a melt viscosity at 100° C. of 200 mPa·s.

Production Example of Resin Compositions

A 10-liter four-neck flask equipped with a nitrogen inlet tube, a dehydration tube, a stirrer, and a thermocouple was charged with a polyester in a given amount as listed in Table C-2. The contents were heated to a temperature as listed in Table C-2 in the nitrogen atmosphere to melt the polyester. Thereafter, a polylactic acid in a given amount as listed in Table C-2 was added to the melted mixture, and the mixture was stirred for a given time as listed in Table C-2. The resulting resin compositions were cooled to 40° C. or lower, the cooled product was subjected to rough pulverization with Rotoplex, manufactured by Hosokawa Micron Corporation using a sieve having a sieve opening of 2 mm, to provide each of resin compositions (RC-1 to RC-6) containing polyester-polylactic acid copolymer having a particle size of 2 mm or less.

TABLE 11

Table C-2

| | | | RC-1 | RC-2 | RC-3 | RC-4 | RC-5 | RC-6 |
|---|---|---|---|---|---|---|---|---|
| Resin | Polyester | L-1 | 50 | 50 | 50 | 50 | 50 | — |
| | | L-2 | — | — | — | — | — | 50 |
| | Polylactic Acid | PLA-1 | 50 | 50 | 50 | 50 | 50 | 50 |
| Transesterification Reaction | Temp. (° C.) | | 170 | 170 | 170 | 170 | 170 | 170 |
| | Time (Hours) | | 5 | 1 | 3 | 10 | 12 | 5 |
| | Transesterification Ratio (%) | | 8.6 | 1.6 | 4.1 | 18.4 | 28.3 | 8.5 |

Note)
PLA-1: N-3000 (manufactured by Nature Works), Mn 188,000, Mw 472,000, melting point 170° C., crystallinity 92%

Production Example of Toners

Examples 1 to 15 and Comparative Examples 1 to 3

A resin composition, an polyester and a releasing agent in given amounts as listed in Table C-4, 3.0 parts by mass of a colorant "ECB-301," manufactured by DAINICHISEIKA COLOR & CHEMICALS MFG. CO., LTD., Phthalocyanine Blue, P.B. 15:3, and 1.0 part by mass of a negatively chargeable charge control agent "BONTRON E-84," manufactured by Orient Chemical Industries Co., Ltd., were mixed with a Henschel mixer, manufactured by NIPPON COKE & ENGINEERING CO., LTD., for 1 minute, and the mixture was melt-kneaded under the condition set forth below.

A continuous twin open-roller type kneader "Kneadex," manufactured by NIPPON COKE & ENGINEERING CO., LTD., having an outer diameter of roller of 14 cm and an effective length of roller of 80 cm, was used. The operating conditions of the continuous twin open-roller type kneader were a peripheral speed of a high-rotation roller, a front roller, of 32.4 m/min, a peripheral speed of a low-rotation roller, a back roller, of 21.7 m/min, and a gap between the rollers of 0.1 mm. The temperatures of the heating medium and the cooling medium inside the rollers are as follows. The high-rotation roller had a temperature at the raw material supplying side of 145° C., and a temperature at the kneaded product discharging side of 100° C., and the low-rotation roller had a temperature at the raw material supplying side of 75° C., and a temperature at the kneaded product discharging side of 35° C. In addition, the feeding rate of the raw material mixture was 10 kg/hr, and the average residence time was about 3 minutes.

The melt-kneaded mixture was cooled, and the cooled mixture was then roughly pulverized with a pulverizer "Rotoplex," manufactured by Hosokawa Micron Corporation using a sieve having a sieve opening of 2 mm, to provide a roughly pulverized product having a particle size of 2 mm or less. The resulting roughly pulverized product was subjected to fine pulverization with an air jet-type classifier Model DS2, impact jet type, manufactured by Nippon Pneumatic Mfg. Co., Ltd., while adjusting a pulverization pressure so as to have a volume-median particle size of 8.0 μm. The resulting finely pulverized product was subjected to classification with an air jet-type classifier Model DSX2, manufactured by Nippon Pneumatic Mfg. Co., Ltd., while adjusting a static pressure (internal pressure) so as to have a volume-median particle size of 8.5 μm, to provide toner matrix particles.

One hundred parts by mass of the toner matrix particles obtained were mixed with 1.0 part by mass of a hydrophobic silica "R972," manufactured by Nippon Aerosil Co., Ltd., volume-average particle size: 16 nm, and 1.0 part by mass of a hydrophobic silica "NAX50," manufactured by Nippon Aerosil Co., Ltd., volume-average particle size: 30 nm, with a Henschel mixer manufactured by NIPPON COKE & ENGINEERING CO., LTD., at 2,100 r/min, i.e. a peripheral speed of 29 m/sec, for 3 minutes, to provide each of toners.

Example 16

Toner raw materials were mixed in Example 1, with a Henschel mixer, and melt-kneaded under the conditions shown below.

A co-rotating twin-screw extruder PCM-30, manufactured by IKEGAI Corporation, having a screw diameter of 2.9 cm and a cross-sectional area of the screw of 7.06 $cm^2$, was used. The operating conditions were as follows: The barrel setting temperature was 100° C., a rotational speed of the screw was 200 r/min, i.e. a peripheral speed of the screw rotations was 0.30 m/sec, and a mixture supplying rate was 10 kg/hr, i.e. a feeding rate of the mixture per unit cross-sectional area of the screw was 1.42 $kg/hr \cdot cm^2$.

The resulting melt-kneading mixture was subjected to rough pulverization and fine pulverization in the same manner as in Example 1, and pulverized product was subjected to classification treatment, to provide toner matrix particles.

The resulting toner matrix particles were mixed with external additives in the same manner as in Example 1, to provide a toner.

Comparative Example 4

A polyester, a polylactic acid, a releasing agent in given amounts as listed in Table C-4, 4.0 parts by mass of a colorant "ECB-301," manufactured by DAINICHISEIKA COLOR & CHEMICALS MFG. CO., LTD., Phthalocyanine Blue, P.B. 15:3, and 0.5 parts by mass of a negatively chargeable charge control agent "BONTRON E-304," manufactured by Orient Chemical Industries Co., Ltd., were mixed with a Henschel mixer for 1 minute and the mixture was melt-kneaded and subjected to pulverization and classification in the same manner as in Example 1. However, in the resulting particles, the polyester and the polylactic acid were separated without being compatible to each other, so that the particles could not be used as a toner.

Comparative Example 5

A polyester and a polylactic acid in given amounts listed as Table C-4 were mixed with a Henschel mixer under the condition set forth below.

A co-rotating twin-screw extruder "PCM-30," manufactured by IKEGAI Corporation, having a screw diameter of 2.9 cm and a cross-sectional area of the screw of 7.06 $cm^2$, was used. The operating conditions were as follows: The barrel setting temperature was 160° C., a rotational speed of the screw was 200 r/min, i.e. a peripheral speed of the screw rotations was 0.30 m/sec, and a mixture supplying rate was 10 kg/hr, i.e. a feeding rate of the mixture per unit cross-sectional area of the screw was 1.42 $kg/hr \cdot cm^2$. The resulting kneaded mixture was cooled to 40° C. or lower, and then roughly pulverized with Rotoplex, manufactured by Hosokawa Micron Corporation using a sieve having a sieve opening of 2 mm, to provide a kneaded composition having a particle size of 2 mm or less.

One hundred parts by mass of the resulting kneaded composition, 6 parts by mass of a releasing agent, 3.0 parts by mass of a colorant "ECB-301," manufactured by DAINICHISEIKA COLOR & CHEMICALS MFG. CO., LTD., Phthalocyanine Blue, P.B. 15:3, and 1.0 part by mass of a negatively chargeable charge control agent "BONTRON E-84," manufactured by Orient Chemical Industries Co., Ltd., were mixed with a Henschel mixer for 1 minute, and the mixture was melt-kneaded in the same manner as in Example 1.

The resulting melt-kneading mixture was subjected to rough pulverization and fine pulverization in the same manner as in Example 1, and pulverized product was subjected to classification treatment, to provide toner matrix particles.

The resulting toner matrix particles were mixed with external additives in the same manner as in Example 1, to provide a toner.

A releasing agent used in each of Examples and Comparative Examples is shown in Table C-3.

TABLE 12

Table C-3

| Kinds | Chemical Name | Manufacturer and Trade Name | Melting Point (° C.) |
|---|---|---|---|
| W-1 | α-Polyolefin Wax | α-Olefin-Based Copolymer of Production Example 1 (Releasing Agent 1) | 76 |
| W-2 | Polypropylene Wax | MITSUI HI WAX NP056, manufactured by MITSUI CHEMICALS, INC. | 127 |
| W-3 | Fischer-Tropsch Wax | SHELL GTL SARAWAX SX105, manufactured by SHELL | 105 |
| W-4 | Paraffin Wax | HNP-9, manufactured by NIPPON SEIRO CO., LTD. | 77 |
| W-5 | Carnauba Wax | WAX-C1, manufactured by S. Kato & CO. | 84 |
| W-6 | Synthetic Ester Wax | WEP-9, manufactured by NOF CORPORATION | 72 |

Test Example 1: Background Fog Under High-Temperature, High-Humidity Conditions

Each of the toners was loaded to a nonmagnetic monocomponent developer "OKI MICROLINE 5400," manufactured by Oki Data Corporation, and allowed to stand for 6 hours under environmental conditions of 30° C./80% RH, and thereafter images having a print coverage of 1% were printed for ten sheets in a standard development bias. The degree of whiteness of the sheet before and after print was measured with "Gretag SPM50" manufactured by Gretag, and an average of difference of the degrees of whiteness (ΔE) was used as an index of background fog on the paper. The smaller the value, the more inhibited the background fog. The results are shown in Table C-4.

Test Example 2: Durability

The evaluation was carried out by the same method as in Test Example 2 of Example A.

In other words, each of the toners was loaded to an ID cartridge "ML-5400 image drum," manufactured by Oki Data Corporation, modified to allow the developer roller to be visually found, an idle run was operated under the conditions of a temperature of 30° C. and humidity of 50% at 70 r/min (corresponding to 36 ppm), and filming on the developer roller was visually observed. The time until generation of filming took place was used as an index of durability. It is shown that the longer the time until generation of filming of a developer roller took place, the more excellent the durability. The results are shown in Table C-4.

TABLE 13

Table C-4

| | Resin Composition | | | | | | | | | | | | | Properties of Toner | |
|---|---|---|---|---|---|---|---|---|---|---|---|---|---|---|---|
| | | | Details | | | | | | | | | | | Background | |
| | | | Polyester[1)] | | Polylactic Acid[2)] | | | Polyester[3)] | | | Polylactic Acid[4)] | | Releasing Agent | Fog Under High-Temp., | |
| | Kinds | Parts by Mass | Kinds | Parts by Mass | Kinds | Parts by Mass | Transesterification Ratio (%) | Kinds | Parts by Mass | Kinds | Parts by Mass | Kinds | Parts by Mass | Kinds | Parts by Mass | High-Humidity Conditions | Durability (Hours) |
| Ex. 1 | RC-1 | 40 | L-1 | 20 | PLA-1 | 20 | 8.6 | H-1 | 50 | L-1 | 10 | — | — | W-1 | 6 | 0.10 | 12.0 |
| Ex. 2 | RC-2 | 40 | L-1 | 20 | PLA-1 | 20 | 1.6 | H-1 | 50 | L-1 | 10 | — | — | W-1 | 6 | 0.14 | 12.5 |
| Ex. 3 | RC-3 | 40 | L-1 | 20 | PLA-1 | 20 | 4.1 | H-1 | 50 | L-1 | 10 | — | — | W-1 | 6 | 0.12 | 12.0 |
| Ex. 4 | RC-4 | 40 | L-1 | 20 | PLA-1 | 20 | 21.4 | H-1 | 50 | L-1 | 10 | — | — | W-1 | 6 | 0.10 | 11.0 |
| Ex. 5 | RC-5 | 40 | L-1 | 20 | PLA-1 | 20 | 28.3 | H-1 | 50 | L-1 | 10 | — | — | W-1 | 6 | 0.08 | 7.0 |
| Ex. 6 | RC-1 | 60 | L-1 | 30 | PLA-1 | 30 | 8.6 | H-1 | 40 | — | — | — | — | W-1 | 6 | 0.16 | 10.0 |
| Ex. 7 | RC-1 | 20 | L-1 | 10 | PLA-1 | 10 | 8.6 | H-1 | 60 | L-1 | 20 | — | — | W-1 | 6 | 0.10 | 9.5 |
| Ex. 8 | RC-1 | 10 | L-1 | 5 | PLA-1 | 5 | 8.6 | H-1 | 65 | L-1 | 25 | — | — | W-1 | 6 | 0.08 | 8.0 |
| Ex. 9 | RC-1 | 40 | L-1 | 20 | PLA-1 | 20 | 8.6 | H-1 | 50 | L-1 | 10 | — | — | W-1 | 1 | 0.18 | 12.0 |
| Ex. 10 | RC-1 | 40 | L-1 | 20 | PLA-1 | 20 | 8.6 | H-1 | 50 | L-1 | 10 | — | — | W-1 | 3 | 0.12 | 11.5 |
| Ex. 11 | RC-1 | 40 | L-1 | 20 | PLA-1 | 20 | 8.6 | H-1 | 50 | L-1 | 10 | — | — | W-1 | 9 | 0.08 | 6.5 |
| Ex. 12 | RC-1 | 40 | L-1 | 20 | PLA-1 | 20 | 8.6 | H-1 | 50 | L-1 | 10 | — | — | W-1 | 6 | 0.14 | 9.5 |
| Ex. 13 | RC-1 | 40 | L-1 | 20 | PLA-1 | 20 | 8.6 | H-1 | 50 | L-1 | 10 | — | — | W-3 | 6 | 0.12 | 9.5 |
| Ex. 14 | RC-1 | 40 | L-1 | 20 | PLA-1 | 20 | 8.6 | H-1 | 50 | L-1 | 10 | — | — | W-4 | 6 | 0.21 | 8.5 |
| Ex. 15 | RC-6 | 40 | L-2 | 20 | PLA-1 | 20 | 8.5 | H-2 | 50 | L-2 | 10 | — | — | W-1 | 6 | 0.09 | 10.0 |
| Ex. 16 | RC-1 | 40 | L-1 | 20 | PLA-1 | 20 | 8.6 | H-1 | 50 | L-1 | 10 | — | — | W-1 | 6 | 0.12 | 8.0 |
| Comp. Ex. 1 | RC-1 | 40 | L-1 | 20 | PLA-1 | 20 | 8.6 | H-1 | 50 | L-1 | 10 | — | — | W-5 | 6 | 0.46 | 10.0 |
| Comp. Ex.2 | RC-1 | 40 | L-1 | 20 | PLA-1 | 20 | 8.6 | H-1 | 50 | L-1 | 10 | — | — | W-6 | 6 | 0.42 | 10.5 |
| Comp. Ex. 3 | — | — | — | — | — | — | — | H-1 | 70 | L-1 | 30 | — | — | W-1 | 6 | 0.06 | 0.5 |
| Comp. Ex. 4 | — | — | — | — | — | — | — | H-1 | 50 | L-1 | 30 | PLA-1 | 20 | W-1 | 6 | Unable to form into toner | |
| Comp. Ex.5 | — | — | — | — | — | — | — | H-1 | 50 | L-1 | 30 | PLA-1 | 20 | W-1 | 6 | 0.53 | 0.1 |

[1)]Kinds and amount of a polyester subjected to a transesterification reaction.
[2)]Kinds and amount of a polylactic acid subjected to a transesterification reaction.
[3)]Kinds and amount of a polyester added other than a resin composition.
[4)]Kinds and amount of a polylactic acid added other than a resin composition.

It can be seen from the above results that the toners of Examples 1 to 16 have excellent developability under high-temperature, high-humidity environmental conditions (inhibition of background fog) and durability, as compared to the toners of Comparative Examples 1 to 5.

Example D

[Softening Point of Polyesters and Charge Control Resin]

The measurement is carried out by the same method as those in softening point of polyesters of Example A.

[Highest Temperature of Endothermic Peak and Melting Point of Polyesters]

The measurement is taken in accordance with the same method as in Example A.

[Glass Transition Temperature of Polyesters]

The measurement is taken in accordance with the same method as in Example A.

[Acid Value of Polyesters]

The measurement is taken in accordance with the same method as in Example A.

[Crystallinity of Polylactic Acids]

The measurement is taken in accordance with the same method as in Example A.

[Melting Point of Polylactic Acids]

The measurement is taken in accordance with the same method as in Example A.

[Average Molecular Weight of Polylactic Acids]

The measurement is taken in accordance with the same method as in Example A.

[Transesterification Ratio Based on Polylactic Acids]

The measurement is taken in accordance with the same method as in Example A.

[Melting Point of Releasing Agents]

The measurement is taken in accordance with the same method as in Example A.

[Volume-Average Particle Size of External Additives]

The measurement is taken in accordance with the same method as in Example A.

[Volume-Median Particle Size of Toners]

The measurement is taken in accordance with the same method as in Example A.

Production Example 1 of Polyester Resins [H-1 and L-1]

A 10-liter four-neck flask equipped with a nitrogen inlet tube, a dehydration tube, a stirrer, and a thermocouple was charged with raw material monomers other than trimellitic anhydride and an esterification catalyst as listed in Table D-1. The temperature was raised to 200° C. under a nitrogen atmosphere, and the contents were reacted at that temperature for 6 hours. Further, the temperature was raised to 210° C., trimellitic anhydride was then added to the reaction mixture, and the contents were reacted at an ambient pressure, 101.3 kPa, for 1 hour, and further reacted at 40 kPa until a desired softening point was reached to provide each of polyesters. The physical properties of the resulting polyesters are shown in Table D-1. Here, the reaction percentage refers to a value calculated by

[amount of water generated/theoretical amount of water generated]×100.

Production Example 2 of Polyester [H-2]

A 10-liter four-neck flask equipped with a nitrogen inlet tube, a dehydration tube, a stirrer, and a thermocouple was charged with raw material monomers other than trimellitic anhydride, an esterification catalyst and a polymerization inhibitor as listed in Table D-1. The temperature was raised to 200° C. under a nitrogen atmosphere, and the content were reacted at that temperature for 6 hours. Further, the temperature was raised to 210° C., trimellitic anhydride was then added to the reaction mixture, and the contents were reacted at an ambient pressure, 101.3 kPa, for 1 hour, and further reacted at 40 kPa until a desired softening point was reached to provide a polyester. The physical properties of the resulting polyester are shown in Table D-1.

Production Example 3 of Polyester Resin [L-2]

A 10-liter four-neck flask equipped with a nitrogen inlet tube, a dehydration tube, a stirrer, and a thermocouple was charged with raw material monomers, an esterification catalyst and a polymerization inhibitor as listed in Table D-1. The temperature was raised to 200° C. under a nitrogen atmosphere, and the contents were reacted at that temperature for 6 hours. Further, the temperature was raised to 210° C., and the contents were reacted at an ambient pressure, 101.3 kPa, for 1 hour, and further reacted at 40 kPa until a softening point was reached to 108° C., to provide a polyester. The physical properties of the resulting polyester are shown in Table D-1.

TABLE 14

Table D-1

| | | H-1 | H-2 | L-1 | L-2 |
|---|---|---|---|---|---|
| Raw Material Monomers | Alcohol Component | | | | |
| | 1,2-Propanediol | 2,815 g (100) | — | 2,815 g (100) | — |
| | BPA-PO[1)] | — | 4,410 g (70) | — | 4,410 g (70) |

TABLE 14-continued

Table D-1

| | | H-1 | H-2 | L-1 | L-2 |
|---|---|---|---|---|---|
| | BPA-EO[2)] | — | 1,755 g (30) | — | 1,755 g (30) |
| | Carboxylic Acid Component | | | | |
| | Terephthalic Acid | 4,487 g (73) | 1,854 g (62) | 4,610 g (75) | 1,196 g (40) |
| | Fumaric Acid | — | 209 g (10) | — | 940 g (45) |
| | Trimellitic Anhydride | 498 g (7) | 346 g (10) | 213 g (3) | — |
| Esterification Catalyst | Dibutyltin Oxide | 16 g | 17 g | 15 g | 17 g |
| Polymerization Inhibitor | tert-Butyl Catechol | — | 4.3 g | — | 4.2 g |
| Physical Properties of Resin | Softening Point (° C.) | 135 | 134 | 110 | 109 |
| | Highest Temp. of Endothermic Peak (° C.) | 71 | 69 | 67 | 69 |
| | Softening Point/Highest Temp. of Endothermic Peak | 1.9 | 2.0 | 1.6 | 1.6 |
| | Glass Transition Temp. (° C.) | 68 | 66 | 64 | 67 |
| | Acid Value (mgKOH/g) | 6.5 | 6.6 | 5.1 | 5.3 |

Note)
Numerical values inside the parentheses express molar ratios when the total number of moles of the alcohol component is 100.
[1)]BPA-PO: Polyoxypropylene(2.2)-2,2-bis(4-hydroxyphenyl)propane
[2)]BPA-EO: Polyoxyethylene(2.2)-2,2-bis(4-hydroxyphenyl)propane Production Example of Resin Compositions A 10-liter four-neck flask equipped with a nitrogen inlet tube, a dehydration tube, a stirrer, and a thermocouple was charged with a polyester in a given amount as listed in Table D-2. The contents were heated to a temperature as listed in Table D-2 in the nitrogen atmosphere to melt the polyester. Thereafter, a polylactic acid in a given amount as listed in Table D-2 was added to the melted mixture and the mixture was stirred for a given time as listed in Table D-2. The resulting resin compositions were cooled to 40° C. or lower, a cooled product was subjected to rough pulverization with Rotoplex, manufactured by Hosokawa Micron Corporation using a sieve having a sieve opening of 2 mm, to provide each of resin compositions (RC-1 to RC-6) containing polyester-polylactic acid copolymer having a particle size of 2 mm or less.

TABLE 15

Table D-2

| | | | RC-1 | RC-2 | RC-3 | RC-4 | RC-5 | RC-6 |
|---|---|---|---|---|---|---|---|---|
| Resin | Polyester | L-1 | 50 | 50 | 50 | 50 | 50 | — |
| | | L-2 | — | — | — | — | — | 50 |
| | Polylactic Acid | PLA-1 | 50 | 50 | 50 | 50 | 50 | 50 |
| Transesterification Reaction | Temp. (° C.) | | 170 | 170 | 170 | 170 | 170 | 170 |
| | Time (Hours) | | 5 | 1 | 3 | 10 | 12 | 5 |
| | Transesterification Ratio (%) | | 9.1 | 2.1 | 4.6 | 17.6 | 26.4 | 8.9 |

Note)
PLA-1: N-3000 (manufactured by Nature Works), Mn 188,000, Mw 472,000, melting point 170° C., crystallinity 92%

Production Example of Toners

Examples 1 to 14, and Comparative Examples 1 to 3

A resin composition, an polyester, a charge control resin and a charge control agent in a given amount as listed in Table D-3, 3.0 parts by mass of a releasing agent "WEP-9," manufactured by NOF CORPORATION, a synthetic ester wax, melting point of 72° C., and 3.0 parts by mass of a colorant "ECB-301," manufactured by DAINICHISEIKA COLOR & CHEMICALS MFG. CO., LTD., Phthalocyanine Blue, P.B. 15:3, were mixed with a Henschel mixer, manufactured by NIPPON COKE & ENGINEERING CO., LTD., for 1 minute, and the mixture was melt-kneaded under the conditions shown below.

A continuous twin open-roller type kneader "Kneadex," manufactured by NIPPON COKE & ENGINEERING CO., LTD., having an outer diameter of roller of 14 cm and an effective length of roller of 80 cm, was used. The operating conditions of the continuous twin open-roller type kneader were a peripheral speed of a high-rotation roller, a front roller, of 32.4 m/min, a peripheral speed of a low-rotation roller, a back roller, of 21.7 m/min, and a gap between the rollers of 0.1 mm. The temperatures of the heating medium and the cooling medium inside the rollers are as follows. The high-rotation roller had a temperature at the raw material supplying side of 145° C., and a temperature at the kneaded product discharging side of 100° C., and the low-rotation roller had a temperature at the raw material supplying side of 75° C., and a temperature at the kneaded product discharging side of 35° C. In addition, the feeding rate of the raw material mixture was 10 kg/hr, and the average residence time was about 3 minutes.

The melt-kneaded mixture was cooled, and a cooled mixture was then roughly pulverized with a pulverizer "Rotoplex," manufactured by Hosokawa Micron Corporation using a sieve having a sieve opening of 2 mm, to provide a roughly pulverized product having a particle size of 2 mm or less. The resulting roughly pulverized product was subjected to fine pulverization with an air jet-type classifier Model DS2, impact jet type, manufactured by Nippon Pneumatic Mfg. Co., Ltd., while adjusting a pulverization pressure so as to have a volume-median particle size of 8.0 μm. The resulting finely pulverized product was subjected to classification with an air jet-type classifier Model DSX2, manufactured by Nippon Pneumatic Mfg. Co., Ltd., while adjusting a static pressure (internal pressure) so as to have a volume-median particle size of 8.5 μm, to provide toner matrix particles.

One hundred parts by mass of the toner matrix particles obtained were mixed with 1.0 part by mass of a hydrophobic silica "R972," manufactured by Nippon Aerosil Co Ltd., volume-average particle size: 16 nm, and 1.0 part by mass of a hydrophobic silica "NAX50," manufactured by Nippon Aerosil Co., Ltd., volume-average particle size: 30 nm, with a Henschel mixer manufactured by NIPPON COKE & ENGINEERING CO., LTD. at 2,100 r/min, i.e. a peripheral speed of 29 m/sec, for 3 minutes, to provide a toner.

Example 15

Toner raw materials were mixed in Example 1, with a Henschel mixer, and melt-kneaded under the conditions given below.

A co-rotating twin-screw extruder PCM-30, manufactured by IKEGAI Corporation, having a screw diameter of 2.9 cm and a cross-sectional area of the screw of 7.06 $cm^2$, was used. The operating conditions were as follows: The barrel setting temperature was 100° C., a rotational speed of the screw was 200 r/min, i.e. a peripheral speed of the screw rotations was 0.30 m/sec, and a mixture supplying rate was 10 kg/hr, i.e. a feeding rate of the mixture per unit cross-sectional area of the screw was 1.42 $kg/hr \cdot cm^2$.

The resulting resin mixture was subjected to rough pulverization and fine pulverization in the same manner as in Example 1, and pulverized product was subjected to classification treatment, to provide toner matrix particles.

The resulting toner matrix particles were mixed with external additives in the same manner as in Example 1, to provide a toner.

Comparative Example 4

A polyester, a polylactic acid and a charge control resin in a given amount as listed in Table D-3, 3.0 parts by mass of a releasing agent "WEP-9," manufactured by NOF CORPORATION, a synthetic ester wax, and 4.0 parts by mass of a colorant "ECB-301," manufactured by DAINICHISEIKA COLOR & CHEMICALS MFG. CO., LTD., Phthalocyanine Blue, P.B. 15:3, were mixed with a Henschel mixer for 1 minute and the mixture was melt-kneaded and subjected to pulverization and classification in the same manner as in Example 1 However, in the resulting particles, the polyester and the polylactic acid were separated without being compatible to each other, so that the particles could not be used as a toner.

Comparative Example 5

A polyester and a polylactic acid in given amounts as listed in Table D-3 were mixed with Henschel mixer, and thereafter melt-kneaded under the condition shown below.

A co-rotating twin-screw extruder "PCM-30," manufactured by IKEGAI Corporation, having a screw diameter of 2.9 cm and a cross-sectional area of the screw of 7.06 $cm^2$, was used. The operating conditions were as follows: The barrel setting temperature was 160° C., a rotational speed of the screw was 200 r/min, i.e. a peripheral speed of the screw rotations was 0.30 m/sec, and a mixture supplying rate was 10 kg/hr, i.e. a feeding rate of the mixture per unit cross-sectional area of the screw was 1.42 $kg/hr \cdot cm^2$. The resulting kneaded mixture was cooled to 40° C. or lower, and then roughly pulverized with Rotoplex, manufactured by Hosokawa Micron Corporation using a sieve having a sieve opening of 2 mm, to provide a kneaded composition having a particle size of 2 mm or less.

One hundred parts by mass of the resulting kneaded composition, 3 parts by mass of a charge control resin CCR-1, 3.0 parts by mass of a releasing agent "WEP-9," manufactured by NOF CORPORATION, a synthetic ester wax, and 4.0 parts by mass of a colorant "ECB-301," manufactured by DAINICHISEIKA COLOR & CHEMICALS MFG. CO., LTD., Phthalocyanine Blue, P.B. 15:3, were mixed with a Henschel mixer for 1 minute, and the mixture was melt-kneaded in the same manner as in Example 1.

The resulting melt-kneaded mixture was subjected to rough pulverization and fine pulverization in the same manner as in Example 1, and pulverized product was subjected to classification treatment, to provide toner matrix particles.

The resulting toner matrix particles were mixed with external additives in the same manner as in Example 1, to provide a toner.

TABLE 16

Table D-3

| | Resin Composition | | | | | | | | | | | | | Charge Control Resin | | Charge Control Agent | |
|---|---|---|---|---|---|---|---|---|---|---|---|---|---|---|---|---|---|
| | | | Details | | | | | | | | | Polylactic Acid[4)] | | | | | |
| | | | Polyester[1)] | | Polylactic Acid[2)] | | | Polyester[3)] | | | | | | | | | |
| | Kinds | Parts by Mass | Kinds | Parts by Mass | Kinds | Parts by Mass | Transesterification Ratio (%) | Kinds | Parts by Mass | Kinds | Parts by Mass | Kinds | Parts by Mass | Kinds[5)] | Parts by Mass | Kinds[5)] | Parts by Mass |
| Ex. 1 | RC-1 | 40 | L-1 | 20 | PLA-1 | 20 | 9.1 | H-1 | 50 | L-1 | 10 | — | — | CCR-1 | 3 | — | — |
| Ex. 2 | RC-2 | 40 | L-1 | 20 | PLA-1 | 20 | 2.1 | H-1 | 50 | L-1 | 10 | — | — | CCR-1 | 3 | — | — |
| Ex. 3 | RC-3 | 40 | L-1 | 20 | PLA-1 | 20 | 4.6 | H-1 | 50 | L-1 | 10 | — | — | CCR-1 | 3 | — | — |
| Ex. 4 | RC-4 | 40 | L-1 | 20 | PLA-1 | 20 | 17.6 | H-1 | 50 | L-1 | 10 | — | — | CCR-1 | 3 | — | — |
| Ex. 5 | RC-5 | 40 | L-1 | 20 | PLA-1 | 20 | 26.4 | H-1 | 50 | L-1 | 10 | — | — | CCR-1 | 3 | — | — |
| Ex. 6 | RC-1 | 60 | L-1 | 30 | PLA-1 | 30 | 9.1 | H-1 | 40 | — | — | — | — | CCR-1 | 3 | — | — |
| Ex. 7 | RC-1 | 20 | L-1 | 10 | PLA-1 | 10 | 9.1 | H-1 | 60 | L-1 | 20 | — | — | CCR-1 | 3 | — | — |
| Ex. 8 | RC-1 | 10 | L-1 | 5 | PLA-1 | 5 | 9.1 | H-1 | 65 | L-1 | 25 | — | — | CCR-1 | 3 | — | — |
| Ex. 9 | RC-1 | 40 | L-1 | 20 | PLA-1 | 20 | 9.1 | H-1 | 50 | L-1 | 10 | — | — | CCR-1 | 1 | — | — |
| Ex. 10 | RC-1 | 40 | L-1 | 20 | PLA-1 | 20 | 9.1 | H-1 | 50 | L-1 | 10 | — | — | CCR-1 | 6 | — | — |
| Ex. 11 | RC-1 | 40 | L-1 | 20 | PLA-1 | 20 | 9.1 | H-1 | 50 | L-1 | 10 | — | — | CCR-1 | 9 | — | — |
| Ex. 12 | RC-1 | 40 | L-1 | 20 | PLA-1 | 20 | 9.1 | H-1 | 50 | L-1 | 10 | — | — | CCR-2 | 3 | — | — |
| Ex. 13 | RC-1 | 40 | L-1 | 20 | PLA-1 | 70 | 9.1 | H-1 | 50 | L-1 | 10 | — | — | CCR-1 | 1.5 | CCA-1 | 1.5 |
| Ex. 14 | RC-6 | 40 | L-2 | 20 | PLA-1 | 20 | 8.9 | H-2 | 50 | L-2 | 10 | — | — | CCR-1 | 3 | — | — |
| Ex. 15 | RC-1 | 40 | L-1 | 20 | PLA-1 | 20 | 9.1 | H-1 | 50 | L-1 | 10 | — | — | CCR-1 | 3 | — | — |
| Comp. Ex. 1 | RC-1 | 40 | L-1 | 20 | PLA-1 | 20 | 9.1 | H-1 | 50 | L-1 | 10 | — | — | — | — | — | — |
| Comp. Ex. 2 | — | — | — | — | — | — | — | H-1 | 70 | L-1 | 30 | — | — | CCR-1 | 3 | — | — |
| Comp. Ex. 3 | — | — | — | — | — | — | — | H-1 | 70 | L-1 | 30 | — | — | CCR-2 | — | — | |
| Comp. Ex, 4 | — | — | — | — | — | — | — | H-1 | 50 | L-1 | 30 | PLA-1 | 20 | CCR-1 | 3 | — | — |
| Comp. Ex. 5 | — | — | — | — | — | — | — | H-1 | 50 | L-1 | 30 | PLA-1 | 20 | CCR-1 | 3 | — | — |

[1)]Kinds and amount of a polyester subjected to a transesterification reaction.

[2)]Kinds and amount of a polylactic acid subjected to a transesterification reaction.

[3)]Kinds and amount of a polyester added other than a resin composition.

[4)]Kinds and amount of a polylactic acid added other than a resin composition.

[5)]CCR-1: Quaternary ammonium salt group-containing styrene-acrylic copolymer, manufactured by FUJIKURA KASEI CO., LTD., FCA-201-PS, Softening Point 111° C. CCR-2: Quaternary ammonium salt group-containing styrene-acrylic copolymer, manufactured by FUJIKURA KASEI CO., LTD., FCA-701-PT, Softening Point 123° C. CCA-1: Quaternary ammonium salt compound, manufactured by Orient Chemical Co., Ltd., BONTRON P-51

Test Example 1: Low-Temperature Fusing Ability

The evaluation was taken in accordance with the same method as in Test Example of Example A.

In other words, each of the toners was loaded to a printer "OKI MICROLINE 5400," manufactured by Oki Data Corporation, modified so as to obtain an unfused image, and an unfused image which was a solid image of a square having a side of 2 cm was printed. Thereafter, this unfused image was subjected to a fusing treatment with an external fusing device, a modified device of "OKI MICROLINE 3010," manufactured by Oki Data Corporation, at a rotational speed of the fusing roller of 120 mm/sec at each temperature, while raising the fusing roller temperatures from 100° to 230° C. in an increment of 5° C., to provide each of fused images. A sand-rubber eraser "ER-502R," manufactured by LION Office Products Corp., to which a load of 500 g was applied was moved backward and forward five times over a fused image obtained at each fusing temperature, and optical densities of the fused image before and after rubbing were measured with an optical densitometer "GRETAG SPM-50," manufactured by Gretag. The temperature of the fusing roller at which a ratio of optical densities before and after rubbing, i.e. optical densities after rubbing/before rubbing×100, initially exceeds 90% is used as an index of a lowest fusing temperature, which was used as an index for low-temperature fusing ability. The lower the value, the more excellent the low-temperature fusing ability. The results are shown in Table D-4.

Test Example 2: Background Fog

Each of the toners was loaded to a printer "HL-2040" equipped with a cleaner-less development system, manufactured by Brother Industries, Ltd., and images having a print coverage of 1% were printed for 2,000 sheets under the conditions of intermittently 20 seconds per page. A blank solid image was printed out every 500 sheets, and a power source was turned off in during the course of printing. The toners on the photoconductor surface were adhered to a "Scotch® mending tape 810" manufactured by SUMITOMO 3M LIMITED, width of 18 mm, and coloration density was measured with an image densitometer "GRETAG SPM-50," manufactured by Gretag. A difference with a coloration density of the tape itself before adhesion of the toner was obtained, and an average of four found values from 500th sheets to 2,000th sheets was obtained. The smaller the value, the more inhibited the background fog. The results are shown in Table D-4.

Test Example 3: Durability

Each of the toners was loaded to a toner cartridge, manufactured by Oki Data Corporation for HL-2040, manufactured by Brother Industries, Ltd., modified such that the developer roller can be visually found, an idle run was operated under the conditions of temperature of 30° C. and humidity of 50%, at 70 r/min (corresponding to 36 ppm), and filming on the developer roller was visually observed. The time until generation of filming took place was used as an index of durability. It is shown that the longer the time until generation of filming of a developer roller took place, the more excellent the durability. The results are shown in Table D-4.

TABLE 17

Table D-4

| | Low-Temp. Fusing Ability (° C.) | Background Fog | Durability (Hours) |
|---|---|---|---|
| Ex. 1 | 140 | 0.04 | 12.0 |
| Ex. 2 | 145 | 0.12 | 12.0 |
| Ex. 3 | 145 | 0.06 | 12.0 |
| Ex. 4 | 140 | 0.04 | 11.0 |
| Ex. 5 | 135 | 0.02 | 8.0 |
| Ex. 6 | 145 | 0.10 | 13.0 |
| Ex. 7 | 140 | 0.05 | 10.5 |
| Ex. 8 | 140 | 0.12 | 8.5 |
| Ex. 9 | 140 | 0.19 | 12.0 |
| Ex. 10 | 145 | 0.04 | 9.5 |
| Ex. 11 | 145 | 0.02 | 8.5 |
| Ex. 12 | 140 | 0.05 | 12.5 |
| Ex. 13 | 140 | 0.06 | 12.5 |
| Ex. 14 | 140 | 0.09 | 12.0 |
| Ex. 15 | 145 | 0.19 | 9.5 |
| Comp. Ex. 1 | 140 | 0.43 | 11.0 |
| Comp. Ex. 2 | 155 | 0.28 | 1.0 |
| Comp. Ex. 3 | 150 | 0.34 | 1.0 |
| Comp. Ex. 4 | Unable to form into toner | | |
| Comp. Ex. 5 | 170 | 0.49 | 1.0 |

It can be seen from the results of Table D-4 that the toners of Examples 1 to 15 have excellent low-temperature fusing ability and durability and inhibit the generation of background fog, as compared to the toilers of Comparative Examples 1 to 5.

Example E

[Softening Point of Polyesters]

The measurement is taken in accordance with the same method as in Example A.

[Highest Temperature of Endothermic Peak and Melting Point of Polyesters]

The measurement is taken in accordance with the same method as in Example A.

[Glass Transition Temperature of Polyesters]

The measurement is taken in accordance with the same method as in Example A.

[Acid Value of Polyesters]

The measurement is taken in accordance with the same method as in Example A.

[Crystallinity of Polylactic Acids]

The measurement is taken in accordance with the same method as in Example A.

[Melting Point of Polylactic Acids]

The measurement is taken in accordance with the same method as in Example A.

[Average Molecular Weight of Polylactic Acids]

The measurement is taken in accordance with the same method as in Example A.

[Transesterification Ratio Based on Polylactic Acids]

The measurement is taken in accordance with the same method as in Example A.

[Melting Point of Releasing Agents]

The measurement is taken in accordance with the same method as in Example A.

[Volume-Average Particle Size of Fine Inorganic Particles and External Additives]

The measurement is taken in accordance with the same method as in a volume-average particle size of external additives of Example A.

[Volume-Median Particle Size of Toners]

The measurement is taken in accordance with the same method as in Example A.

Production Example 1 of Polyester Resins [H-1, H-2 and L-1]

A 10-liter four-neck flask equipped with a nitrogen inlet tube, a dehydration tube, a stirrer, and a thermocouple was charged with raw material monomers other than trimellitic anhydride and an esterification catalyst, as listed in Table E-1. The temperature was raised to 200° C. in a nitrogen atmosphere, and the contents were reacted at that temperature for 6 hours. Further, the temperature was raised to 210° C., trimellitic anhydride was then added to the reaction mixture, and the contents were reacted at an ambient pressure, 101.3 kPa, for 1 hour, and further reacted at 40 kPa until a desired softening point was reached to provide each of polyesters. The physical properties of the polyesters obtained are shown in Table E-1. Here, the reaction percentage refers to a value calculated by

[amount of water generated/theoretical amount of water generated]×100.

Production Example 2 of Polyester Resin [L-2]

A 10-liter four-neck flask equipped with a nitrogen inlet tube, a dehydration tube, a stirrer, and a thermocouple was charged with raw material monomers and an esterification catalyst as listed in Table E-1. The temperature was raised to 200° C. in a nitrogen atmosphere, and the contents were reacted at that temperature for 6 hours. Further, the temperature was raised to 210° C., and the contents were reacted at an ambient pressure, 101.3 kPa, for 1 hour, and further reacted at 40 kPa until a softening point reached to 108° C., to provide a polyester L-2. The physical properties of the polyester obtained are shown in Table E-1.

TABLE 18

Table E-1

| | | H-1 | H-2 | L-1 | L-2 |
|---|---|---|---|---|---|
| Raw Material Monomers | Alcohol Component | | | | |
| | 1,2-Propanediol | 2,815 g (100) | — | 2,815 g (100) | — |
| | BPA-PO[1)] | — | 4,410 g (70) | — | 6,300 g (100) |
| | BPA-EO[2)] | — | 1,755 g (30) | — | — |

TABLE 18-continued

Table E-1

| | | H-1 | H-2 | L-1 | L-2 |
|---|---|---|---|---|---|
| | Carboxylic Acid Component | | | | |
| | Terephthalic Acid | 4.918 g (80) | 2,093 g (70) | 5,225 g (85) | 2,542 g (85) |
| | Trimellitic Anhydride | 711 g (10) | 519 g (15) | 355 g (5) | — |
| Esterification Catalyst | Dibutyltin Oxide | 17 g | 18 g | 17 g | 18 g |
| Physical Properties of Resin | Softening Point (° C.) | 134 | 133 | 112 | 108 |
| | Highest Temp. of Endothermic Peak (° C.) | 70 | 73 | 69 | 69 |
| | Softening Point/ Highest Temp. of Endothermic Peak | 1.9 | 1.8 | 1.6 | 1.6 |
| | Glass Transition Temp. (° C.) | 68 | 70 | 66 | 66 |
| | Acid Value (mgKOH/g) | 18.3 | 18.6 | 17.6 | 10.6 |

Note)
Numerical values inside the parentheses express molar ratios when the total number of moles of the alcohol component is 100.
[1)]BPA-PO: Polyoxypropylene(2.2)-2,2-bis(4-hydroxyphenyl)propane
[2)]BPA-EO: Polyoxyethylene(2.2)-2,2-bis(4-hydroxyphenyl)propane

Production Example of Toner

Examples 1 to 16, and Comparative Examples 1 and 2

(Step 1)

A 10-liter four-neck flask equipped with a nitrogen inlet tube, a dehydration tube, a stirrer, and a thermocouple was charged with a polyester in a given amount as listed in Table E-2. The temperature was raised to a temperature listed in Table E-2 under a nitrogen atmosphere, to melt the polyester. Thereafter, a polylactic acid in a given amount as listed in Table E-2 was added thereto, and the mixture was stirred for a given time as listed in Table E-2. The resulting resin composition was cooled to 40° C. or lower, and the resin composition was then roughly pulverized with Rotoplex, manufactured by Hosokawa Micron Corporation using a sieve having a sieve opening of 2 mm, to provide a resin composition containing a polyester-polylactic acid copolymer having a particle size of 2 mm or less. Here, the resin composition prepared in each of Examples and Comparative Examples is any one of RC-1 to RC-6 usable in Step 2,

TABLE 19

Table E-2

| | | | RC-1 | RC-2 | RC-3 | RC-4 | RC-5 | RC-6 |
|---|---|---|---|---|---|---|---|---|
| Resin | Polyester | L-1 | 50 | 50 | 50 | 50 | 50 | — |
| | | L-2 | — | — | — | — | — | 50 |
| | Polylactic Acid | PLA-1 | 50 | 50 | 50 | 50 | 50 | 50 |
| Transesterification Reaction | Temp. (° C.) | | 170 | 170 | 170 | 170 | 170 | 170 |
| | Time (Hours) | | 5 | 1 | 3 | 10 | 12 | 5 |
| | Transesterification Ratio (%) | | 8.6 | 1.6 | 4.1 | 18.4 | 28.3 | 8.5 |

Note)
PLA-1: N-3000 (manufactured by Nature Works), Mn 188,000, Mw 472,000, melting point 170° C., crystallinity 92%

(Step 2)

A resin composition obtained in Step 1 and a polyester in a given amount as listed in Table E-4, 3.0 parts by mass of a releasing agent "WEP-9," manufactured by NOF CORPORATION, a synthetic ester wax, melting point of 72° C., 3.0 parts by mass of a colorant "ECB-301," manufactured by DAINICHISEIKA COLOR & CHEMICALS MFG. CO., LTD., Phthalocyanine Blue, P.B. 15:3, and 1.0 part by mass of a negatively chargeable charge control agent "BONTRON E-84," manufactured by Orient Chemical Industries Co., Ltd., were mixed with a Henschel mixer, manufactured by NIPPON COKE & ENGINEERING CO., LTD., for 1 minute, and the mixture was melt-kneaded under the conditions given below.

A continuous twin open-roller type kneader "Kneadex," manufactured by NIPPON COKE & ENGINEERING CO., LTD., having an outer diameter of roller of 14 cm and an effective length of roller of 80 cm, was used. The operating conditions of the continuous twin open-roller type kneader were a peripheral speed of a high-rotation roller, a front roller, of 32.4 m/min, a peripheral speed of a low-rotation roller, a back roller, of 21.7 m/min, and a gap between the rollers of 0.1 mm. The temperatures of the heating medium and the cooling medium inside the rollers are as follows. The high-rotation roller had a temperature at the raw material supplying side of 145° C., and a temperature at the kneaded product discharging side of 100° C., and the low-rotation roller had a temperature at the raw material supplying side of 75° C., and a temperature at the kneaded product discharging side of 35° C. In addition, the feeding rate of the raw material mixture was 10 kg/h, and the average residence time was about 3 minutes.

(Step 3)

The melt-kneaded mixture was cooled, and a melt-kneaded mixture was then roughly pulverized with a pulverizer "Rotoplex," manufactured by Hosokawa Micron Corporation using a sieve having a sieve opening of to provide a roughly pulverized product having a particle size of 3 mm or less. Next, based on 100 parts by mass of the resulting roughly pulverized product, the fine inorganic particles as listed in Table 4 were mixed with a 10 L Henschel mixer equipped with two blades at a rotational speed of 3,000 r/min for 1 minute. The mixture obtained was subjected to fine pulverization with a fluidised bed opposed jet mill "AFG-200" manufactured by HOSOKAWA ALPINE AG, while adjusting the pulverization pressure so as to have a volume-median particle size $D_{50}$ after fine pulverization of 6.5 μm. Further, the pulverized product was classified with a rotor-type classifier "TTSP-100" manufactured by HOSOKAWA ALPINE AG, to provide toner matrix particles having a volume-median particle size of 7.0 μm. The pulverization pressure during fine pulverization is shown Table 4.

One hundred parts by mass of the toner matrix particles obtained were mixed fine inorganic particles as listed in Table E-4, with a Henschel mixer, manufactured by NIPPON COKE & ENGINEERING CO., LTD. at a rotational speed of 2,100 r/min, i.e. a peripheral speed of 29 m/sec, for 3 minutes, to provide the toners. However, in Comparative Example 1, based on 100 parts by mass of toner matrix particles, 2.0 parts by mass of Si-A was firstly mixed with a Henschel mixer, manufactured by NIPPON COKE & ENGINEERING CO., LTD. at a rotational speed of 2,100 r/min, i.e. a peripheral speed of 29 m/sec, for 1 minute, and then 1.0 part by mass of Si-A was added thereto, and the mixture was mixed with a Henschel mixer, manufactured by NIPPON COKE & ENGINEERING CO., LTD. at a rotational speed of 2,100 r/min, i.e. a peripheral speed of 29 m/sec, for 2 minutes, to provide each of toners.

Comparative Example 3

The same procedures as in Example 1 were carried out except that the polylactic acids was not used and the step 1 was not carried out, to provide toner matrix particles.

The resulting toner matrix particles were mixed with external additives in the same manner as in Example 1 to provide a toner.

Comparative Example 4

A polyester and a polylactic acid in given amounts, as listed in Table E-4, 3.0 parts by mass of a releasing agent "WEP-9," manufactured by NOF CORPORATION, a synthetic ester wax, 3.0 parts by mass of a colorant "ECB-301," manufactured by DAINICHISEIKA COLOR & CHEMICALS MEG. CO., LTD., Phthalocyanine Blue, P.B. 15:3, and 1.0 part by mass of a negatively chargeable charge control agent "BONTRON E-84," manufactured by Orient Chemical Industries Co., Ltd., were mixed with a Henschel mixer for 1 minute, and thereafter the mixture was melt-kneaded in the same manner as in Example 1. However, the polyester and the polylactic acid were separated without being compatible to each other, so that the procedure did not proceed to step 3.

Comparative Example 5

A polyester and a polylactic acid in a given amounts, as listed in Table E-4 were mixed with a Henschel mixer, and thereafter melt-kneaded under the conditions shown below.

A co-rotating twin-screw extruder "PCM-30," manufactured by IKEGAI Corporation, having a screw diameter of 2.9 cm and a cross-sectional area of the screw of 7.06 $cm^2$, was used. The operating conditions were as follows: The barrel setting temperature was 160° C., a rotational speed of the screw was 200 r/min, i.e. a peripheral speed of the screw rotations was 0.30 m/sec, and a mixture supplying rate was 10 kg/hr, i.e. a feeding rate of the mixture per unit cross-sectional area of the screw was 1.42 $kg/hr \cdot cm^2$. The resulting kneaded product was cooled to 40° C. or lower, and then roughly pulverized with Rotoplex, manufactured by Hosokawa Micron Corporation using a sieve having a sieve opening of 2 mm, to provide a kneaded composition having a particle size of 2 mm or less.

One hundred parts by mass of the resulting kneaded composition, 3.0 parts by mass of a releasing agent, "WEP-9," manufactured by NOF CORPORATION, a synthetic ester wax, and 3.0 parts by mass of a colorant "ECB-301," manufactured by DAINICHISEIKA COLOR & CHEMICALS MFG. CO., LTD Phthalocyanine Blue, P.B. 15:3, and 1.0 part by mass of a negatively chargeable charge control agent "BONTRON E-84," manufactured by Orient Chemical Industries Co., Ltd., were mixed with a Henschel mixer for 1 minute, and the mixture was melt-kneaded in the same manner as in step 2 of Example 1.

The resulting melt-kneaded mixture was cooled, and a melt-kneaded mixture was then roughly pulverized with a pulverizer "Rotoplex," manufactured by Hosokawa Micron Corporation using a sieve having a sieve opening of 3 min, to provide a roughly pulverized product having a particle size of 3 mm or less. Next, based on 100 parts by mass of the resulting roughly pulverized product, the hydrophobically treated silica as listed in Table E-4 was mixed in a 10 L Henschel mixer equipped with two blades at a rotational speed of 3,000 r/min for 1 minute. The resulting mixture was subjected to fine pulverization with a fluidised bed opposed jet mill "AFG-200" manufactured by HOSOKAWA ALPINE AG, while adjusting the pulverization pressure so as to have a volume-median particle size $D_{50}$ after fine pulverization of 6.5 μm. Further, the pulverized product was classified with a rotor-type classifier "TTSP-100" manufactured by HOSOKAWA ALPINE AG, to provide toner matrix particles having a volume-median particle size of 7.0 μm. The pulverization pressure during fine pulverization is shown Table E-4.

The resulting toner matrix particles were mixed with external additives in the same manner as in Example 1, to provide a toner.

Comparative Example 6

The same procedure was carried out as in Comparative Example 3 except that the pulverization pressure was adjusted to 0.51 MPa to carry out a fine pulverization, to provide toner matrix particles.

The resulting toner matrix particles were mixed with external additives in the same manner as in Example 1, to provide a toner.

The fine inorganic particles used in Examples and Comparative Examples are shown in Table E-3.

TABLE 20

Table E-3

| Kinds | Chemical Name | Manufacturer and Trade Name | Hydrophobically Treating Agent | Volume-Average Particle Size |
|---|---|---|---|---|
| Si-A | Silica | R972, manufactured by Nippon Aerosil Co., Ltd. | DDS: Dimethyl-dichlorosilane | 16 nm |
| Si-B | Silica | R976, manufactured by Nippon Aerosil Co., Ltd. | DDS: Dimethyl-dichlorosilane | 7 nm |
| Si-C | Silica | RX50, manufactured by Nippon Aerosil Co., Ltd. | HMDS: Hexamethyl-disilazane | 40 nm |
| Si-D | Silica | RY50, manufactured by Nippon Aerosil Co., Ltd. | PDMS: Dimethyl-polysiloxane | 40 nm |

TABLE 21

Table E-4

| | Step 2 | | | | | | | | | | |
|---|---|---|---|---|---|---|---|---|---|---|---|
| | Resin Composition | | | | | | | | | | |
| | | | Details | | | | | | | | |
| | | | Polyester[1)] | | Polylactic Acid[2)] | | | Polyester[3)] | | | |
| | Kinds | Parts by Mass | Kinds | Parts by Mass | Kinds | Parts by Mass | Transesterification Ratio (%) | Kinds | Parts by Mass | Kinds | Parts by Mass |
| Ex. 1 | RC-1 | 40 | L-1 | 20 | PLA-1 | 20 | 8.6 | H-1 | 50 | L-1 | 10 |
| Ex. 2 | RC-2 | 40 | L-1 | 20 | PLA-1 | 20 | 1.6 | H-1 | 50 | L-1 | 10 |
| Ex. 3 | RC-3 | 40 | L-1 | 20 | PLA-1 | 20 | 4.1 | H-1 | 50 | L-1 | 10 |
| Ex. 4 | RC-4 | 40 | L-1 | 20 | PLA-1 | 20 | 18.4 | H-1 | 50 | L-1 | 10 |
| Ex. 5 | RC-5 | 40 | L-1 | 20 | PLA-1 | 20 | 28.3 | H-1 | 50 | L-1 | 10 |
| Ex. 6 | RC-1 | 60 | L-1 | 30 | PLA-1 | 30 | 8.6 | H-1 | 40 | — | — |
| Ex. 7 | RC-1 | 20 | L-1 | 10 | PLA-1 | 10 | 8.6 | H-1 | 60 | L-1 | 20 |
| Ex. 8 | RC-1 | 10 | L-1 | 5 | PLA-1 | 5 | 8.6 | H-1 | 65 | L-1 | 25 |
| Ex. 9 | RC-1 | 40 | L-1 | 20 | PLA-1 | 20 | 8.6 | H-1 | 50 | L-1 | 10 |
| Ex. 10 | RC-1 | 40 | L-1 | 20 | PLA-1 | 20 | 8.6 | H-1 | 50 | L-1 | 10 |
| Ex. 11 | RC-1 | 40 | L-1 | 20 | PLA-1 | 20 | 8.6 | H-1 | 50 | L-1 | 10 |
| Ex. 12 | RC-1 | 40 | L-1 | 20 | PLA-1 | 20 | 8.6 | H-1 | 50 | L-1 | 10 |
| Ex. 13 | RC-1 | 40 | L-1 | 20 | PLA-1 | 20 | 8.6 | H-1 | 50 | L-1 | 10 |
| Ex. 14 | RC-1 | 40 | L-1 | 20 | PLA-1 | 20 | 8.6 | H-1 | 50 | L-1 | 10 |
| Ex. 15 | RC-6 | 40 | L-2 | 20 | PLA-1 | 20 | 8.5 | H-2 | 50 | L-2 | 10 |
| Ex. 16 | RC-1 | 40 | L-1 | 20 | PLA-1 | 20 | 8.6 | H-1 | 50 | L-1 | 10 |
| Comp. Ex. 1 | RC-1 | 40 | L-1 | 20 | PLA-1 | 20 | 8.6 | H-1 | 50 | L-1 | 10 |
| Comp. Ex. 2 | RC-1 | 40 | L-1 | 20 | PLA-1 | 20 | 8.6 | H-1 | 50 | L-1 | 10 |
| Comp. Ex. 3 | — | — | — | — | — | — | — | H-1 | 70 | L-1 | 30 |
| Comp. Ex. 4 | — | — | — | — | — | — | — | H-1 | 50 | L-1 | 30 |
| Comp. Ex. 5 | — | — | — | — | — | — | — | H-1 | 50 | L-1 | 30 |
| Comp. Ex. 6 | — | — | — | — | — | — | — | H-1 | 70 | L-1 | 30 |

| | Step 3 | | | | | | | | |
|---|---|---|---|---|---|---|---|---|---|
| | Step 2 | | Fine | | | Externally Adding | | | |
| | Polylactic Acid[4)] | | Inorganic Particle | | | Treatment External Additive | | | |
| | Kinds | Parts by Mass | Kinds | Parts by Mass[5)] | Pulverization Pressure | Kinds | Parts by Mass[6)] | Kinds | Parts by Mass[6)] |
| Ex. 1 | — | — | Si-A | 2 | 0.52 | Si-A | 1 | — | — |
| Ex. 2 | — | — | Si-A | 2 | 0.48 | Si-A | 1 | — | — |
| Ex. 3 | — | — | Si-A | 2 | 0.50 | Si-A | 1 | — | — |
| Ex. 4 | — | — | Si-A | 2 | 0.48 | Si-A | 1 | — | — |
| Ex. 5 | — | — | Si-A | 2 | 0.46 | Si-A | 1 | — | — |
| Ex. 6 | — | — | Si-A | 2 | 0.52 | Si-A | 1 | — | — |
| Ex. 7 | — | — | Si-A | 2 | 0.50 | Si-A | 1 | — | — |
| Ex. 8 | — | — | Si-A | 2 | 0.49 | Si-A | 1 | — | — |
| Ex. 9 | — | — | Si-B | 2 | 0.51 | Si-A | 1 | — | — |
| Ex. 10 | — | — | Si-C | 2 | 0.50 | Si-A | 1 | — | — |
| Ex. 11 | — | — | Si-D | 2 | 0.52 | Si-A | 1 | — | — |
| Ex. 12 | — | — | Si-A | 0.5 | 0.49 | Si-A | 1 | — | — |
| Ex. 13 | — | — | Si-A | 1 | 0.50 | Si-A | 1 | — | — |
| Ex. 14 | — | — | Si-A | 5 | 0.49 | Si-A | 1 | — | — |
| Ex. 15 | — | — | Si-A | 2 | 0.54 | Si-A | 1 | — | — |
| Ex. 16 | — | — | Si-A | 2 | 0.52 | Si-D | 1 | — | — |
| Comp. Ex. 1 | — | — | — | — | 0.51 | Si-A | 2 | Si-A | 1 |
| Comp. Ex. 2 | — | — | — | — | 0.51 | Si-A | 3 | — | — |
| Comp. Ex. 3 | — | — | Si-A | 2 | 0.33 | Si-A | 1 | — | — |
| Comp. Ex. 4 | PLA-1 | 20 | — | — | — | — | — | — | — |
| Comp. Ex. 5 | PLA-1 | 20 | Si-A | 2 | 0.48 | Si-A | 1 | — | — |
| Comp. Ex. 6 | — | — | Si-A | 2 | 0.51 | Si-A | 1 | — | — |

[1)]Kinds and amount of a polyester subjected to a transesterification reaction.

[2)]Kinds and amount of a polylactic acid subjected to a transesterification reaction.

[3)]Kinds and amount of a polyester added other than a resin composition.

[4)]Kinds and amount of a polyactic acid added other than resin composition.

[5)]Parts by mass, based on 100 parts by mass of a melt-kneaded mixture.

[6)]Parts by mass, based on 100 parts by mass of the toner matrix particles.

Test Example 1: Background Fog

Each of the toners was loaded to a nonmagnetic monocomponent development device "OKI MICROLINE 5400" manufactured by Oki Data Corporation, equipped with an organic photoconductor (OPC), and images having a print coverage of 10% were printed for 2,000 sheets. After printing, a toner cartridge was replaced with new one, and images having a print coverage of 10% were printed for 100 sheets. Next, a white blank (print coverage of 0%) image was printed for 5 sheets in the state where new and old toners were sufficiently mixed, and thereafter the toners on the photoconductor surface were adhered to a "Scotch® mending tape 810" manufactured by SUMITOMO 3M LIMITED, width of 18 mm, and the difference with the optical density of the tape itself before adhering the toner was measured. The measurement was carried out using a color-difference meter "X-Rite" (manufactured by X-Rite). The smaller the value, the more inhibited the background fog. The results are shown in Table E-5.

Test Example 2: Photoconductor Damages

Each of the toners was loaded to the same device as in Test Example 1, and images having a print coverage of 5% were printed for 5,000 sheets. Thereafter, the toner cartridge was replaced with new toner cartridges loaded with each of toner three times, and images were printed for a total of 20,000 sheets. After printing, a photoconductor unit was removed from an image drum, photoconductor damages on the photoconductor unit were observed, and the number of generation of photoconductor damages was counted. The smaller the value, the more inhibited the generation of photoconductor damages. The results are shown in Table E-5.

Test Example 3: Flowability

The cohesiveness of the toners was measured and used as an index of flowability. The lower the numerical value, the more excellent the flowability. The results are shown in Table E-5.

Cohesiveness

The cohesiveness is measured using a powder tester manufactured by Hosokawa Micron Corporation.

Sieves having openings of 150 μm, 75 μm, and 45 μm are stacked on top of each other, 4 g of a toner is placed on the uppermost sieve, and the sieves are vibrated at an oscillation width of 1 mm for 60 seconds. After the vibration, an amount of the toner remaining on the sieve is measured, and the cohesiveness is calculated using the following sets of formulas:

$$\text{Cohesiveness} = a + b + c, \text{ wherein}$$

$$a = \frac{\text{Mass of Toner Remaining on Top Sieve}}{\text{Amount of Sample}} \times 100$$

$$b = \frac{\text{Mass of Toner Remaining on Middle Sieve}}{\text{Amount of Sample}} \times 100 \times \frac{3}{5}$$

$$c = \frac{\text{Mass of Toner Remaining on Lower Sieve}}{\text{Amount of Sample}} \times 100 \times \frac{1}{5}$$

TABLE 22

Table E-5

| | Properties of Toner | | |
|---|---|---|---|
| | Background Fog | Photoconductor Damages (—) | Cohesiveness |
| Ex. 1 | 0.12 | 21 | 4.3 |
| Ex. 2 | 0.16 | 26 | 5.4 |
| Ex. 3 | 0.13 | 22 | 4.8 |
| Ex. 4 | 0.14 | 22 | 5.1 |
| Ex. 5 | 0.20 | 18 | 9.6 |
| Ex. 6 | 0.18 | 21 | 3.8 |
| Ex. 7 | 0.16 | 24 | 5.2 |
| Ex. 8 | 0.20 | 23 | 12.6 |
| Ex. 9 | 0.21 | 18 | 3.6 |
| Ex. 10 | 0.26 | 23 | 23.8 |
| Ex. 11 | 0.15 | 21 | 29.6 |
| Ex. 12 | 0.32 | 23 | 18.6 |
| Ex. 13 | 0.26 | 22 | 7.6 |
| Ex. 14 | 0.08 | 32 | 2.1 |
| Ex. 15 | 0.15 | 22 | 3.4 |
| Ex. 16 | 0.18 | 26 | 8.5 |
| Comp. Ex. 1 | 0.18 | 38 | 3.8 |
| Comp. Ex. 2 | 0.12 | 44 | 4.0 |
| Comp. Ex. 3 | 0.59 | 20 | 36.3 |
| Comp. Ex. 4 | Unable to obtain a pulverizable melt-kneaded mixture | | |
| Comp. Ex. 5 | 0.63 | 23 | 39.1 |
| Comp. Ex. 6 | 0.75 | 18 | 40.3 |

It can be seen from the result of Table E-5 that the toners of Examples 1 to 16 inhibit the generation of background fog or photoconductor damages and have excellent flowability, as compared to toners of Comparative Examples 1 to 6.

The toner for electrophotography of the present invention is suitably used in developing latent images formed in an electrophotographic method, an electrostatic recording method, an electrostatic printing method, or the like.

The invention claimed is:

1. A method for producing a toner for electrophotography, comprising:

(1) mixing a polyester and a polylactic acid at a temperature of 140° C. or higher and 200° C. or lower and subjecting the mixture to a transesterification reaction to provide a resin composition; and (2) mixing the resin composition obtained from said (1) mixing with a polyester which is identical to or different from the polyester of said (1) mixing, in a production of a toner for electrophotography.

2. The method for producing a toner for electrophotography according to claim 1, wherein said (2) mixing comprises:

(2A) mixing the resin composition obtained from said (1) mixing with a polyester which is identical to or different from the polyester of said (1) mixing and melt-kneading the obtained raw material mixture for a toner, and wherein the method further comprises (3A) pulverizing and classifying the melt-kneaded mixture obtained from said (2A) mixing.

3. The method for producing a toner for electrophotography according to claim 2, wherein said (3A) pulverizing is carried out in the presence of fine inorganic particles.

4. The method for producing a toner for electrophotography according to claim 1, wherein said (2) mixing comprises:

(2B) dispersing the resin composition obtained from (1) mixing in an aqueous dispersion and mixing the dispersed mixture with an aqueous dispersion comprising a polyester which is identical to or different from the polyester of said (1) mixing to provide a liquid mixture, and wherein the method further comprises (3B) aggregating and thermally depositing a resin composition particle, in the liquid mixture obtained from said (2B) dispersing.

5. The method for producing a toner for electrophotography according to claim 1, wherein a transesterification ratio is from 0.1% or more to 35% or less based on the polylactic acid in the transesterification reaction of said (1) mixing.

6. The method for producing a toner for electrophotography according to claim 1, wherein said (1) mixing is carried out for a time of 0.5 hours or more and 15 hours or less.

7. The method for producing a toner for electrophotography according to claim 1, wherein a colorant is further mixed during said (2) mixing.

* * * * *